US011509100B2

(12) United States Patent
Chen et al.

(10) Patent No.: US 11,509,100 B2
(45) Date of Patent: Nov. 22, 2022

(54) HIGH DENSITY RECEPTACLE

(71) Applicant: Molex, LLC, Lisle, IL (US)

(72) Inventors: Teng-Kai Chen, San Jose, CA (US); John C. Laurx, Aurora, IL (US); Li Zhuang, Long Grove, IL (US)

(73) Assignee: Molex, LLC, Lisle, IL (US)

( * ) Notice: Subject to any disclaimer, the term of this patent is extended or adjusted under 35 U.S.C. 154(b) by 193 days.

(21) Appl. No.: 16/960,546

(22) PCT Filed: Jan. 8, 2019

(86) PCT No.: PCT/US2019/012649

§ 371 (c)(1),
(2) Date: Jul. 8, 2020

(87) PCT Pub. No.: WO2019/139882

PCT Pub. Date: Jul. 18, 2019

(65) Prior Publication Data

US 2021/0066862 A1 Mar. 4, 2021

Related U.S. Application Data

(60) Provisional application No. 62/615,301, filed on Jan. 9, 2018.

(51) Int. Cl.
*H01R 12/00* (2006.01)
*H01R 13/6586* (2011.01)
(Continued)

(52) U.S. Cl.
CPC ..... *H01R 13/6586* (2013.01); *H01R 9/2408* (2013.01); *H01R 12/7076* (2013.01); *H01R 13/6471* (2013.01); *H01R 13/6599* (2013.01)

(58) Field of Classification Search
CPC ..... H01R 13/6658; H01R 23/025; H01R 13/658; H01R 23/6873
See application file for complete search history.

(56) References Cited

U.S. PATENT DOCUMENTS 5,800,186 A * 9/1998 Ramirez ..... H01R 12/721 439/74
6,561,821 B1 * 5/2003 Yu ..... H01R 12/52 439/74
(Continued)

FOREIGN PATENT DOCUMENTS

CN 101073184 A 11/2007
CN 101779341 A 7/2010
(Continued)

OTHER PUBLICATIONS

International search report and written opinion received for PCT application No. PCT/US2019/012649, dated Apr. 30, 2019, 9 pages.
(Continued)

*Primary Examiner* — Phuong Chi Thi Nguyen

(57) ABSTRACT

A connector assembly includes an insulative housing, first and second conductive ground wafers (see e.g., 661 and 663) and a plurality of grounding links. The insulative housing has a plurality of conductive signal terminals disposed therein (see e.g., 662). The insulative housing has opposite side surfaces and a plurality of openings therein extending between the side surfaces. The second ground wafer is spaced from and parallel to the first ground wafer. The grounding links are electrically connected to one of the ground wafers and extend towards another of the ground wafers and extend through the openings in the housing.

19 Claims, 62 Drawing Sheets

(51) Int. Cl.

| | |
|---|---|
| ***H01R 9/24*** | (2006.01) |
| ***H01R 12/70*** | (2011.01) |
| ***H01R 13/6471*** | (2011.01) |
| ***H01R 13/6599*** | (2011.01) |

(56) References Cited

U.S. PATENT DOCUMENTS

| | | | | |
|---|---|---|---|---|
| 7,976,318 | B2 | 7/2011 | Fedder et al. | |
| 9,225,122 | B1 | 12/2015 | Evans et al. | |
| 9,246,252 | B2 * | 1/2016 | Kachlic | H01R 13/6582 |
| 9,312,618 | B2 | 4/2016 | Regnier et al. | |
| 9,385,455 | B2 | 7/2016 | Regnier et al. | |
| 10,439,317 | B2 | 10/2019 | Horchler et al. | |
| 10,505,302 | B2 * | 12/2019 | Watanabe | H01R 12/737 |
| 2003/0186595 | A1 | 10/2003 | Provencher et al. | |
| 2003/0220019 | A1 | 11/2003 | Billman et al. | |
| 2004/0224559 | A1 | 11/2004 | Nelson et al. | |
| 2007/0021002 | A1 * | 1/2007 | Laurx | H01R 12/724 439/607.1 |
| 2011/0021082 | A1 | 1/2011 | Kline | |
| 2013/0164955 | A1 * | 6/2013 | Tamai | H01R 13/6469 439/76.1 |
| 2014/0194004 | A1 | 7/2014 | Pickel et al. | |
| 2015/0064968 | A1 | 3/2015 | Davis et al. | |
| 2017/0302036 | A1 | 10/2017 | Regnier et al. | |
| 2022/0039250 | A1 * | 2/2022 | Amleshi | H01R 13/6587 |

FOREIGN PATENT DOCUMENTS

| | | | |
|---|---|---|---|
| CN | 101888032 | A | 11/2010 |
| CN | 201699248 | U | 1/2011 |
| CN | 103682837 | A | 3/2014 |
| CN | 104009303 | A | 8/2014 |
| CN | 104022402 | A | 9/2014 |
| CN | 105284009 | A | 1/2016 |
| CN | 205069933 | U | 3/2016 |
| CN | 106450853 | A | 2/2017 |
| CN | 106469878 | A | 3/2017 |
| TW | 201315051 | A | 4/2013 |
| TW | 201515332 | A | 4/2015 |
| WO | 2015/112717 | A1 | 7/2015 |
| WO | 2017201024 | A1 | 11/2017 |
| WO | 2019/139882 | A1 | 7/2019 |

OTHER PUBLICATIONS

Third office action received for Chinese Application No. 201980007783.1 dated Feb. 15, 2022, 17 pages (10 pages of English translation and 7 pages of official notification).

* cited by examiner

HIGH DENSITY RECEPTACLE

RELATED APPLICATIONS

This application claims priority to International Application No. PCT/US19/12649, filed Jan. 8, 2019, which in turn claims priority to U.S. Provisional Application No. 62/615,301, filed Jan. 9, 2018, both applications are hereby incorporated by reference in their entirety.

TECHNICAL FIELD

This disclosure relates to the field of input/output (IO) connectors, more specifically to IO connectors suitable for use in very high data rate applications.

DESCRIPTION OF RELATED ART

Input/output (IO) connectors are designed to support high data rates and a number of improvements have been developed to help provide data rates that reach 25 Gbps and even higher. In order to support consumer needs and desires, however, many companies are looking at ways to support substantially higher data rates. As a result, development work into supporting very high data rate payloads using NRZ or PAM 4 encoding are underway. These increases will pose significant problems for existing manufacturing techniques, however, as conventional circuit boards and connectors together cannot readily support the associated Nyquist frequencies with maximums exceeding 25 GHz signals. Thus, new architectures and methods will be required.

Another method to support increased data rates has been to try to increase the number of ports. One way to increase the number of ports is to shrink the size of the connector thereby enabling a similar sized connector with additional ports and higher signal density. For example, it is common for many standard connectors to be designed to work on a 0.8 mm or 0.75 mm pitch and recently a connector standard that supports 0.5 mm has been approved (the OCULINK connector). While shrinking the connector size works well for clean sheet designs and is effective at supporting very high density at the front of the rack, smaller connectors are more challenging to use for optical connector designs as the very small size makes it challenging to dissipate sufficient thermal energy when used in active applications. They also tend to use smaller sized conductors, which makes it difficult to support more than 2 or 3 meter length cables with electrical signaling. In addition, the new smaller connector size poses potential issues for backwards compatibility. As a result, certain individuals would appreciate further improvements in connector technology.

SUMMARY

A connector is disclosed that includes a set of wafers formed of terminals which are supported by an insulative frame. The set of wafers can be positioned in a cage without a housing. Card slot members are aligned with contacts of the terminals. In an embodiment a connector can include a wafer that supports two rows of terminals on both sides of a card slot and the connector can be arranged to have a press-fit tails. In addition to press-fit tails, other termination methods are also contemplated.

BRIEF DESCRIPTION OF THE DRAWINGS

The present invention is illustrated by way of example and not limited in the accompanying figures in which like reference numerals indicate similar elements and in which.

DETAILED DESCRIPTION

The detailed description that follows describes exemplary embodiments and is not intended to be limited to the expressly disclosed combination(s). Therefore, unless otherwise noted, features disclosed herein may be combined together to form additional combinations that were not otherwise shown for purposes of brevity.

As can be appreciated from FIGS. 1-5, a receptacle 100 is mounted on a circuit board and provides a right-angled construction that is configured to receive plug module 20. The depicted receptacle design is beneficial to use with plug modules that include cooling slots 115. While the use of cooling slots 115 in a module is not required, the cooling slots 115 can provide additional cooling and make it easier, when used with other features disclosed herein, to cool a module that uses 8 or more watts of power.

Figure 1:
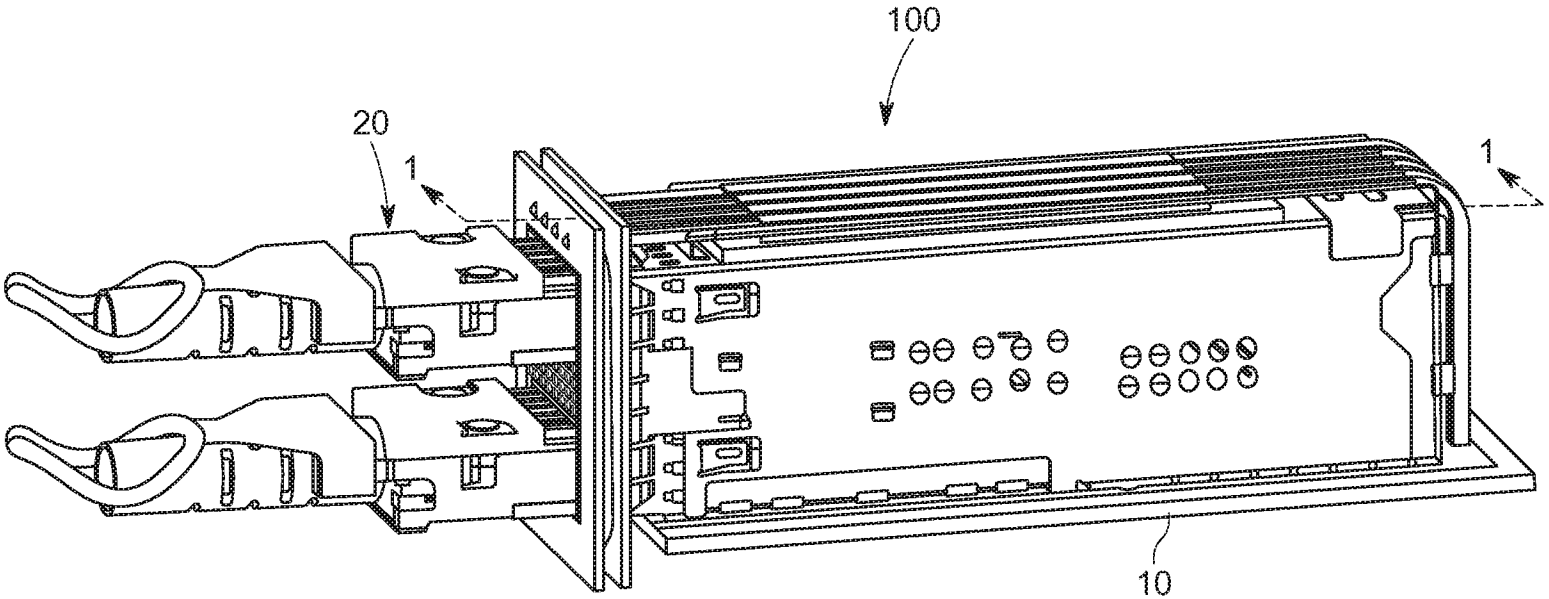
FIG. 1 illustrates a perspective view of an embodiment of connector system.
Figure 2:
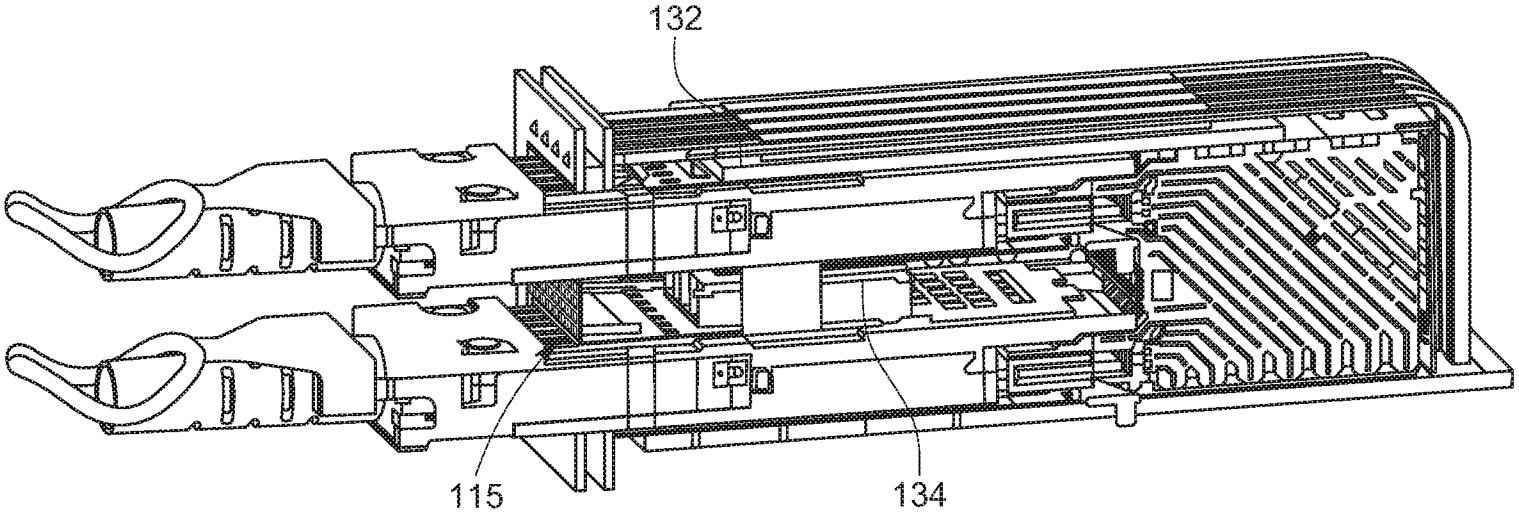
FIG. 2 illustrates a perspective sectional view of the embodiment depicted in FIG. 1, taken along line 1-1.
Figure 3:
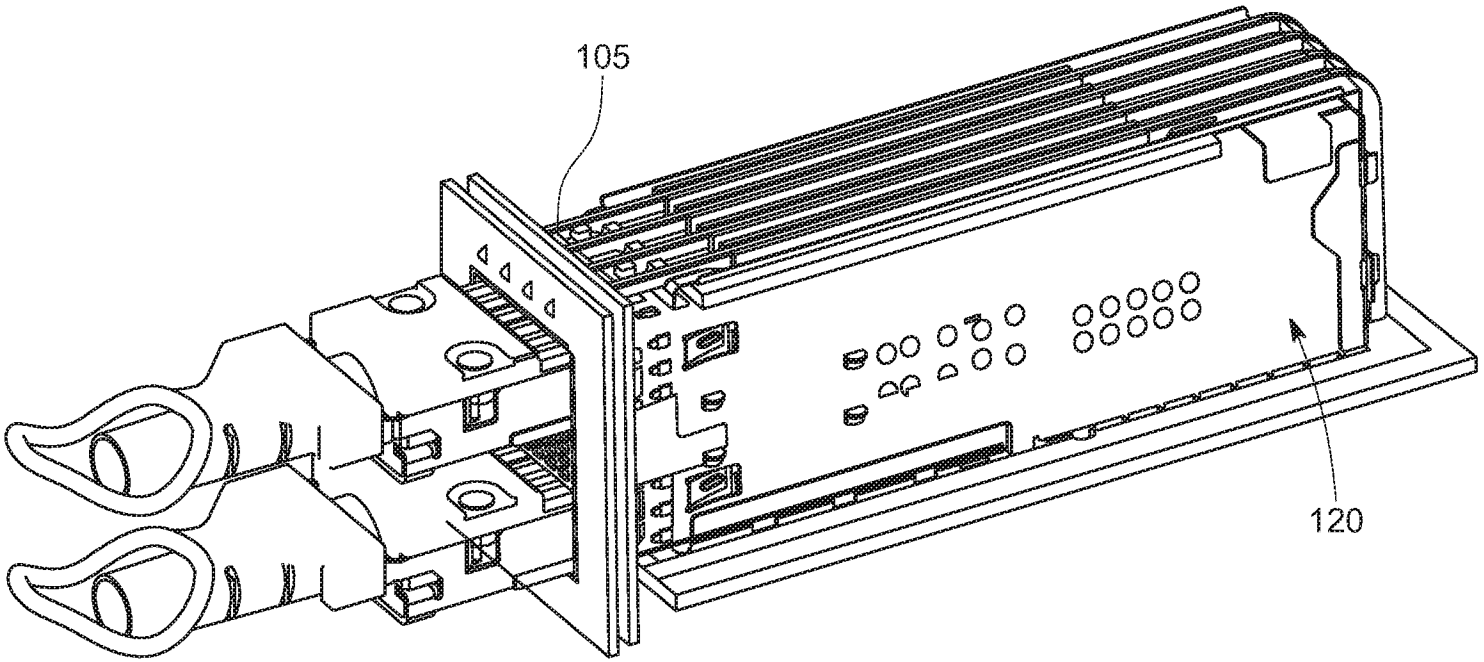
FIG. 3 illustrates another perspective view of the embodiment depicted in FIG. 1.
Figure 4:
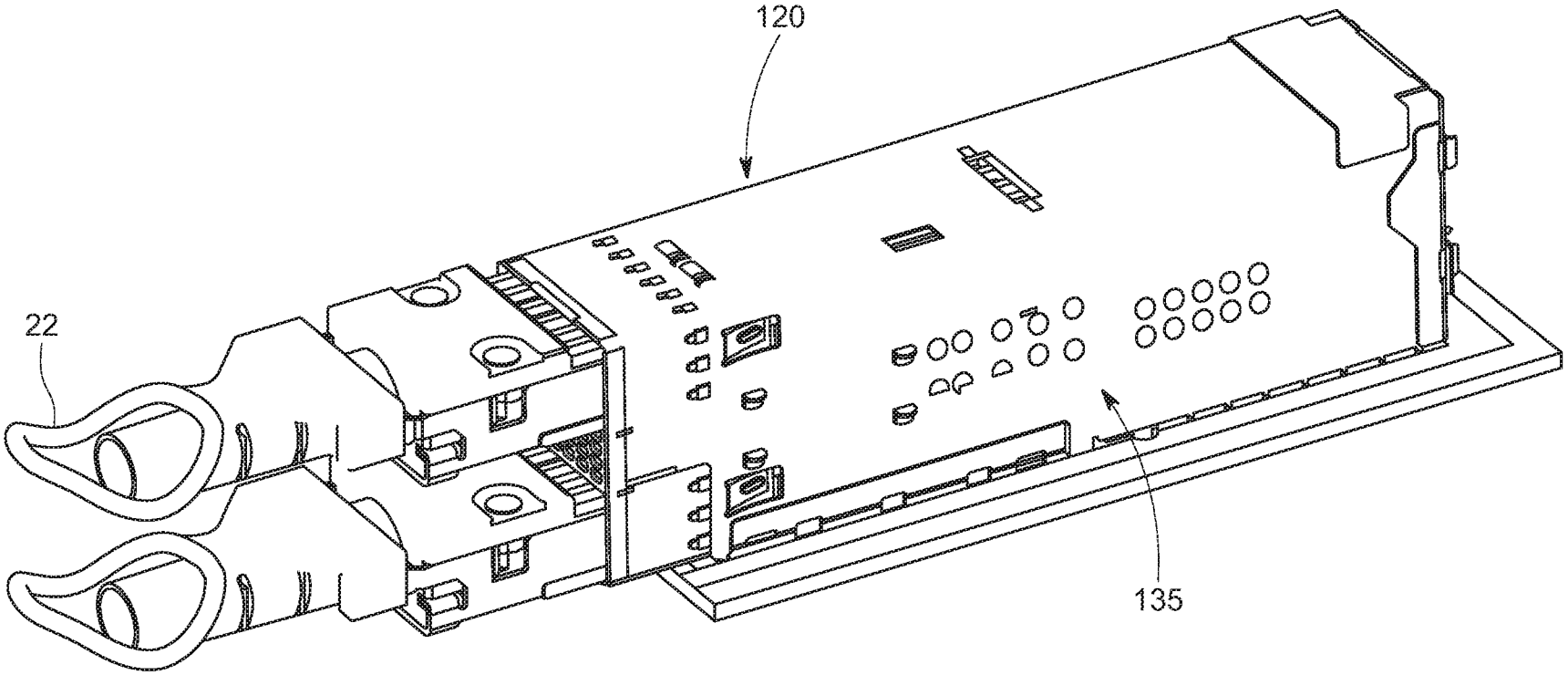
FIG. 4 illustrates a simplified perspective view of the embodiment depicted in FIG. 3.
Figure 5:
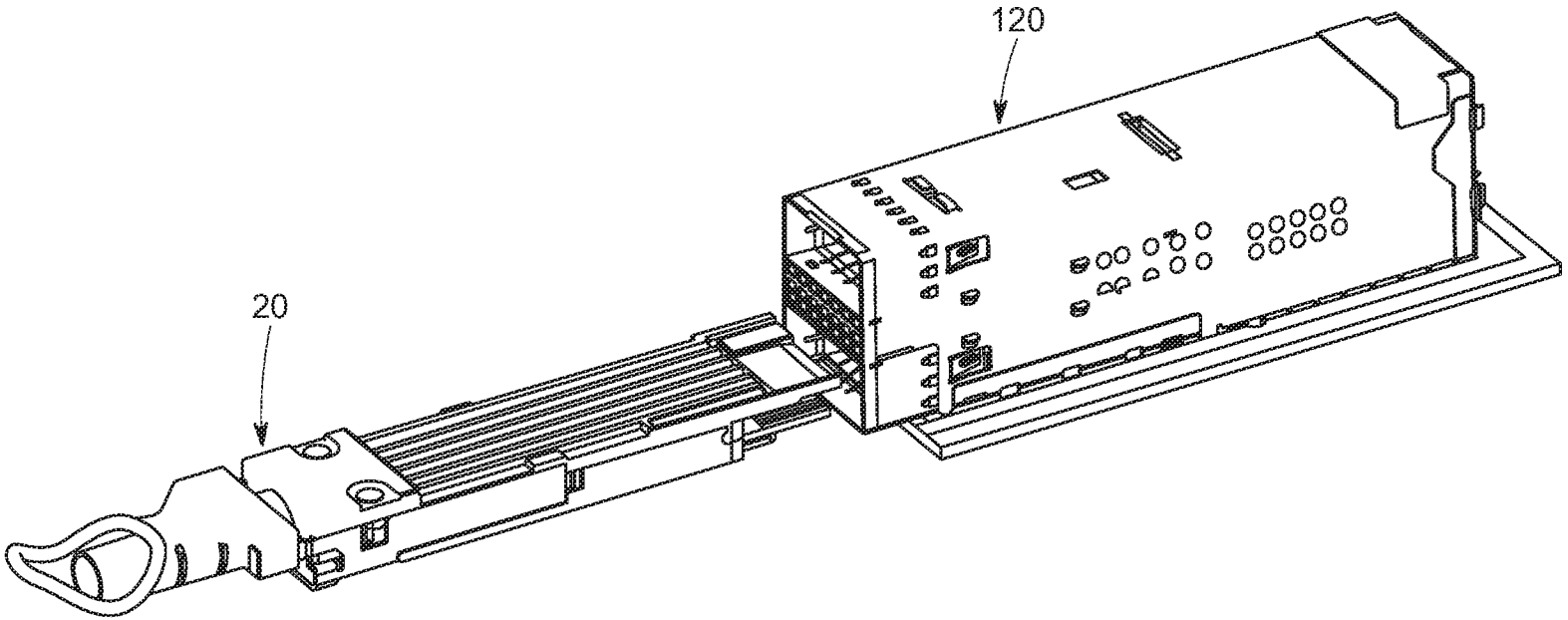
FIG. 5 illustrates a perspective view of an embodiment of a plug module prior to insertion into a receptacle.
Figure 6:
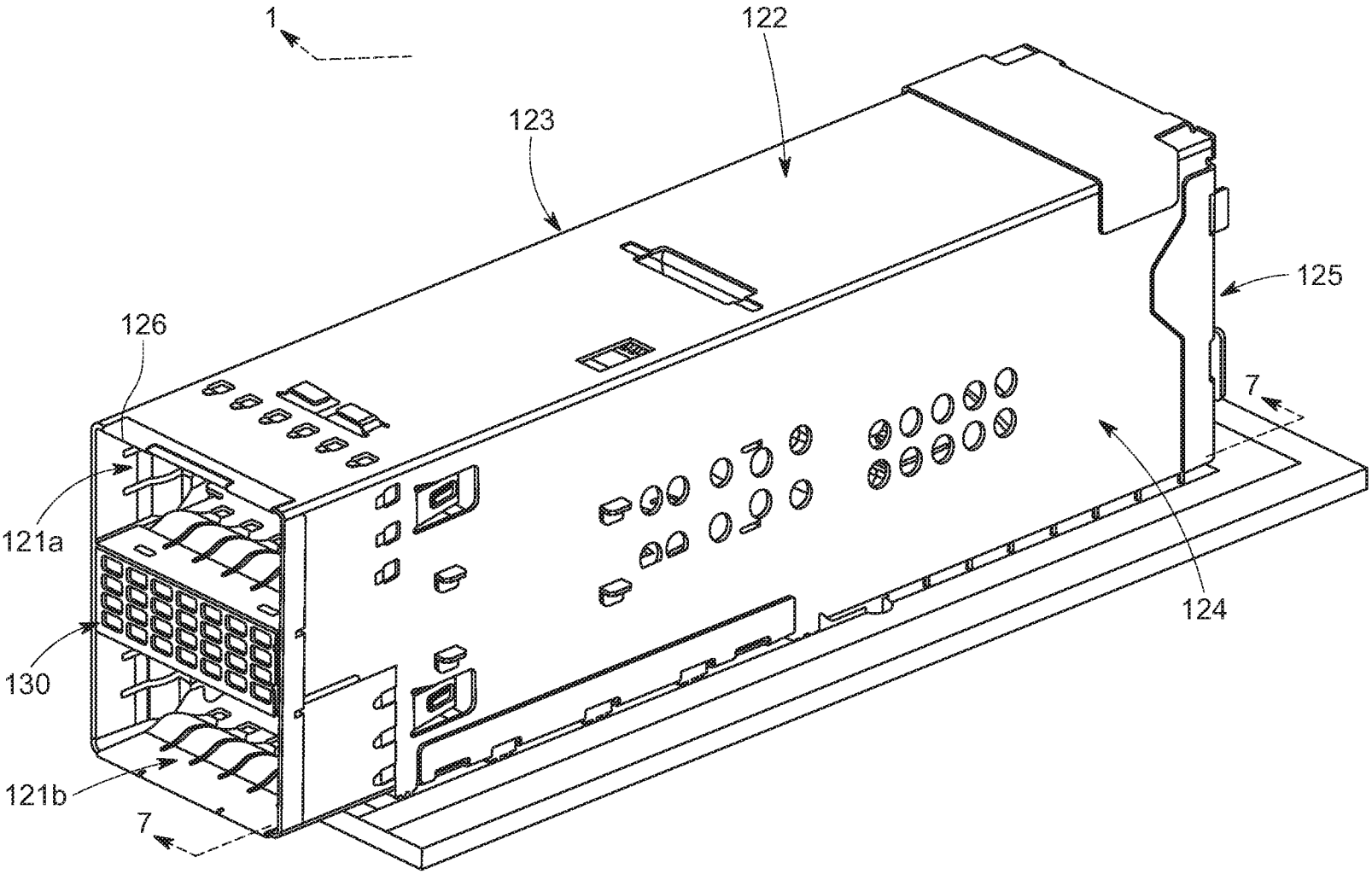
FIG. 6 illustrates a perspective view of an embodiment of a receptacle.
Figure 7A:
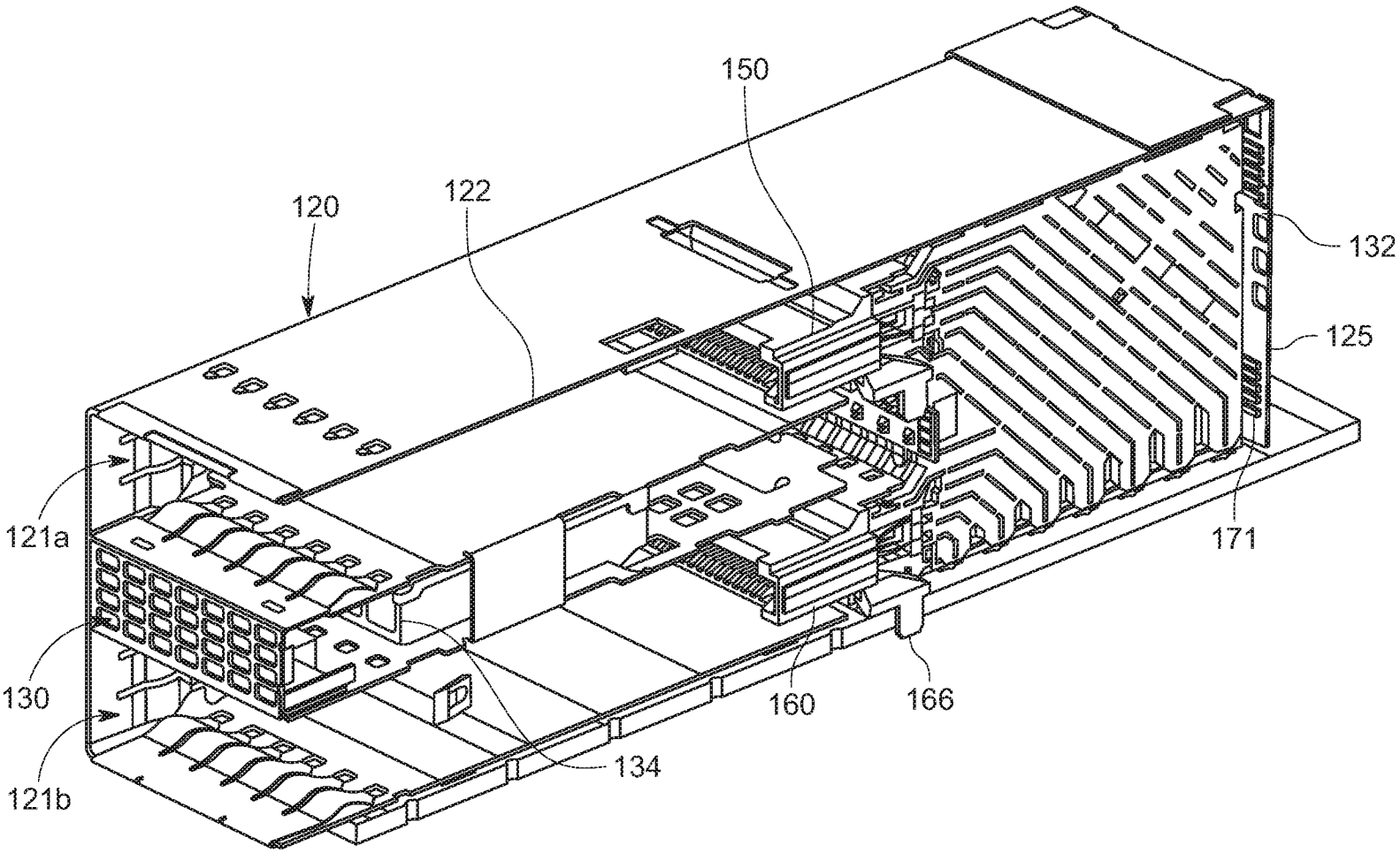
FIG. 7A illustrates a perspective sectional view of the embodiment depicted in FIG. 6, taken along line 7-7.
Figure 7B:
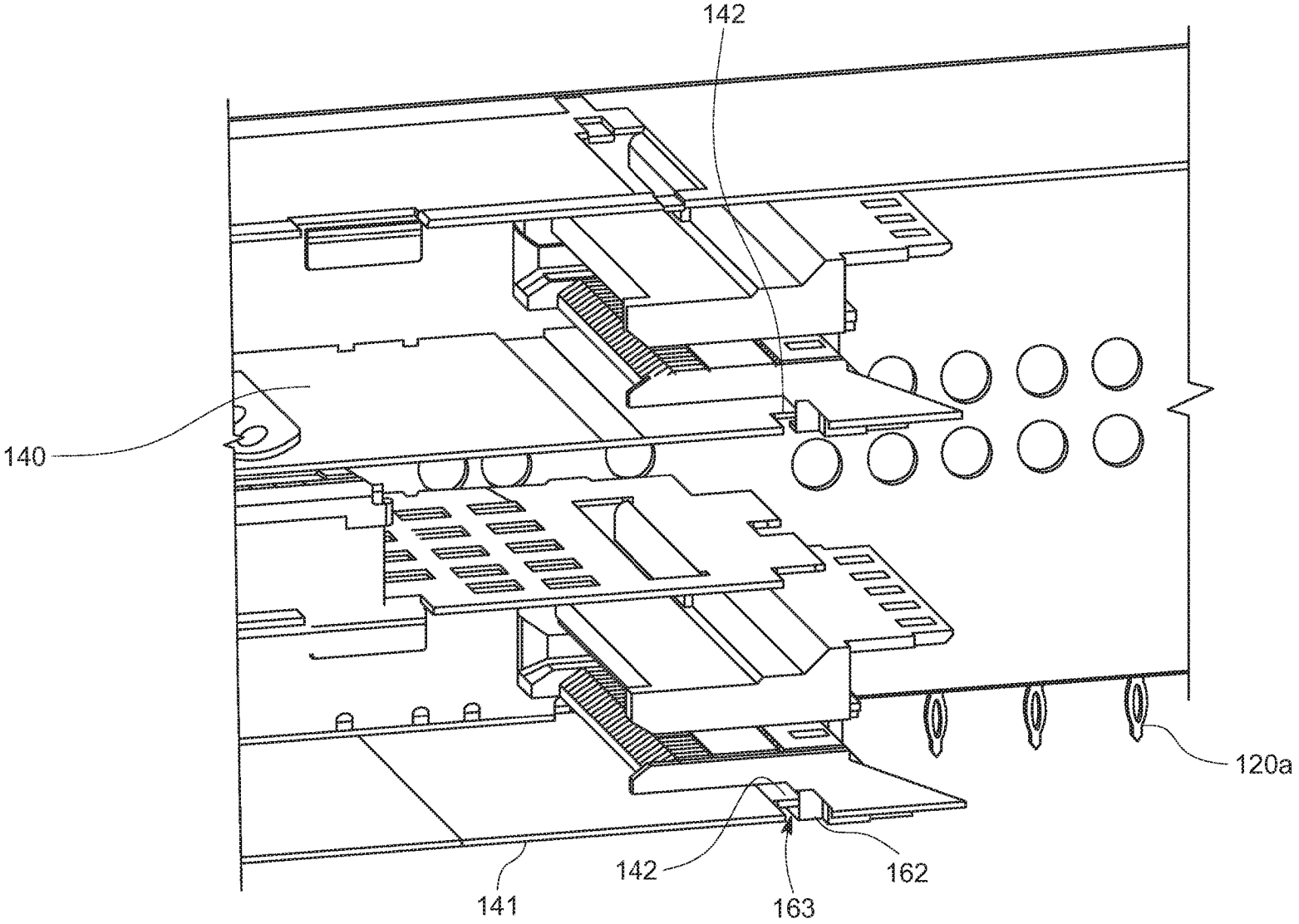
FIG. 7B illustrates an enlarged simplified perspective view of the embodiment depicted in FIG. 7A.
Figure 7C:
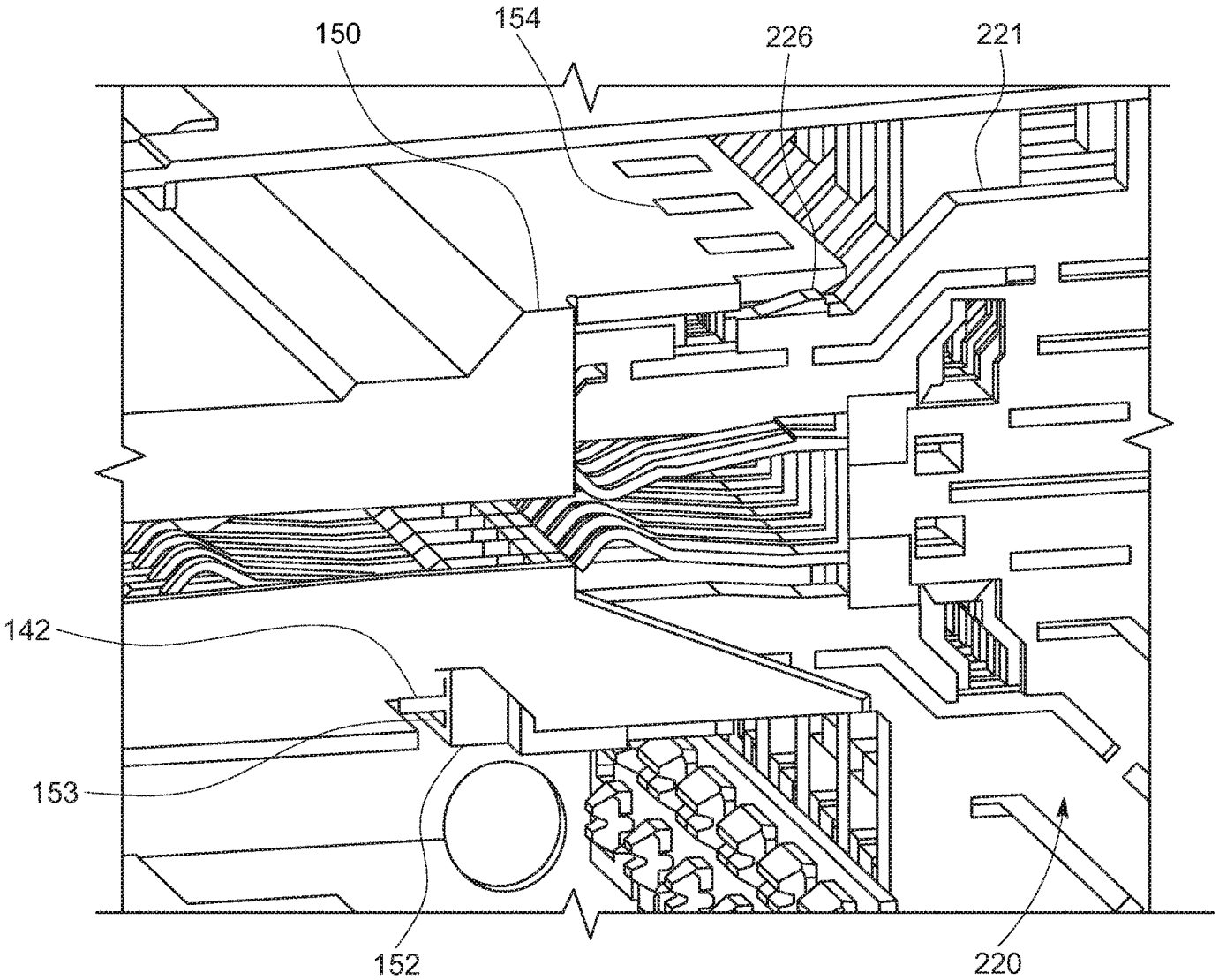
FIG. 7C illustrates an enlarged perspective view of an embodiment depicted in FIG. 7A in which a second set of terminals following in-line behind the traditional first set of terminals can be seen.
Figure 8:
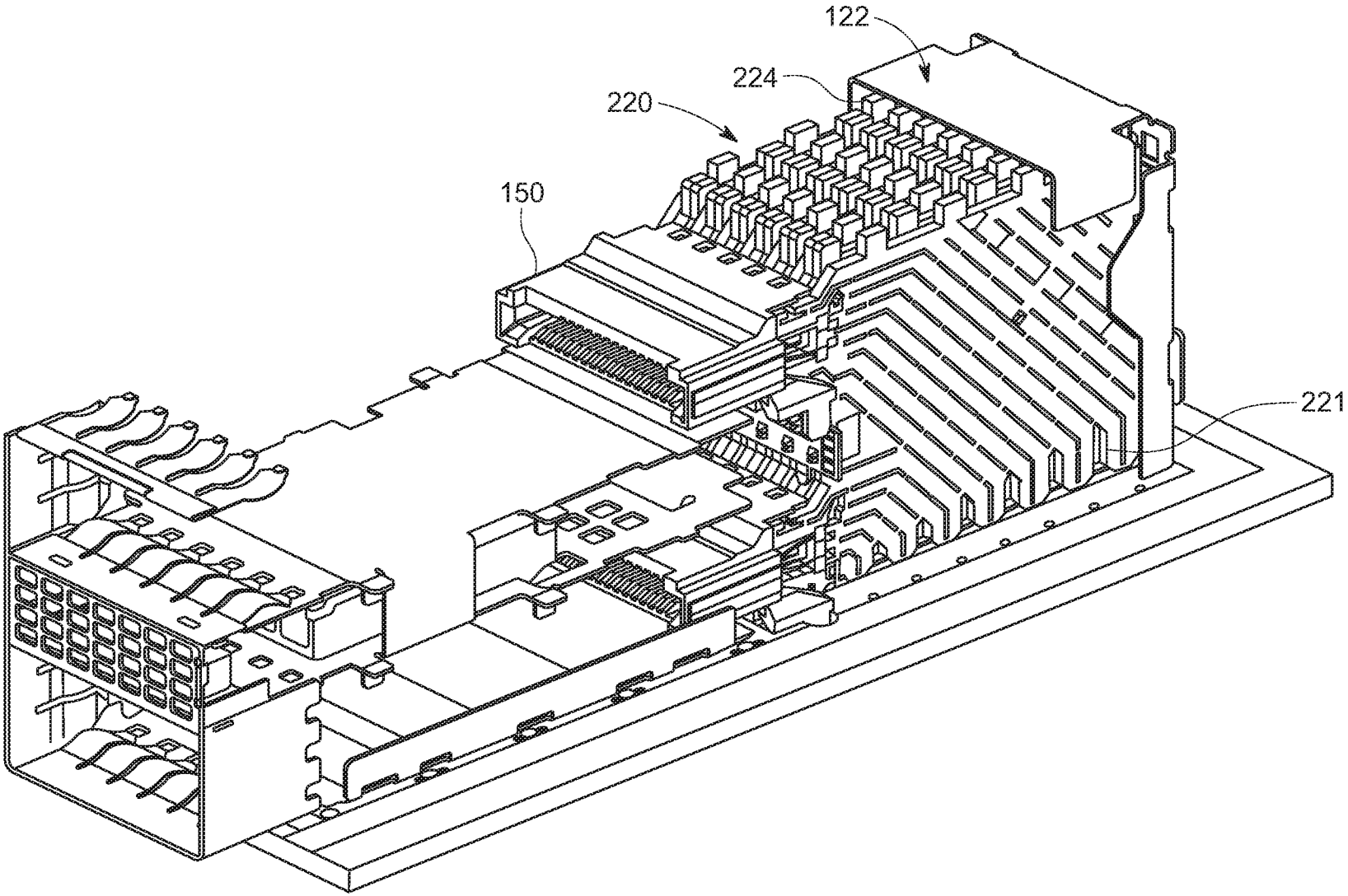
FIG. 8 illustrates a perspective view of the embodiment depicted in FIG. 6 with the cage partially removed.
Figure 9:
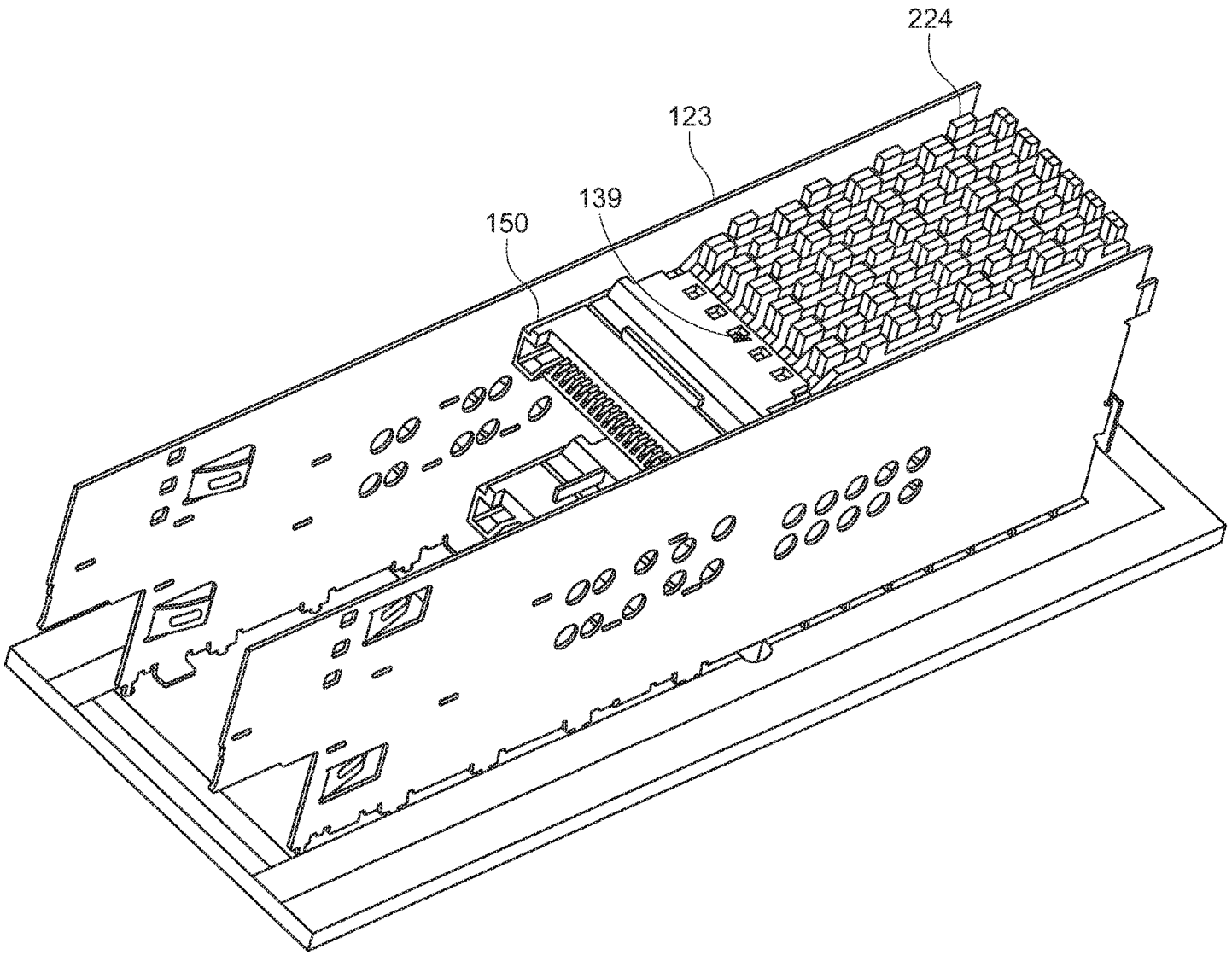
FIG. 9 illustrates a simplified perspective view of the embodiment depicted in FIG. 6 with the top wall and front portion of the cage removed.
Figure 10:
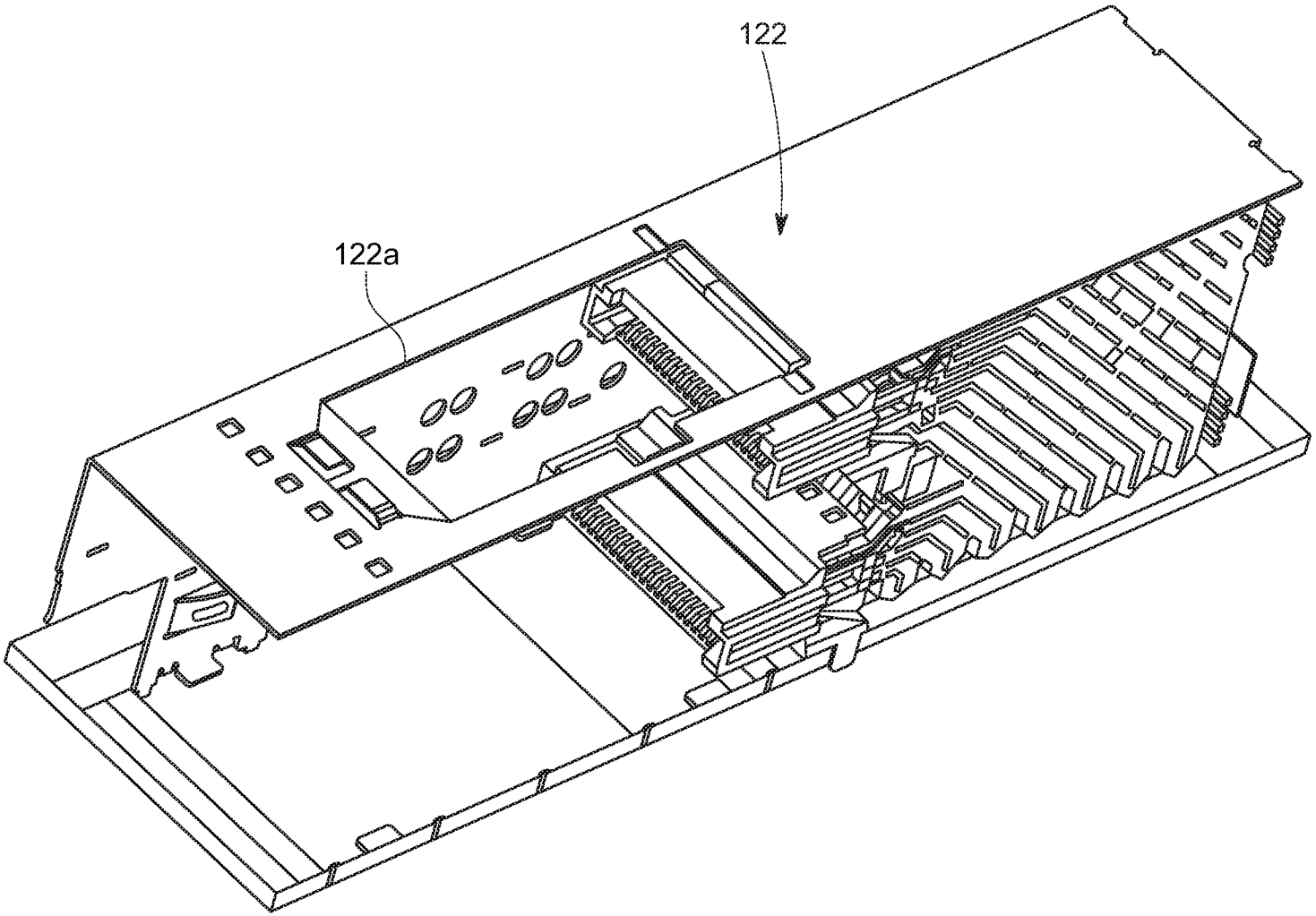
FIG. 10 illustrates a perspective cross-sectional view of the embodiment depicted in FIG. 7 with a modified top wall.
Figure 11A:
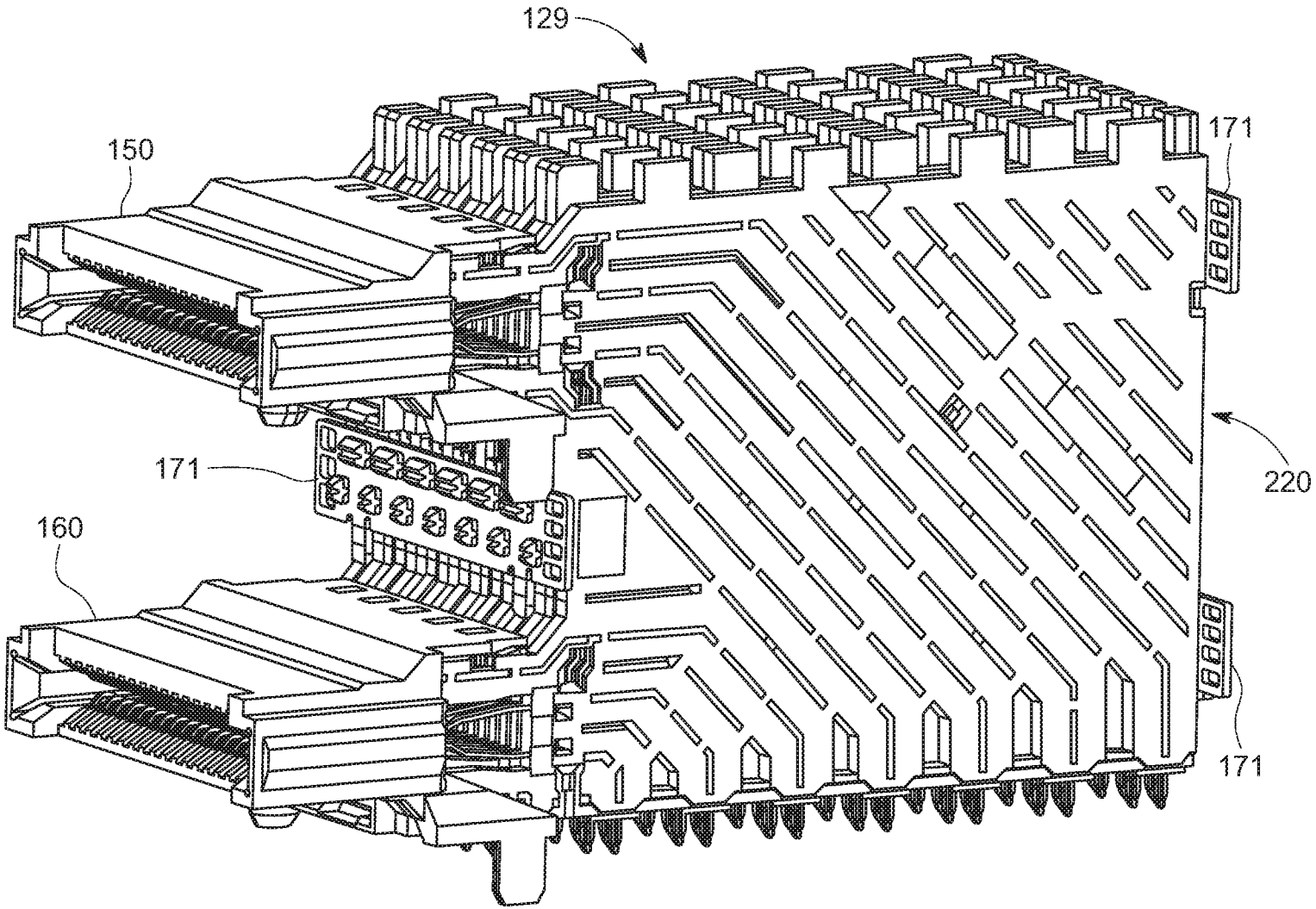
FIG. 11A illustrates a perspective view of an embodiment of a connector.
Figure 11B:
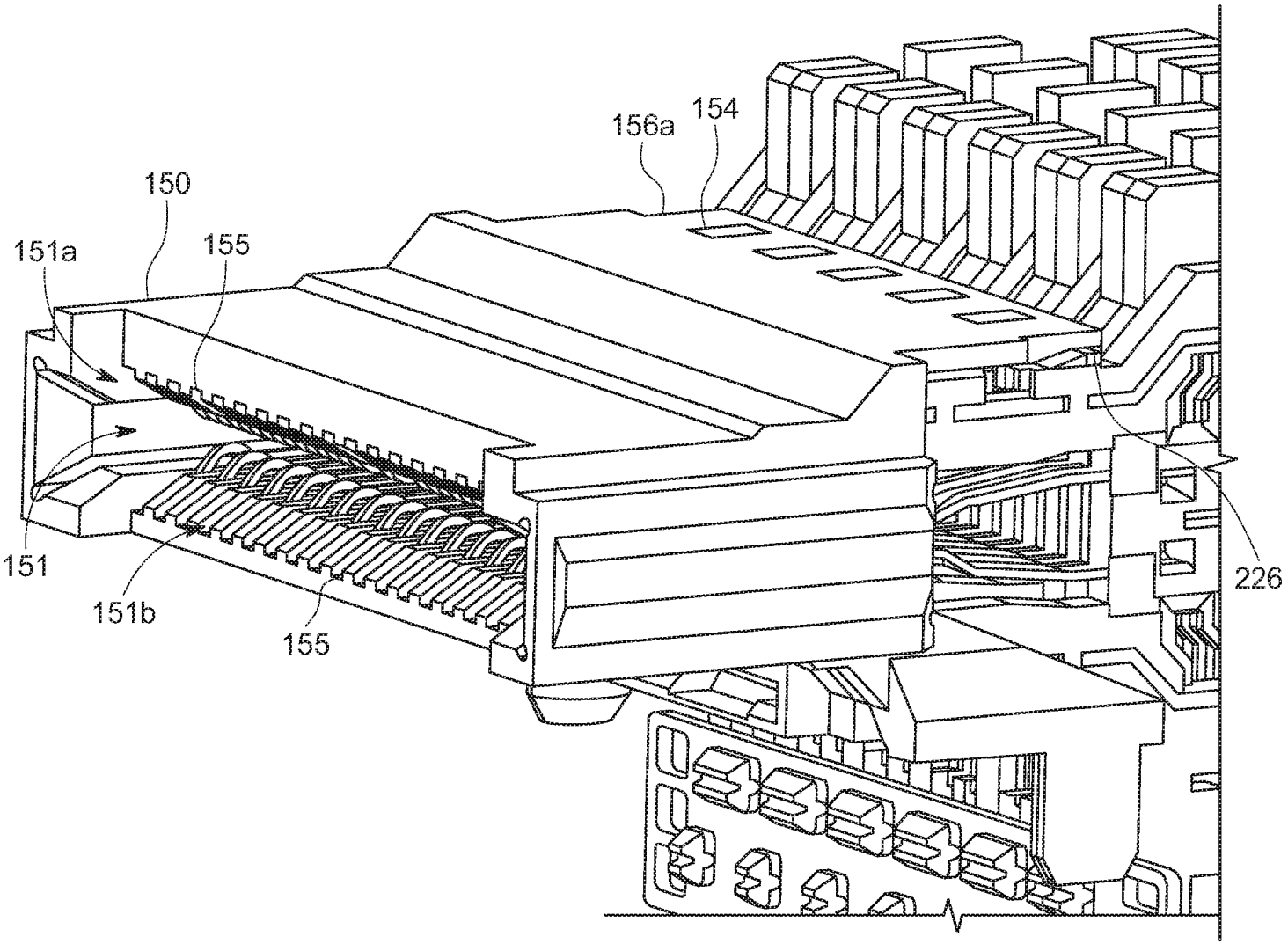
FIG. 11B illustrates an enlarged perspective view of the embodiment depicted in FIG. 11A.
Figure 12:
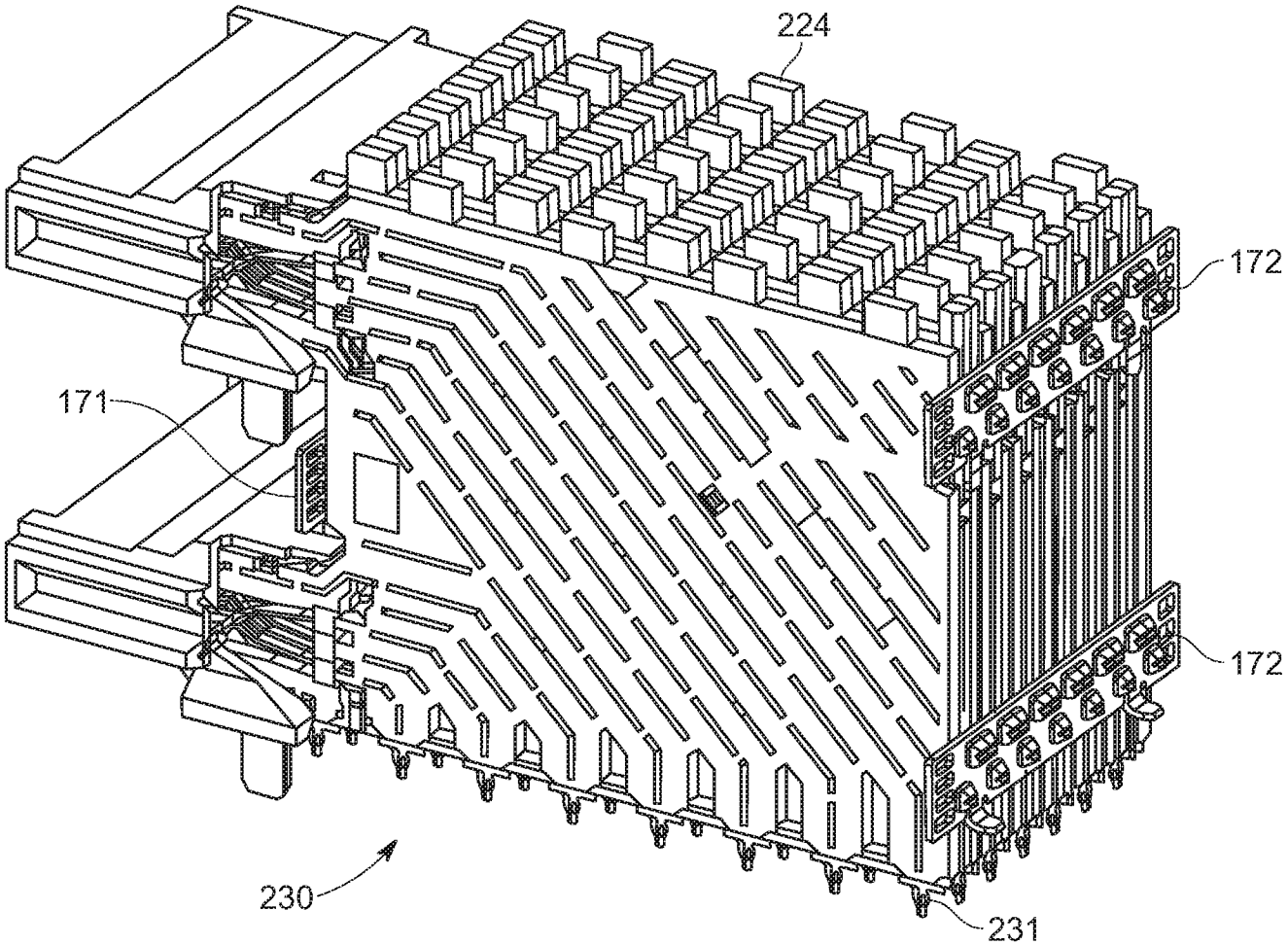
FIG. 12 illustrates another perspective view of the embodiment depicted in FIG. 11A.
Figure 13:
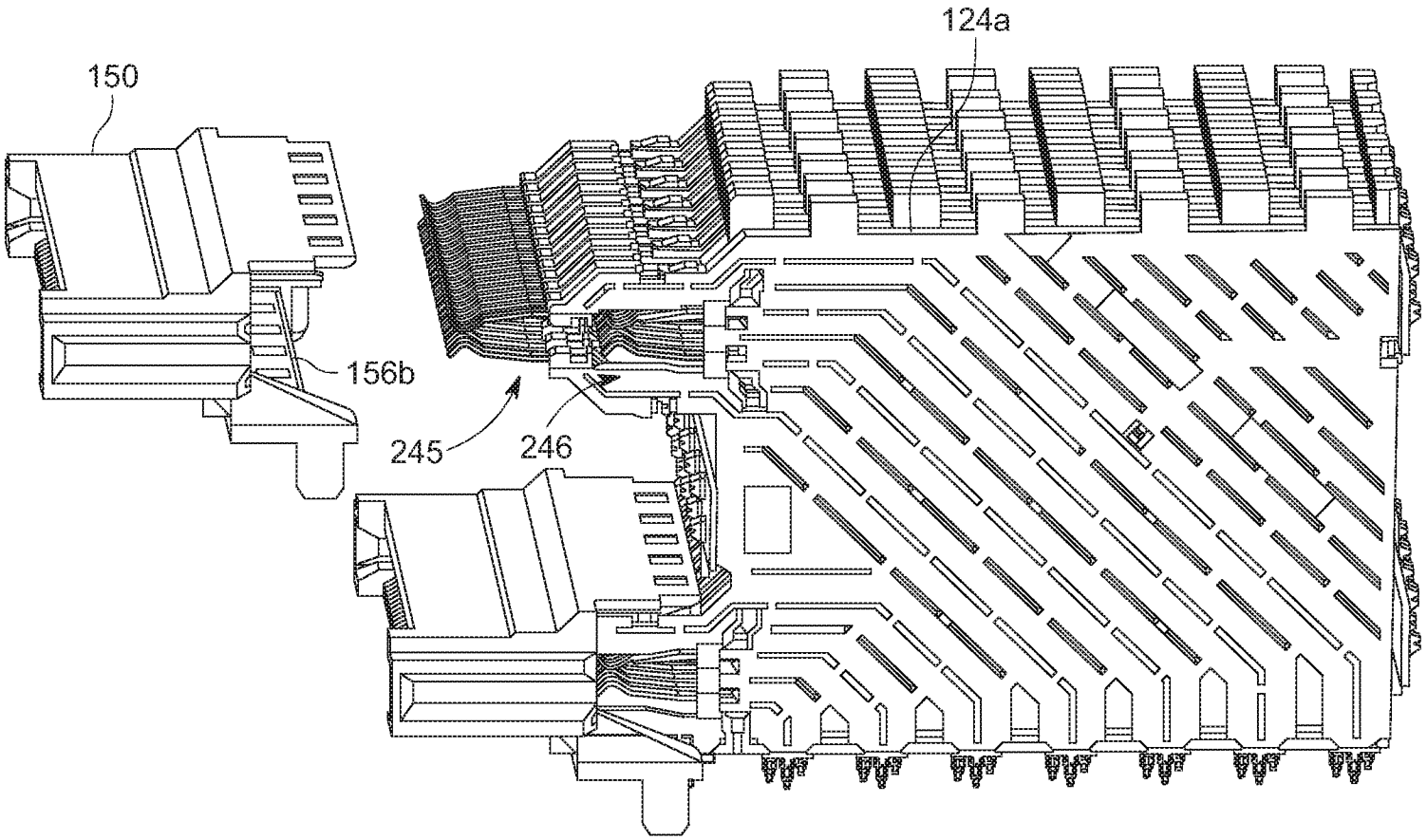
FIG. 13 illustrates a partially exploded perspective view of the embodiment depicted in FIG. 11A.
Figure 14:
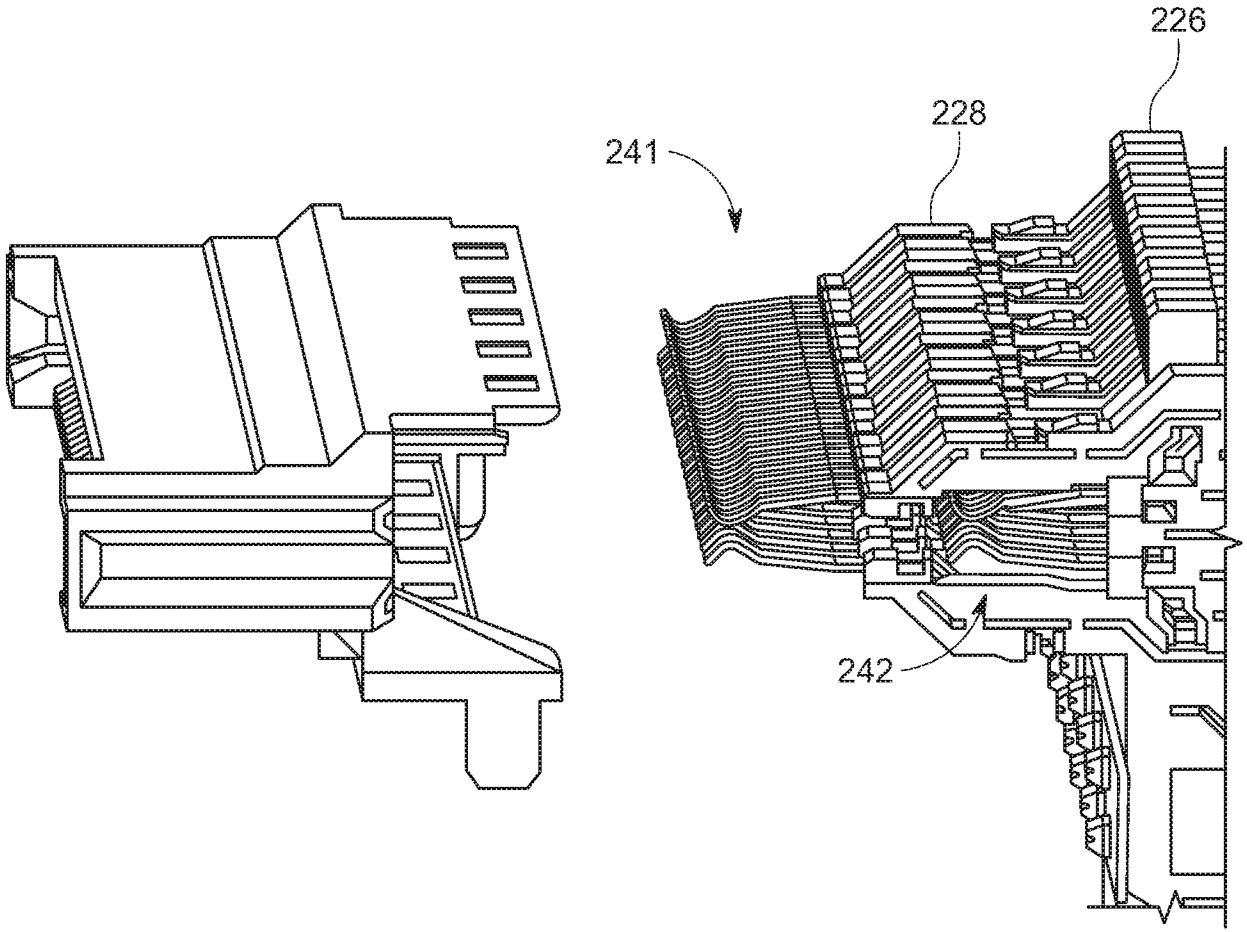
FIG. 14 illustrates an enlarged perspective view of the embodiment depicted in FIG. 13.
Figure 15:
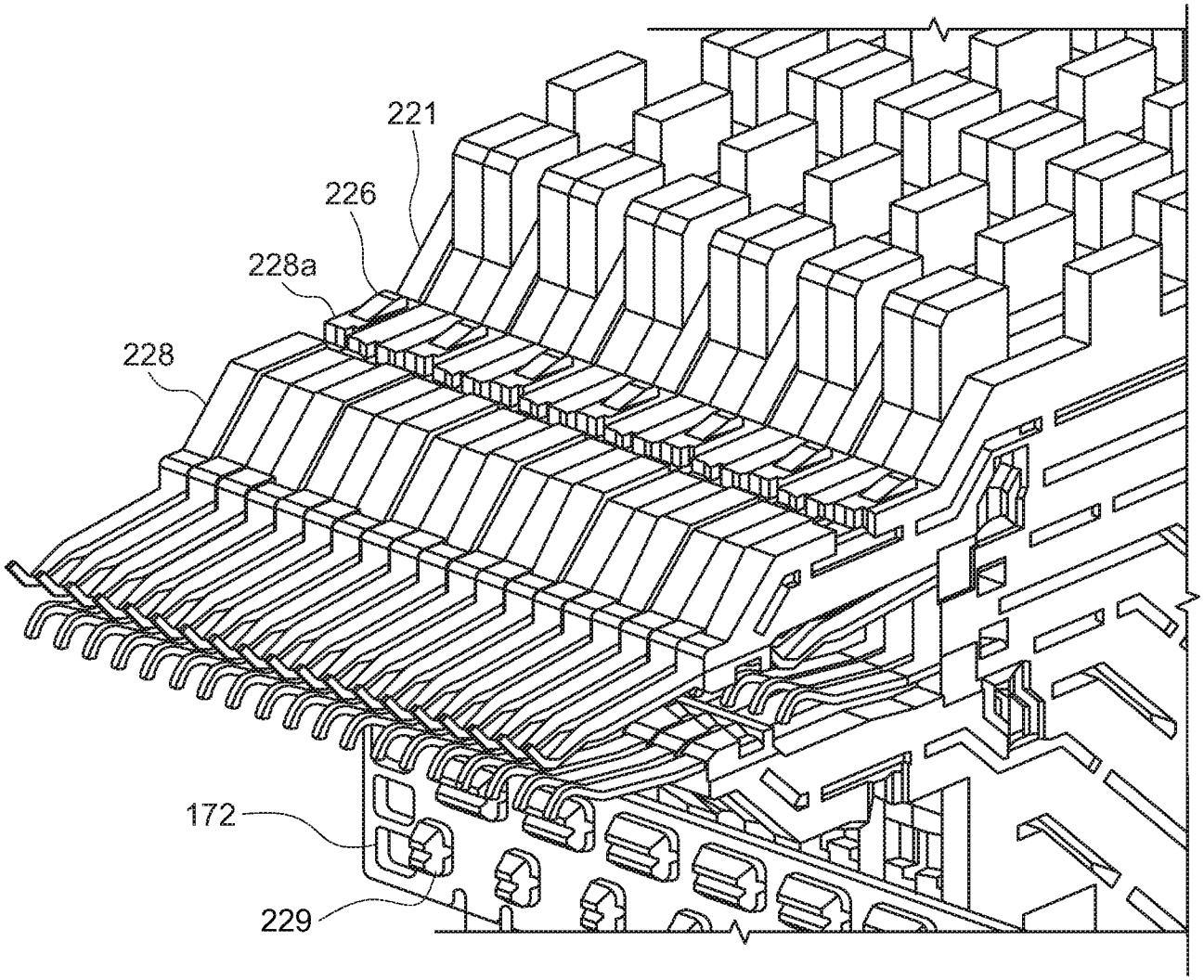
FIG. 15 illustrates a perspective view of the embodiment depicted in FIG. 13 with the card slot plug removed.
Figure 16:
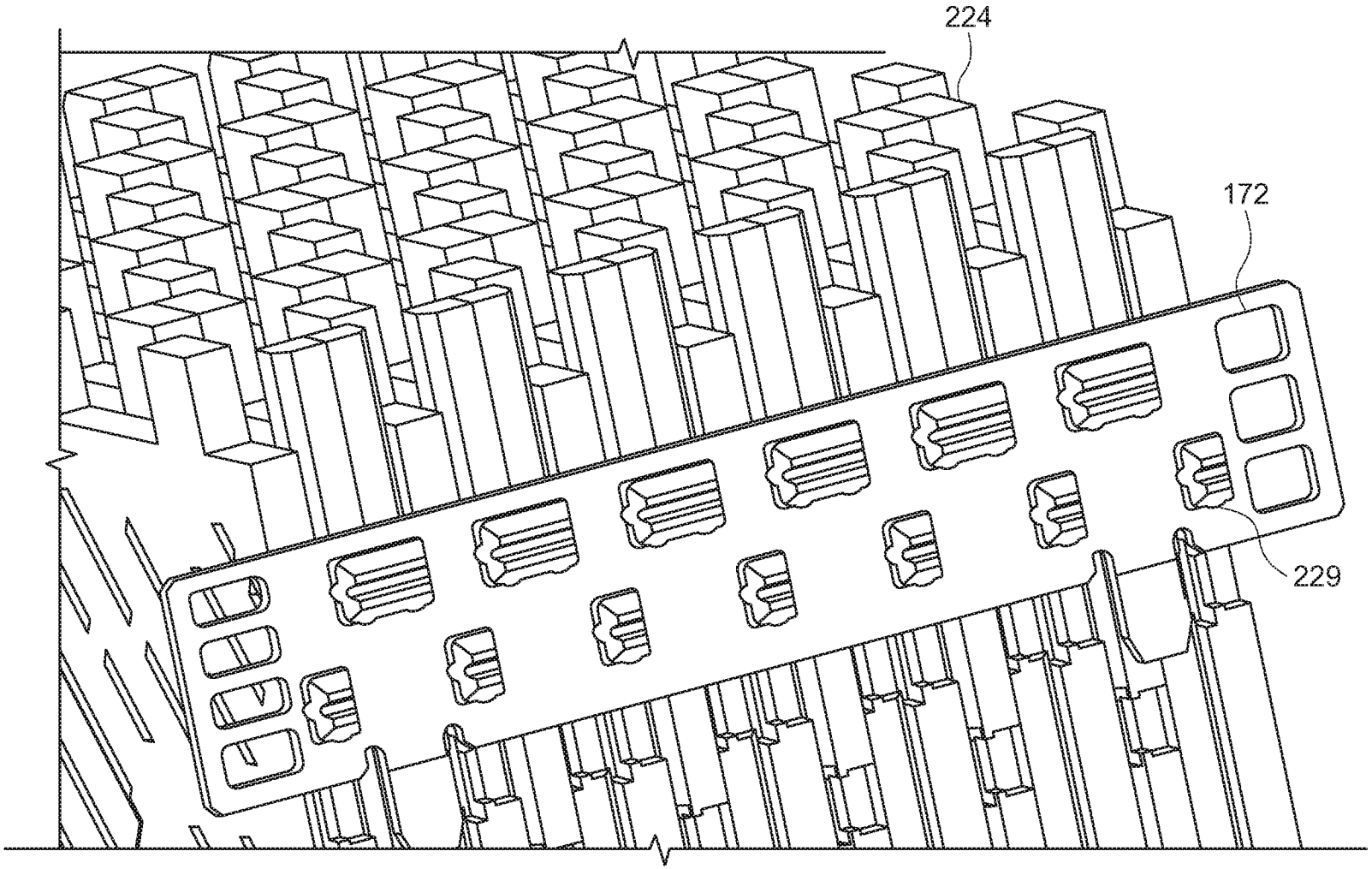
FIG. 16 illustrates a perspective view of an embodiment of a retaining bar securing a wafer set.
Figure 17:
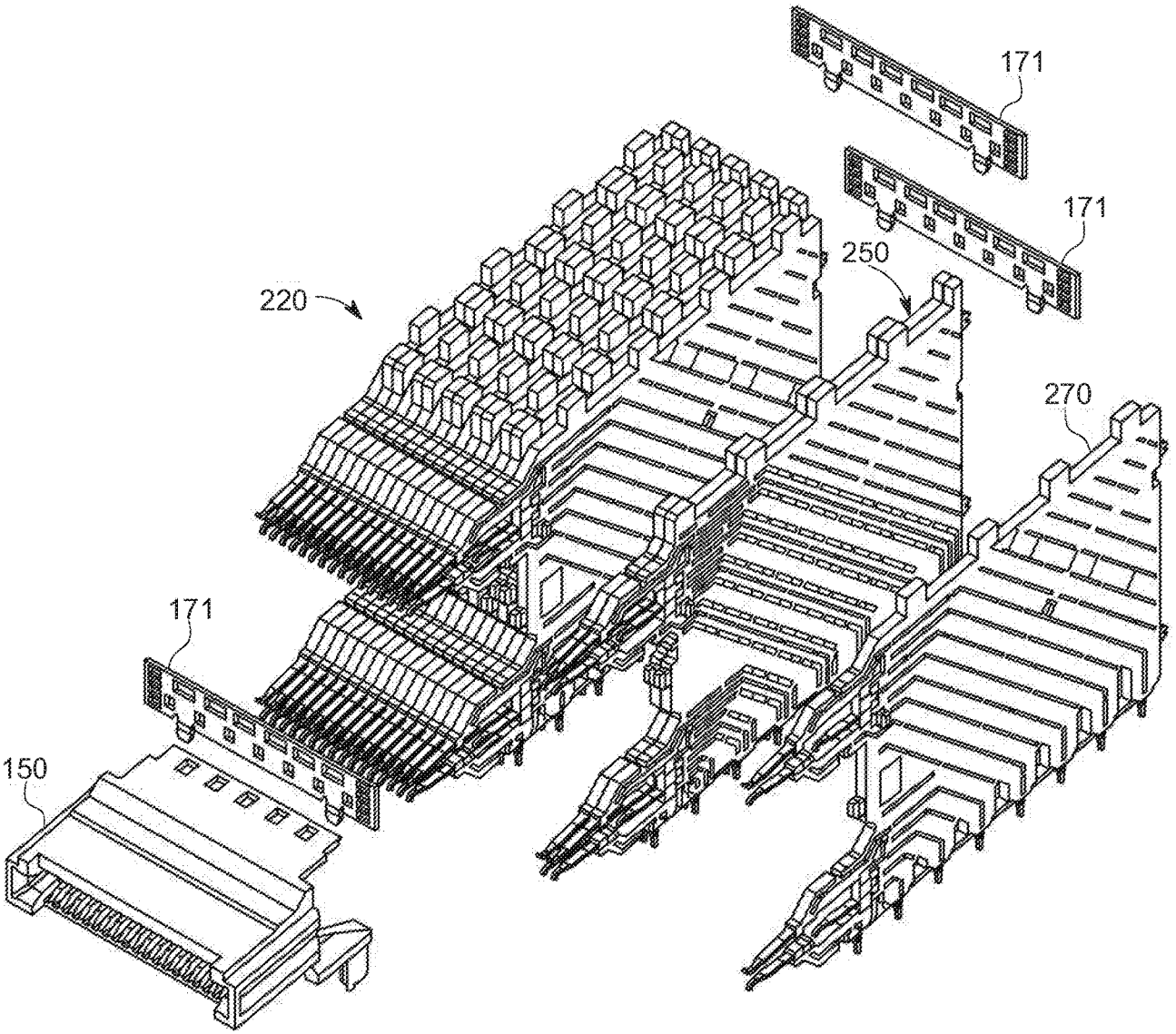
FIG. 17 illustrates an exploded partial perspective view of an embodiment of a connector.
Figure 18:
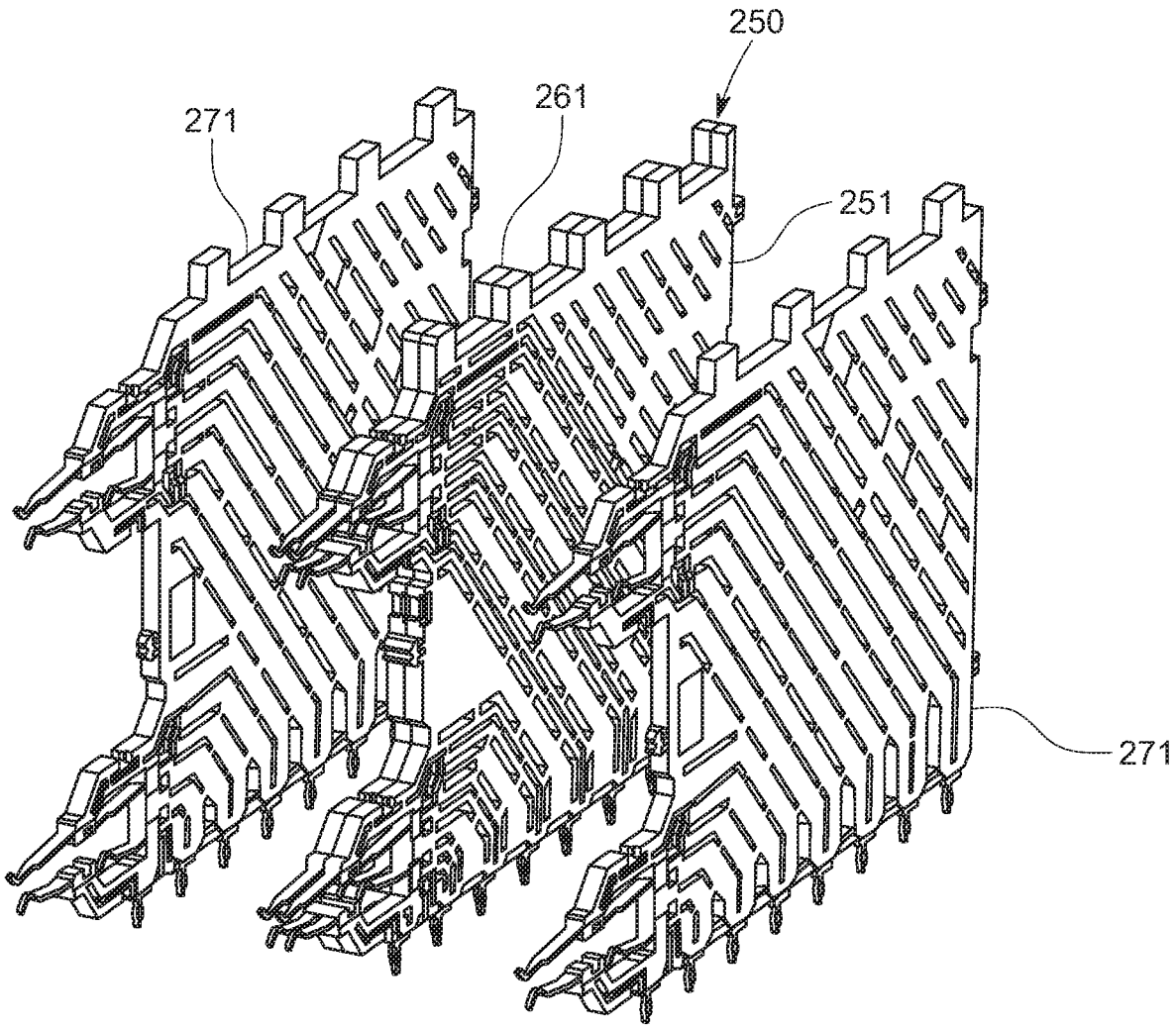
FIG. 18 illustrates a partially exploded perspective view of an embodiment of a signal wafer pair surrounded by ground wafers.
Figure 19:
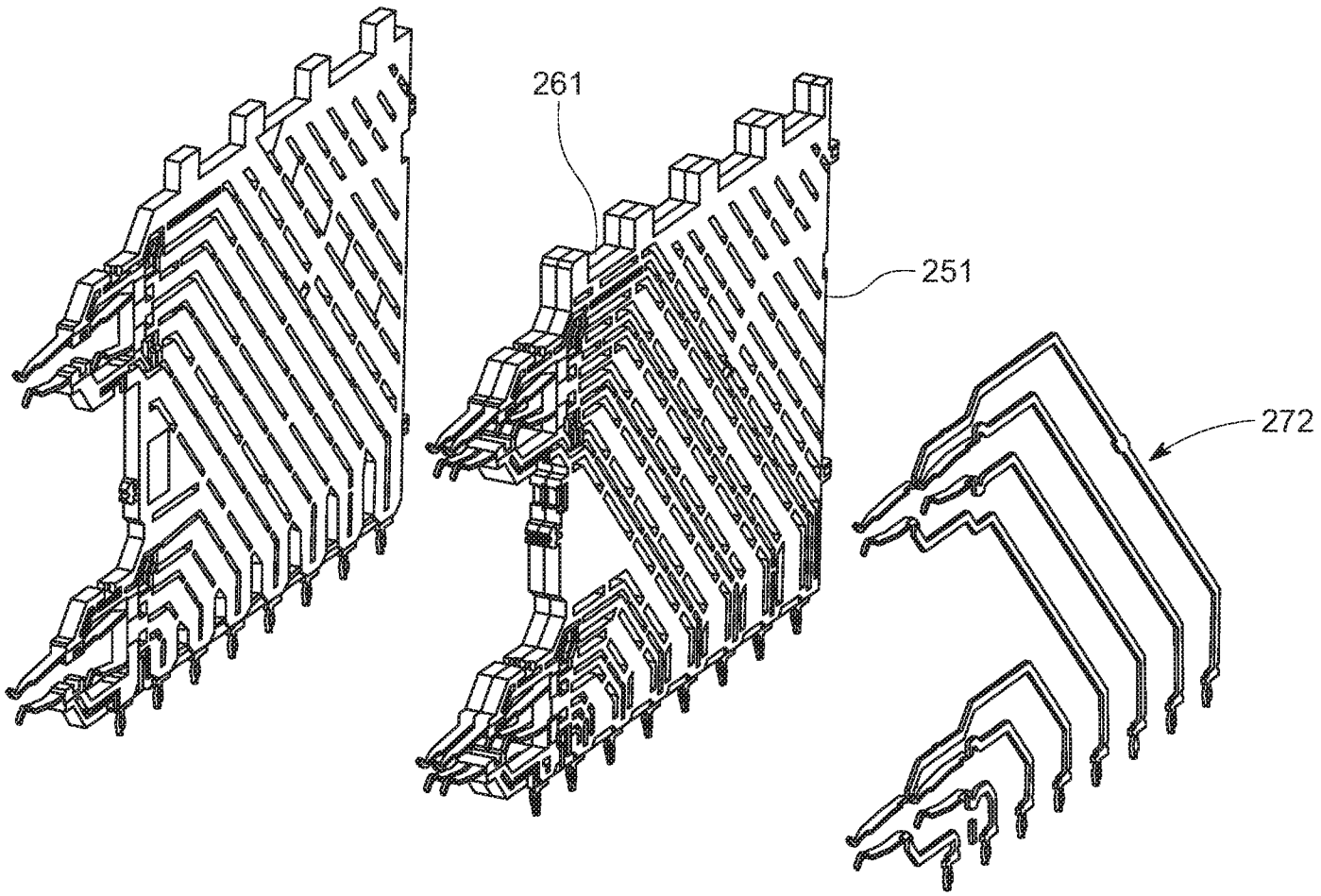
FIG. 19 illustrates a simplified perspective view of the embodiment depicted in FIG. 18 with an insulative frame removed for illustrative purposes.
Figure 20:
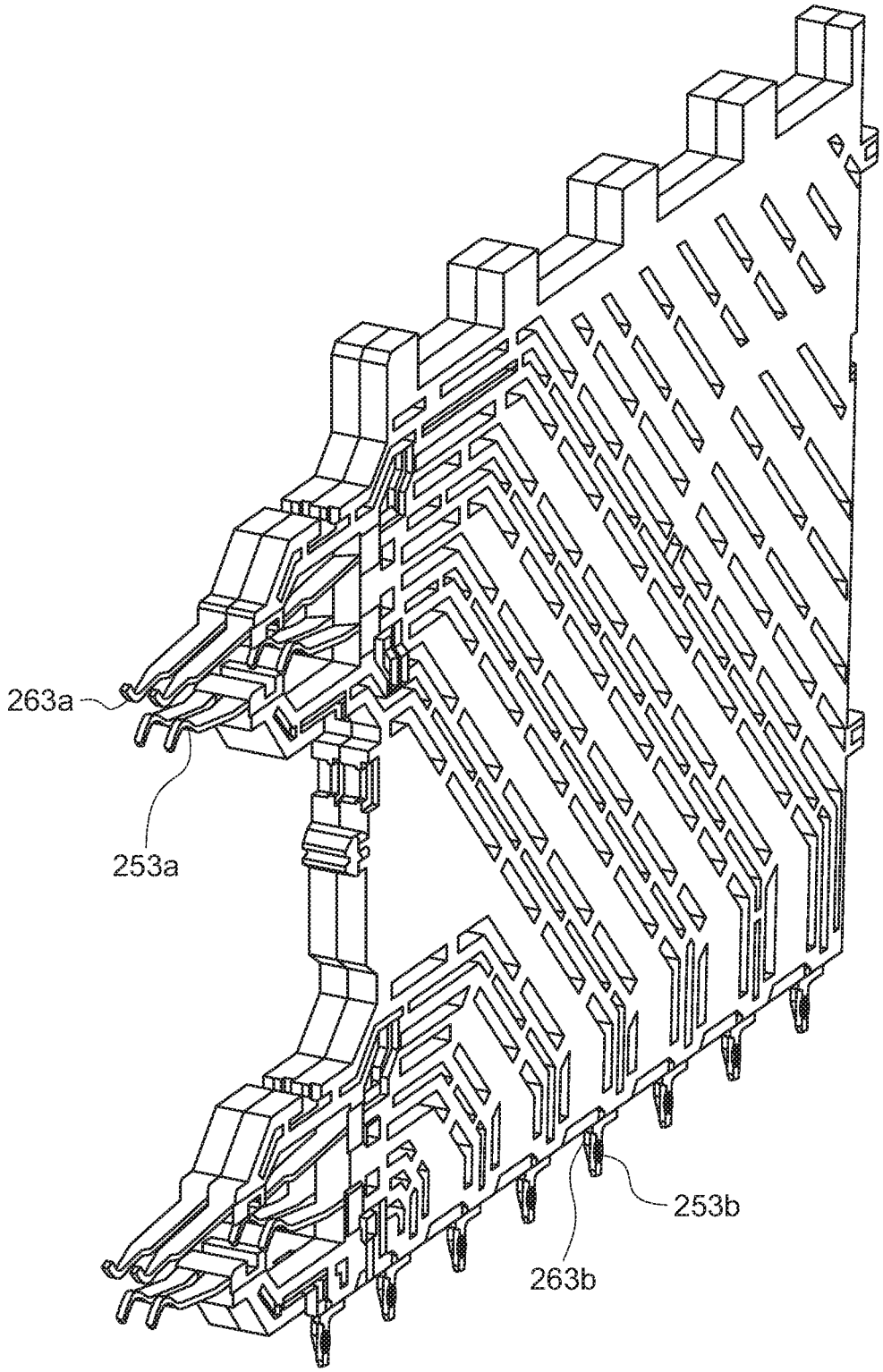
FIG. 20 illustrates a perspective view of an embodiment of a signal wafer pair.
Figure 21:
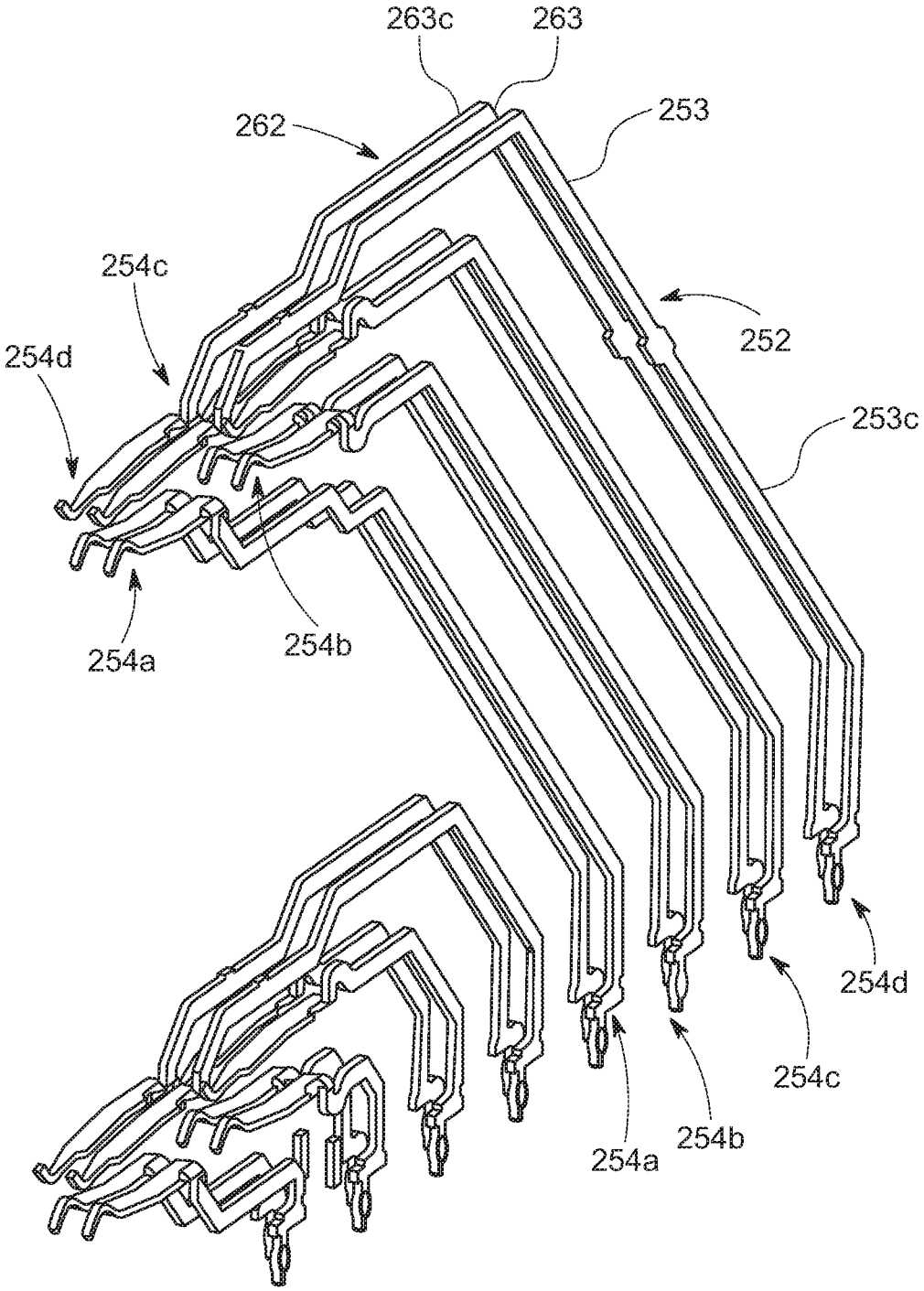
FIG. 21 illustrates a perspective view of the embodiment with the insulative frame removed.
Figure 22:
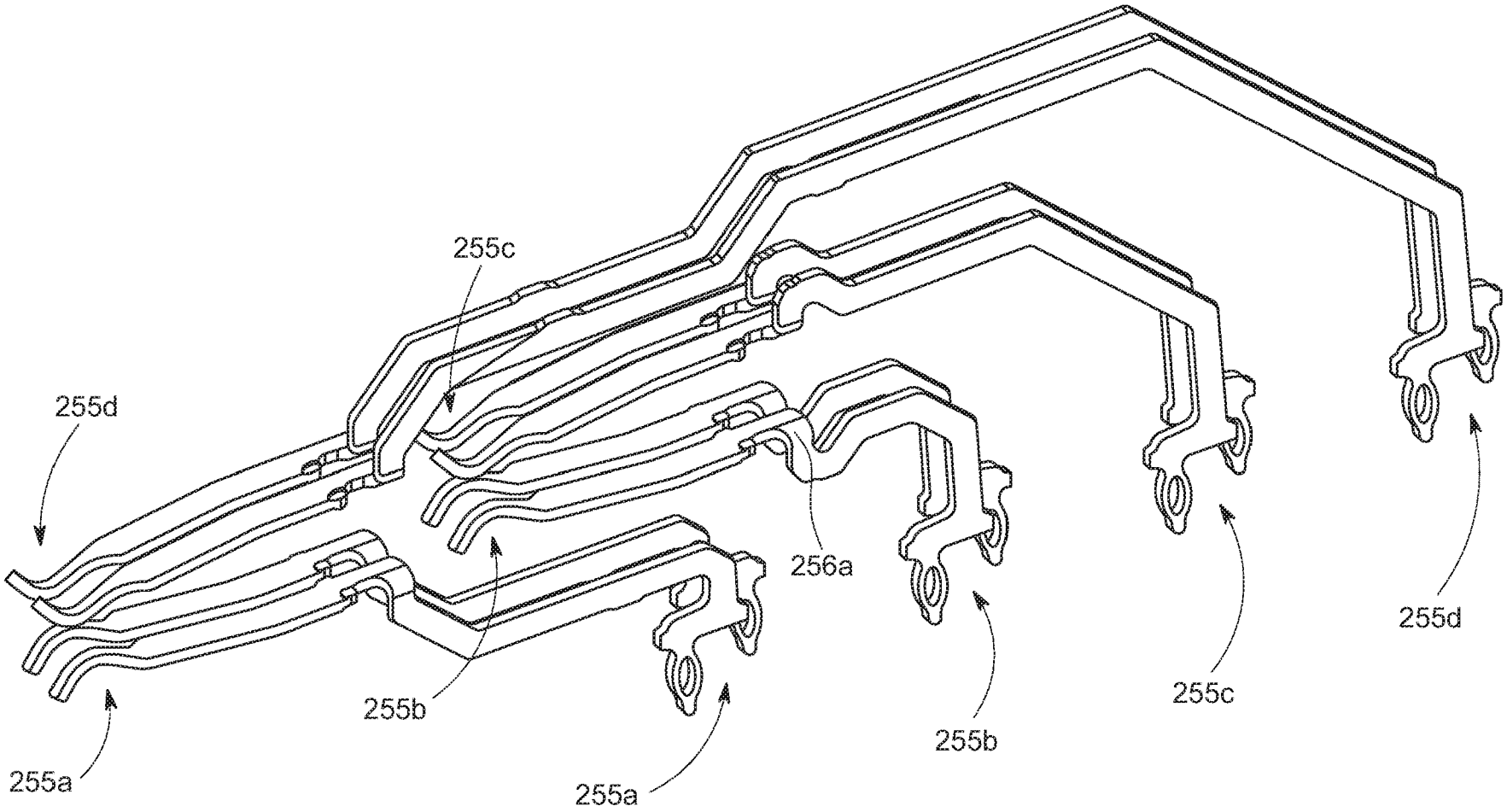
FIG. 22 illustrates a perspective view of an embodiment of terminals that provide the contact rows in the bottom port.
Figure 23:
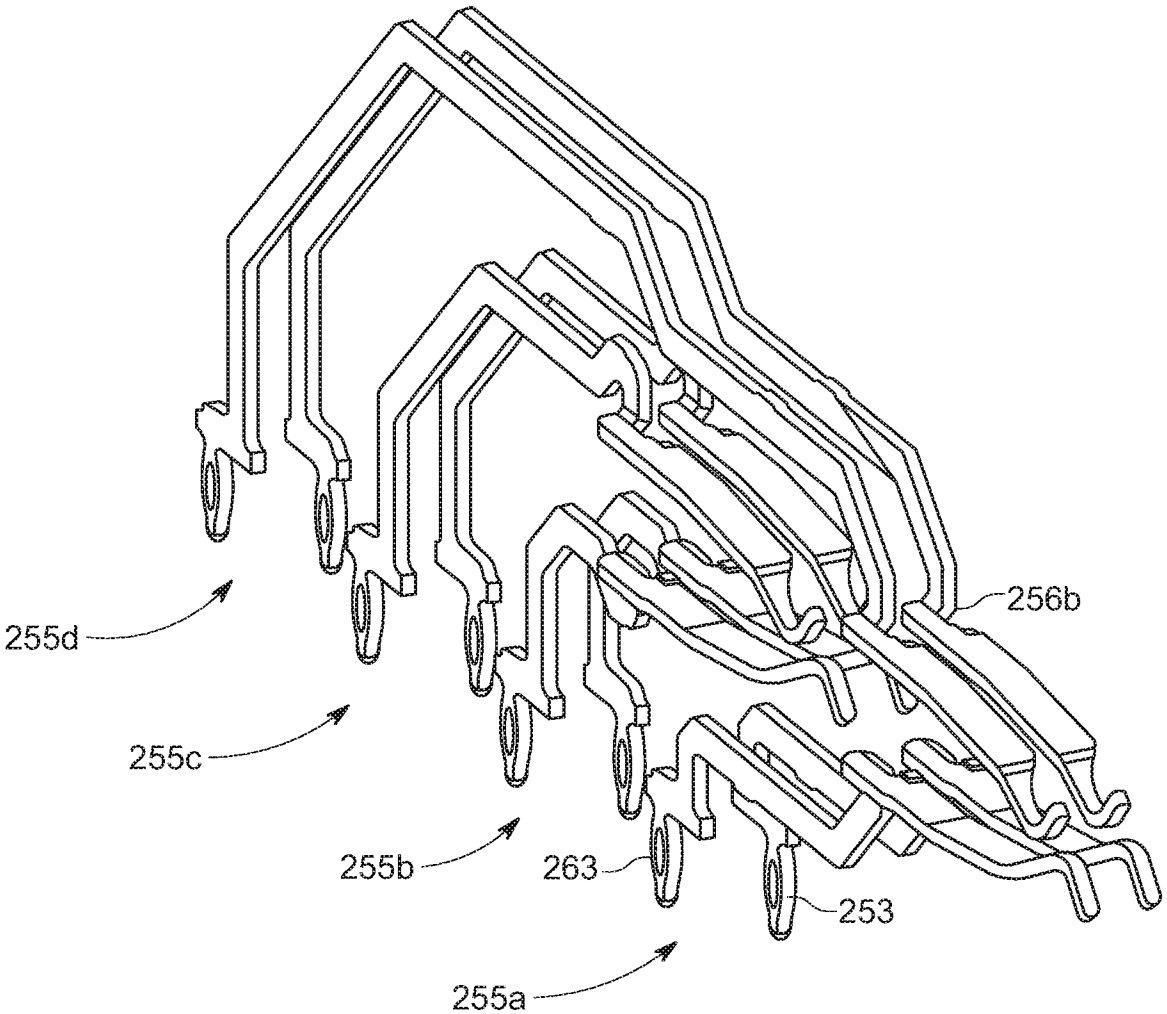
FIG. 23 illustrates another perspective view of the embodiment depicted in FIG. 22.
Figure 24:
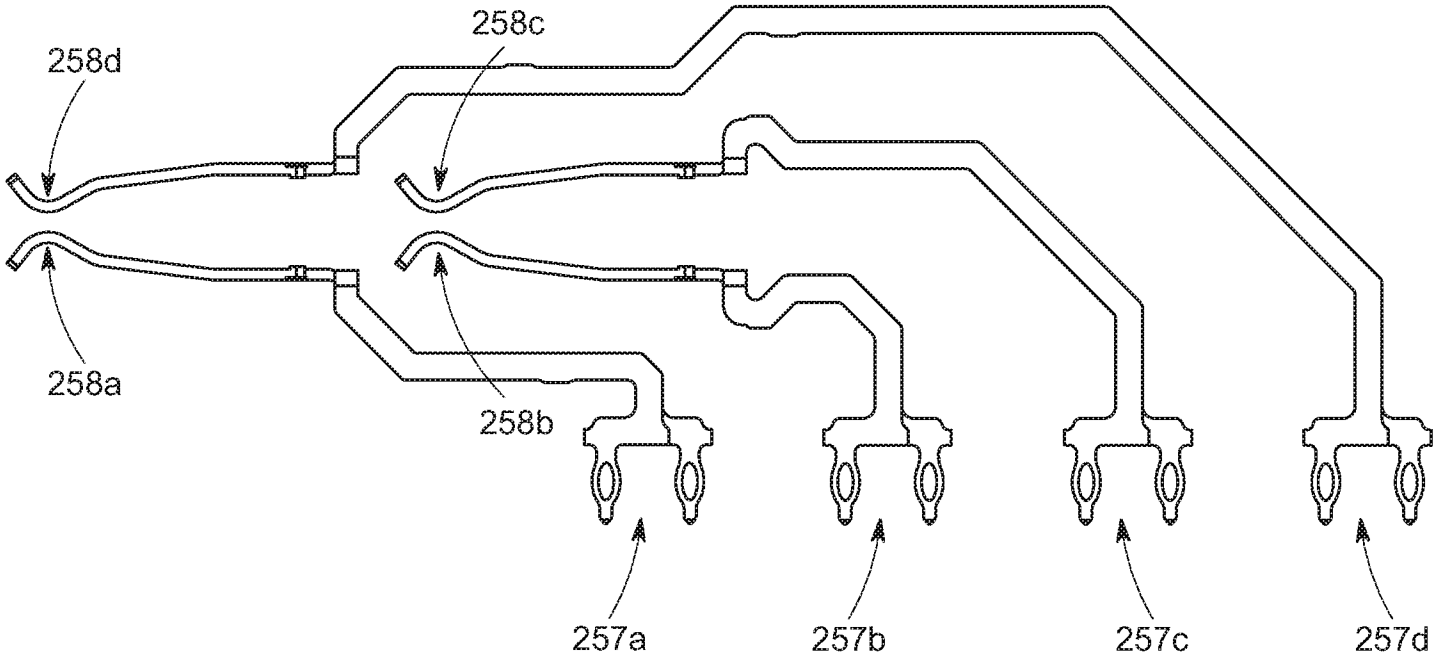
FIG. 24 illustrates an elevated side view of the embodiment depicted in FIG. 22.
Figure 25A:
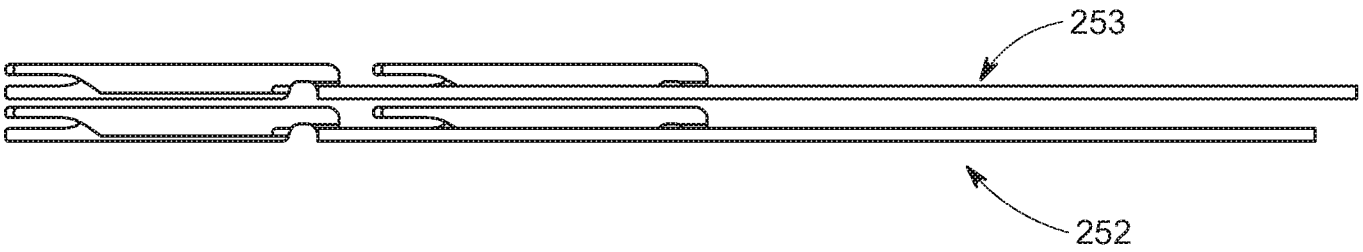
FIG. 25A illustrates a plan view of the embodiment depicted in FIG. 21.
Figure 25B:
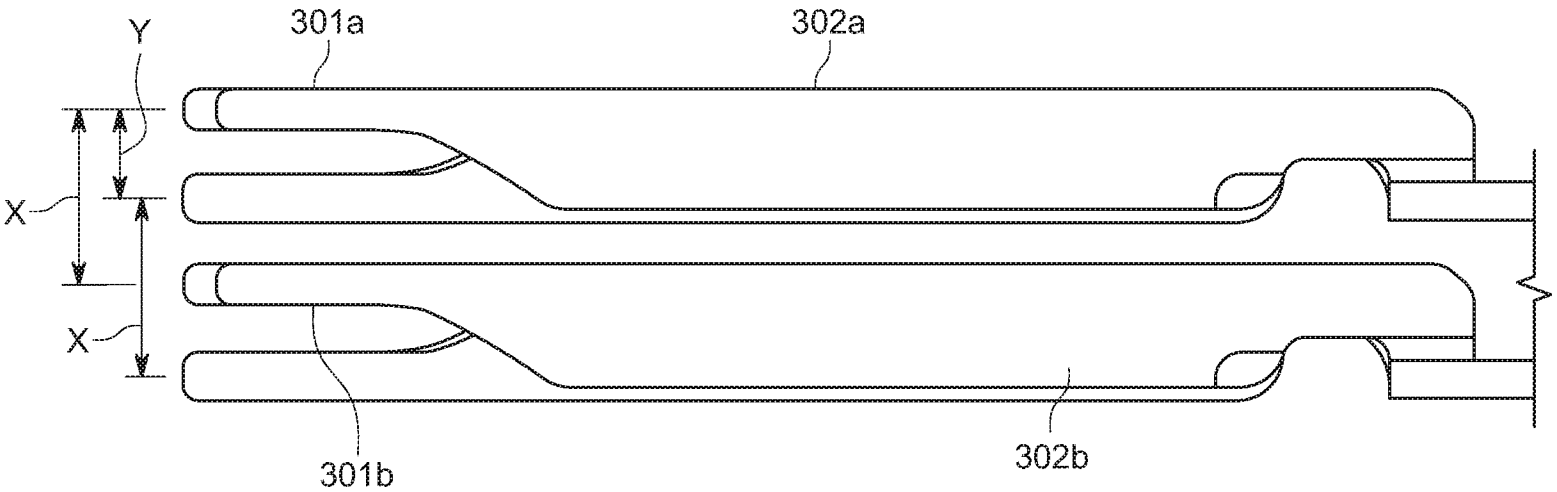
FIG. 25B illustrates an enlarged plan view of the embodiment depicted in FIG. 25A.

The receptacle 100 includes a cage 120 and can support light pipes 105 if desired. Referring to FIG. 6, the cage includes a top wall 122, a first side wall 123, a second side wall 124, a rear wall 125 and a front edge 126. The receptacle 100 defines a top port 121*a* and a bottom port 121*b*. The first and second side walls 123, 124 can include vent apertures 135.

As can be appreciated, the depicted designs are intended to facilitate cooling of an inserted plug module 20. Thus, the design has been tailored to improve air flow in a number of ways that will be discussed herein. In certain embodiments the receptacle 100 can include an internal riding heat sink 134 that is in communication with a front grill 130 and a rear aperture set 132. The top wall 122 can include a cooling aperture 122*a* and an external riding heat sink 133 can be positioned therein. Riding heat sinks are typically designed so that they extend into the port and engage an inserted plug module, helping to provide a conductive path to direct heat away from the plug module. It should be noted that in certain circumstances it may not be desirable to have the additional cooling (for example, in applications where there is no intention to use active modules) and in such situations many of the optional thermal features can be omitted. Thus, the depicted internal riding heat sink and the various venting features can be omitted if not desired. (To be clear, the use of the technologies described herein are contemplated within both active and passive modules.)

One common design of existing receptacles is the use of a housing positioned inside of a cage, the housing helping to define a connector. The cage helps support the mating plug module, can help support the connector and can also provide EMI protection. The connector positioned in the cage supports terminals that include tails and contacts that allow the mating plug module to be electrically connected to a circuit board (or to cables if a Bipass design is desired). The receptacle, which is typically press-fit onto a circuit board to ease assembly, thus must have the terminals of the connector aligned with terminals on the cage. As can be appreciated, the cage can be formed of metal and is expected to have a fairly repeatable arrangement of tails that have the desired dimensional control with respect to each other. The tails of the connector can also be carefully manufactured so that they are aligned with each other. It is somewhat more difficult, however, to align the tails of the connector with the tails of the cage as there are multiple points of dimensional stack-up. This dimensional issue is made more difficult by the fact that in a typical press fit design the housing supports wafers that support the terminals. Thus, the terminals are dimensional controlled with respect to each other within a wafer but have dimensional stack-up with respect to both the housing and other wafers while the housing has dimensional stack-up with the cage. Prior designs attempted to have a datum that acts as a stop to carefully control insertion of the housing into the cage to control the tolerances between the datum point and the tails of both the cage and the connector.

While such control is possible, it turns out to be more challenging and difficult, particularly as the tails are reduced in size. Applicants have determined that instead of having a stop that limits and controls the position of the housing with respect to the cage, it is more desirable to have a system where the cage 120 and connector 129 are mated together in a manner that allows for infinite adjustment over a small range so that mating of the cage 120 and the connector 129 can be done in a controlled manner and dimensional control can be assured. As depicted, the cage 120 includes bottom walls 140, 141 that each have a tongue 142 that is inserted into the respective card slot plug 150, 160. More specifically, the tongues 142 from the cage 120 are inserted into tongue slots 153, 163 in mating portions 152, 162, respectively, of card slot plugs 150, 160. As can be appreciated, the card slot plugs 150, 160 engage a wafer set 220 and would provide some additional dimensional stack up therebetween. In an embodiment, the insertion can be done based on alignment between the wafer set 220 and the cage 120, thus eliminating some of the dimensional stack up that would otherwise exist. In an embodiment the tongues 142 have an interference fit with the tongue slots 153, 163 so that the cage and connector 129 are appropriately joined and stay at the appropriate location relative to each other. Such a manufacturing process allows a position of the cage 120 and the wafer set 220 to be better controlled with respect to each other and improves the yield of receptacles 100 while ensuring the receptacle 100 can properly be mounted on a circuit board.

As can be appreciated from the Figures, the depicted connector 129 omits a housing. Applicants have surprisingly discovered that the use of a housing is unnecessary to support a wafer set 220 so long as the wafers are securely fastened together, preferably on at least two sides. In a depicted embodiment, retaining bars 171 are positioned on opposing sides and one of the sides has two retaining bars 171. The retaining bars 171 are connected to wafers 221 via wafer nubs 229 that can be heat staked onto the retaining bars 171. The depicted connector 129 illustrates an embodiment where a triangular arrangement is provided with two retaining bars 171 positioned on one side and one retaining bar 171 positioned on a second side of the wafer set. While it is desirable to have at least two retaining bars 171 (each positioned on a different side of the connector) a triangular arrangement of retaining bars 171 has been determined to be beneficial as it provides improved control and support for wafers 221 that make up the wafer set 220. It has been determined that removing the housing provides certain unexpected benefits. One issue is that no housing is perfectly square and straight, thus the tolerance in the housing adds to the tolerance in the wafers and thus increases the tolerance of the location of the tails. By removing the housing Applicants can better control the position of the tails of the wafer set with respect to the cage. The removal of the housing also allows for the size of the receptacle to be decreased, thus allowing for increased density.

Each wafer 221 includes an insulative frame 221*a*. The depicted insulative frames 221*a* includes top projections 224 and supports terminal sets 252, 262, 272 (as is expected in embodiments where there is a three wafer system that includes a ground wafer and two signal wafers). It should be noted that the configuration of the depicted terminals, while beneficial for the depicted receptacle, is not intended to be limiting as the features of providing a connector without a housing has broad applicability. Thus the design elements that provide for the removal of the housing could be used with a wide range of wafer configurations.

The terminal set 252 includes terminals 253 that each include a contact 253*a*, a tail 253*b* and a body 253*c* that extends therebetween. Similarly, the terminal set 262 includes terminals 263 that include a contact 263*a*, a tail 263*b* and a body 263*c* that extends therebetween. As the depicted tails 253*b*, 263*b* are intended to press-fit into a circuit board, it is helpful to provide a receptacle where force can be readily applied to the tails to press them into vias on a circuit board. As depicted, the insulative frame 121*a* includes top projections that extend to a top wall 122 of the cage 120. As a result of the depicted design, a force exerted on the cage 120 is transferred through the insulative frame 121*a* to the tails 253*b*, 263*b* and thus a reliable press-fit operation is possible.

The depicted top projections 124 have a number of cutouts 124*a* so that the wafer engages the top wall in several places but also leaves gaps. The cutouts 124*a* can be arranged in a pattern that allows air to flow along the top wall 122 of the cage in a desirable manner As can be appreciated, the number and size of the cutouts 124*a*, as well as the location, can vary as appropriate to provide the desired air flow.

Figure 26:
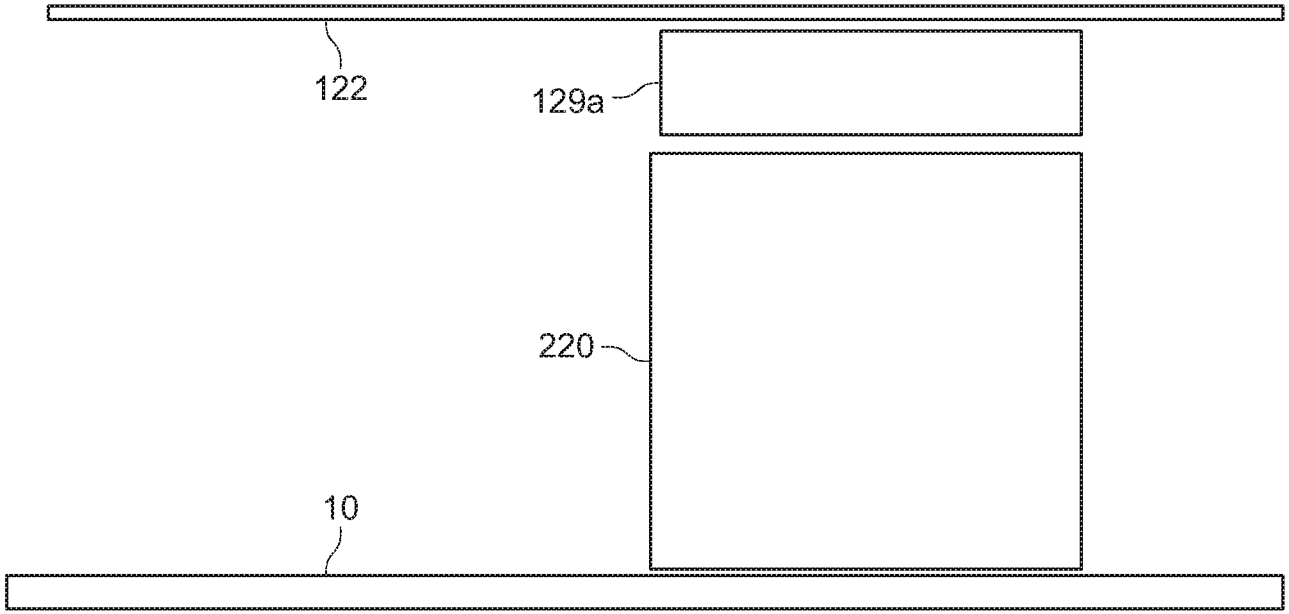
FIG. 26 illustrates a schematic depiction of an embodiment of a connector with an insert.
Figure 32:
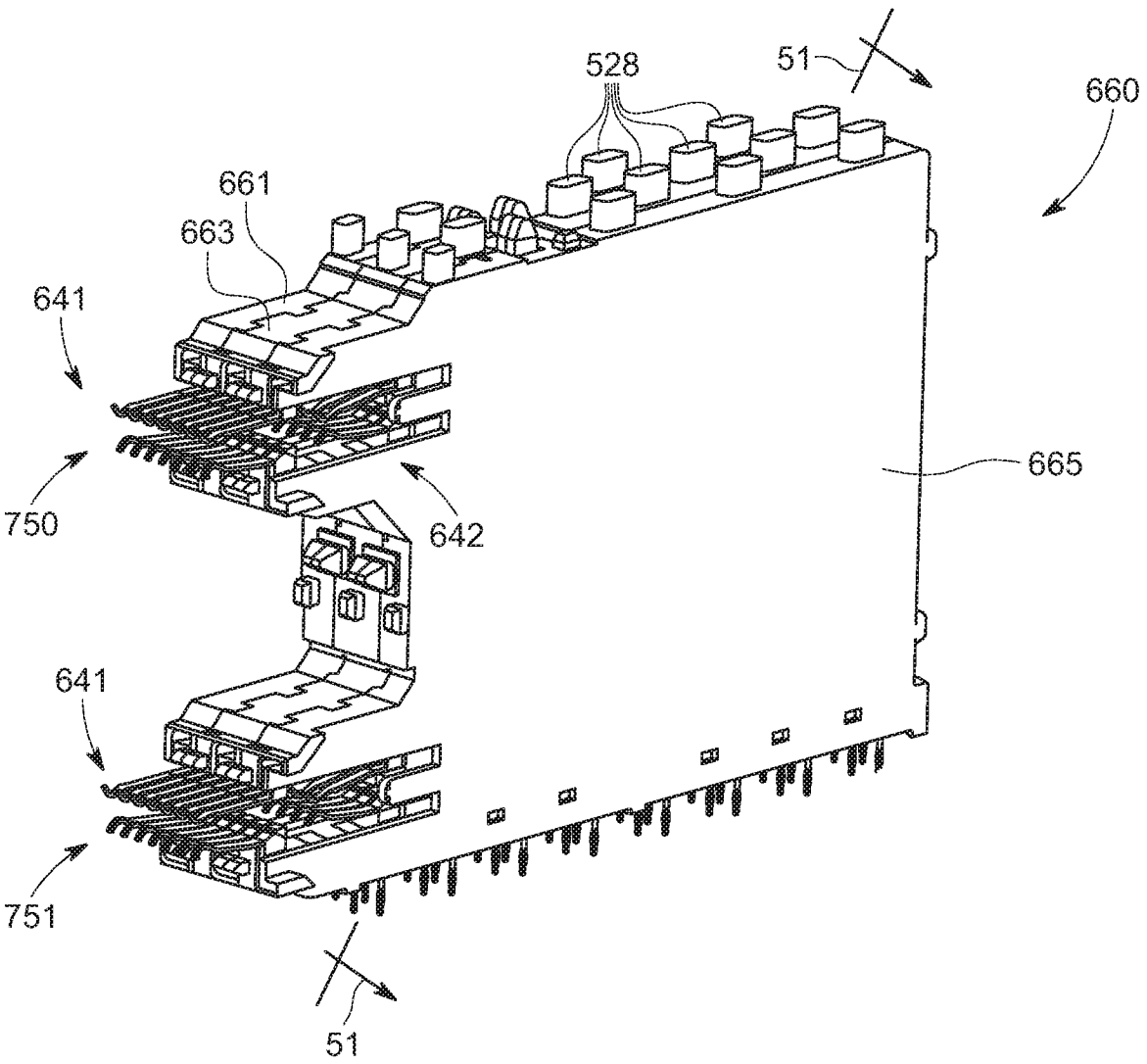
FIG. 32 illustrates a perspective view of a high-speed wafer block of the embodiment depicted in FIG. 28.
Figure 33:
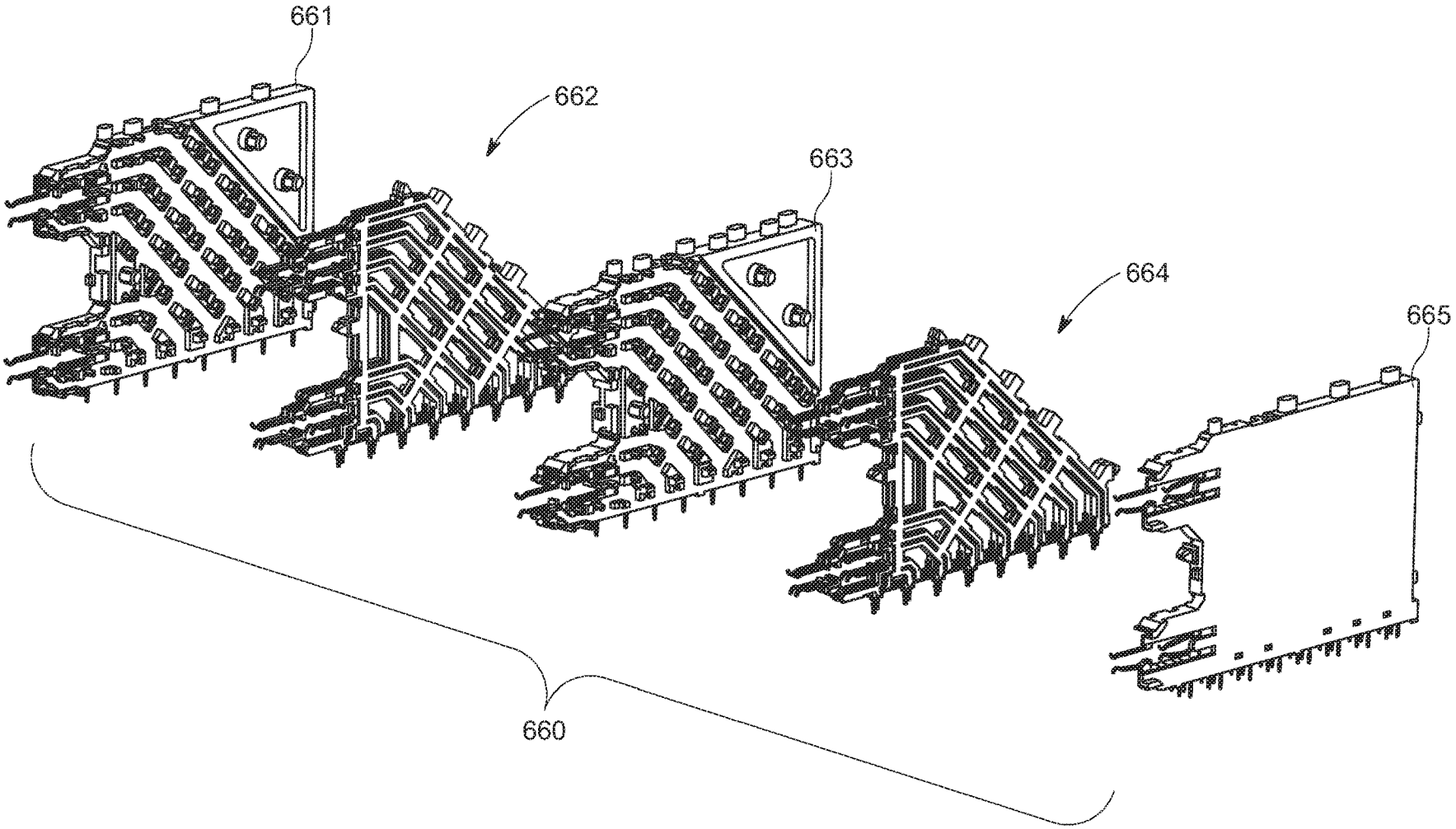
FIG. 33 illustrates a partially exploded perspective view of the high-speed wafer block depicted in FIG. 32.

It should be noted that the cutouts 124*a*, while providing a tortuous path for air to flow through, do not provide a straight path for the air to flow between the wafers and the top wall and thus may increase the pressure drop of air flow through the receptacle. While the depicted path could be considered a zig-zag or undulating path, other paths could also be provided, depending on the configuration of the top wall. Chamfers may be used on some or all of the top projections (see e.g., top projections 528 in FIG. 32) in order to promote more laminar (less turbulent or torturous) airflow. In an alternative embodiment the projection 124 can be shortened and an insert 129*a* (shown in schematic representation in FIG. 26) can be positioned between the wafer set 220 and the top wall 122. The insert 129*a* can transfer force from the top wall 122 to the wafers 221 while providing a more optimized air flow path between the top wall 122 and the wafer set 220 (thus reducing air resistance). In another alternative embodiment the insert 129*a* can be removeable and just used to mount the connector on the circuit board 10 before being removed. In such a design the back wall 125 of the cage 120 can be attached after the cage 120 (or at least most of it) and connector 129 are both pressed into the circuit board and the opening can provide reduced air resistance. Thus, a number of variations are possible, depending on the need for air flow and the desire to manage costs.

The depicted design provides wafers 221 that have a front contact row 245 and a rear contact row 246 that are spaced apart in a plug module insertion direction and the contact rows are configured to engage two rows of pads on a mating connector. While not required, the benefit of such a design is a substantial increase in density. If such density is not desired then the wafers can be made to support a lesser number of terminals. It should be noted that depicted wafers are arranged in a pattern that provides a ground, signal, signal pattern that can be repeated. Other patterns are also possible if desired. If desired, the ground wafers could include terminals that are commoned together, and in an embodiment, the ground wafers could have contacts that engage the top wall to provide electrical grounding to the cage.

Because the connector 129 does not need a housing (although it is possible to use a housing if desired in certain embodiments), the depicted connector 129 supports card slots plugs with the wafer set 220. As depicted, the card slots plugs 150, 160 each have shoulders that are similar to the shoulders 156*a*, 156*b* that latch onto retaining features on at least some of the wafers in the wafer set 220 to provide desirable location and stability control. In an embodiment, just the ground wafers can include retention features. As depicted, the shoulders 156*a*, 156*b* can have grooves 154 that engage projections 226 but other retention configurations would also be suitable. The card slot plugs 150, 160 are positioned in ports 121*a*, 121*b* defined by the cage 120 and provide card slots 151 that have contacts positioned on both sides of the card slots 151. The card slots 151 preferably include terminal grooves 155 for the front contact row 245 so that the most vulnerable contacts are protected during the initial mating with a mating plug connector. As the front portion of the card slot plugs 150, 160 helps align and control the mating paddle card, the rear contact row 246 can beneficially omit the terminal slots. If desired, a card slot plug 160 can include a peg 166 that is intended to be inserted into a circuit board but such a feature is optional and is not expected to be as helpful for a design that includes two vertically arranged ports in a 2XN configuration.

In an embodiment, the retaining bar 171 can be configured to engage the cage 120. The retaining bar 171 can be made wider than the wafer set 220 so that the retaining bar 171 slides along the side walls of the cage 220. If such a construction (which helps ensure proper alignment of the cage 120 to the wafer set 220) is desired, then the retaining bar 171 can include vent apertures 172 to allow air to flow more readily through the receptacle.

It has been determined that, for a full double row design, it is desirable for the contacts all to be blanked and formed (it has been determined that this provides mechanical and signal integrity benefits). Thus the depicted embodiment features two rows of stamped and formed contacts on both sides 151*a*, 151*b* of the card slot 151.

To support the front contact row 245, the wafers 221 include an arm 228 that extends past the rear contact row 246. The arm 228 helps ensure the impedance is more consistently managed through the body of the wafer. To provide for suitable flexibility the arm 228 can include a notch 228*a* that allows that arm 228 to flex slightly.

As noted above, each of the terminals includes the contact, tail and body extending therebetween. The depicted configuration includes a ground wafer 271 and a signal wafer set 250 that includes a first signal wafer 251 and a second signal wafer 261. One signal wafer can be said to support a number of minus (−v) signals and the other signal wafer correspondingly can be said to support a number of plus (+v) signals; together, these signals form a set of differential pair signals (−v/+v). The signal wafer set 250 thus provides for the top port, a first different pair 254*a*, a second differential pair 254*b*, a third differential pair 254*c* and a fourth differential pair 254*d*. The signal wafer set 250 also provides for the bottom port, a fifth differential pair 255*a*, a sixth differential pair 255*b*, a seventh differential pair 255*c* and an eighth differential pair 255*d*. From the depicted terminal configuration it can be appreciated that for both the top and bottom ports the terminals that form the two back differential pairs have tails that are positioned between tails of the two differential pairs that form the front contacts. For example, differential tail sets 257*b* and 257*c* are associated with contact pairs 258*b* and 258*c*, respectively, and the contact pairs 258*b*, 258*c* are in the rear contact row. Differential tail sets 257*a* and 257*d* are on both sides of the differential tail sets 257*b*, 257*c* and are associated with contact pairs 258*a*, 258*d* that are in the front contact row. It has been determined that this configuration is beneficial as it allows for the three rows of terminals to have similar lengths while having one significantly longer terminal. Thus the depicted embodiment helps provide more consistent terminal lengths.

As can be appreciated, a top row of contacts opposes a bottom row of contacts. In an embodiment the contacts of the terminals that form that the top row of contact can have a form 256*b* that is folded in a first direction and the terminals that form the bottom row of contacts can have a form 256*a* that is also folded in the first direction. For example, when looking straight at the contacts in a plug module insertion direction all the sets of contacts can have forms that are folded to one side (e.g., they can all be folded to the left or to the right). While such a construction is beneficial, it turns out that for certain applications it is desirable to have the top row of contacts offset from the bottom row of contacts. To provide this functionality, the contact can taper down from a beam portion 302*a*, 302*b* to a pad touching portion 301*a*, 301*b*, where the pad touching portion 301*a*, 301*b* is less than half the width of the beam portion 302*a*, 302*b*. If desired, the pad touching portion of the top row can be on opposite sides of the beam portion as the pad touching portions on the bottom row so as to provide an offset alignment. If such an alignment is not needed then the contacts can be configured symmetrically or in some other desired configuration.

The pitch can vary depending on the intended interface. As depicted, the terminals are on a x pitch, which could be 0.8 mm and the top and bottom terminals can have a y offset, which can be 0.4 mm If the connector provides a double row of contacts on the top and bottom and the front contacts are intended to be compatible with existing designs, then it will be beneficial to have the pitch of the contacts match existing designs. If a clean sheet design is preferred then the pitch can be varied as desired, keeping in mind that signal integrity performance can be more challenging as the pitch decreases below 0.8 mm and that a pitch below 0.65 typically requires additional features such as biased paddle cards and/or contact interface (such as is used in the OCULINK connector).

FIGS. 27-51 depict alternative embodiments of certain aspects of the connector embodiments that were described with reference to FIGS. 1-26 above. The embodiments now described with respect to FIGS. 27-51 may be combined with certain connector embodiments already described, in whole or in part, depending on the particular aspect being implemented. Thus, some connector embodiment aspects may remain unchanged, some aspects replaced with structures now described, and some aspects modified to incorporate the structures now described.

Figure 27:
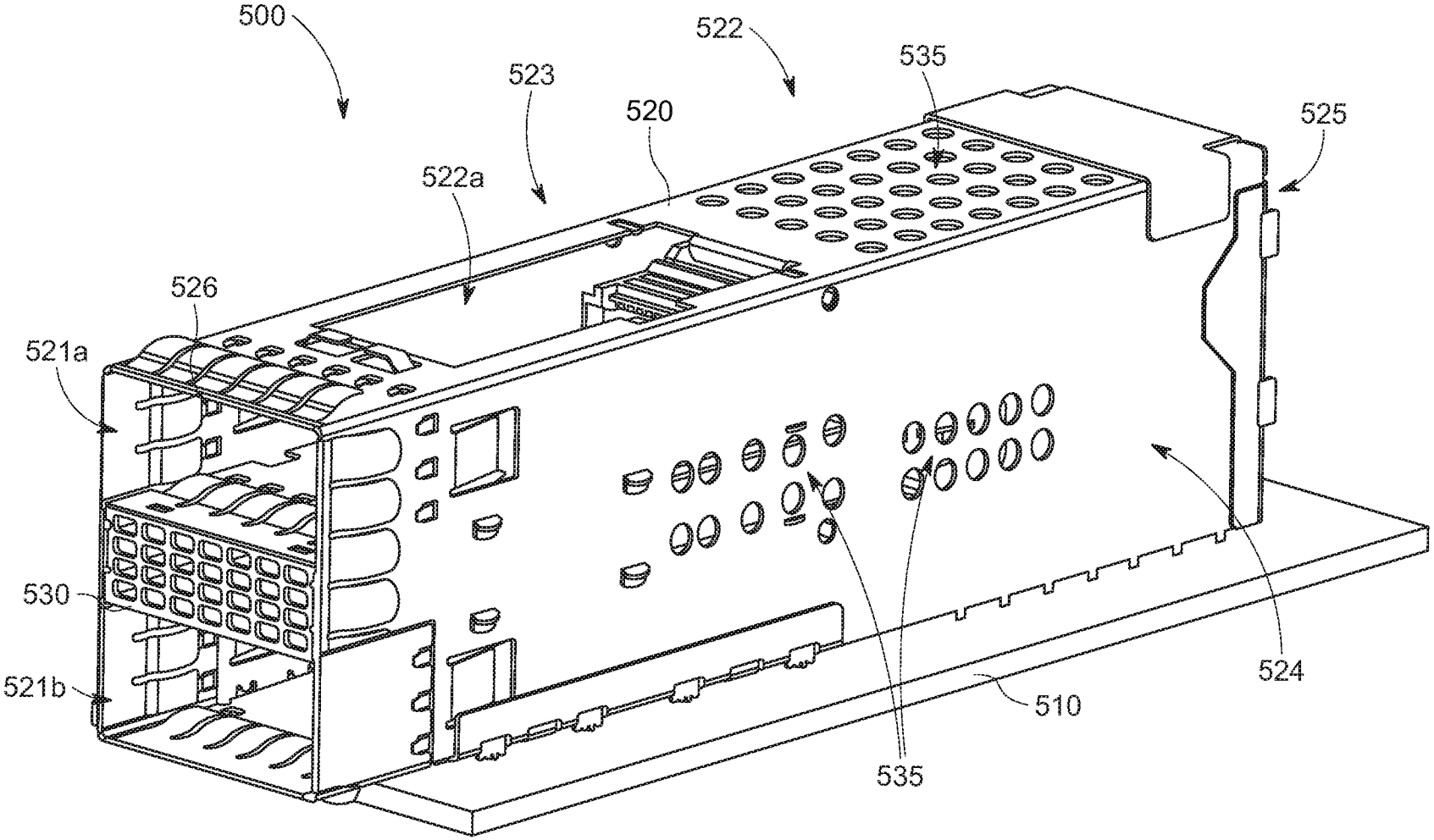
FIG. 27 illustrates a perspective view of an embodiment of a receptacle.
Figure 28:
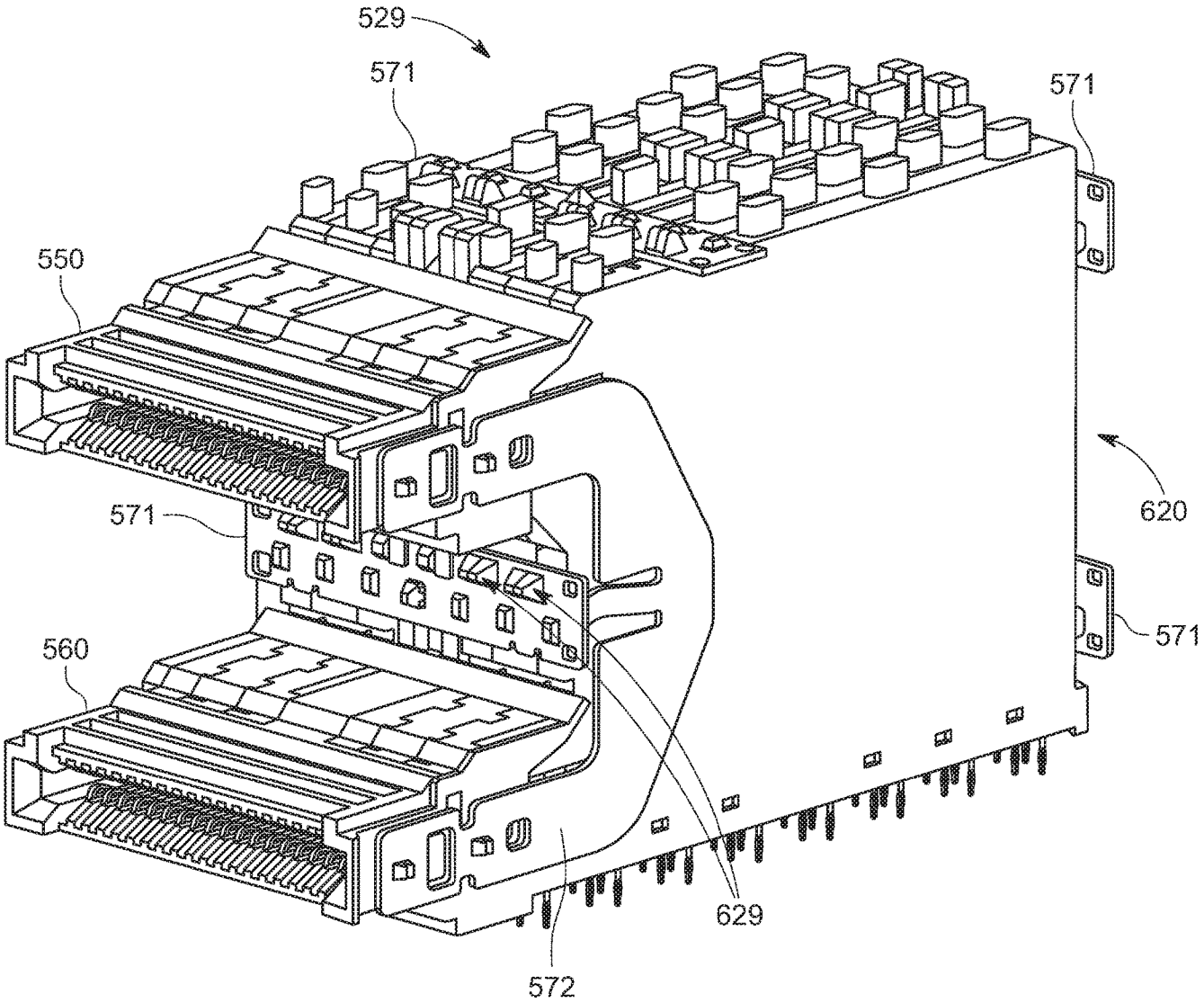
FIG. 28 illustrates a perspective view of an embodiment of a connector.
Figure 29:
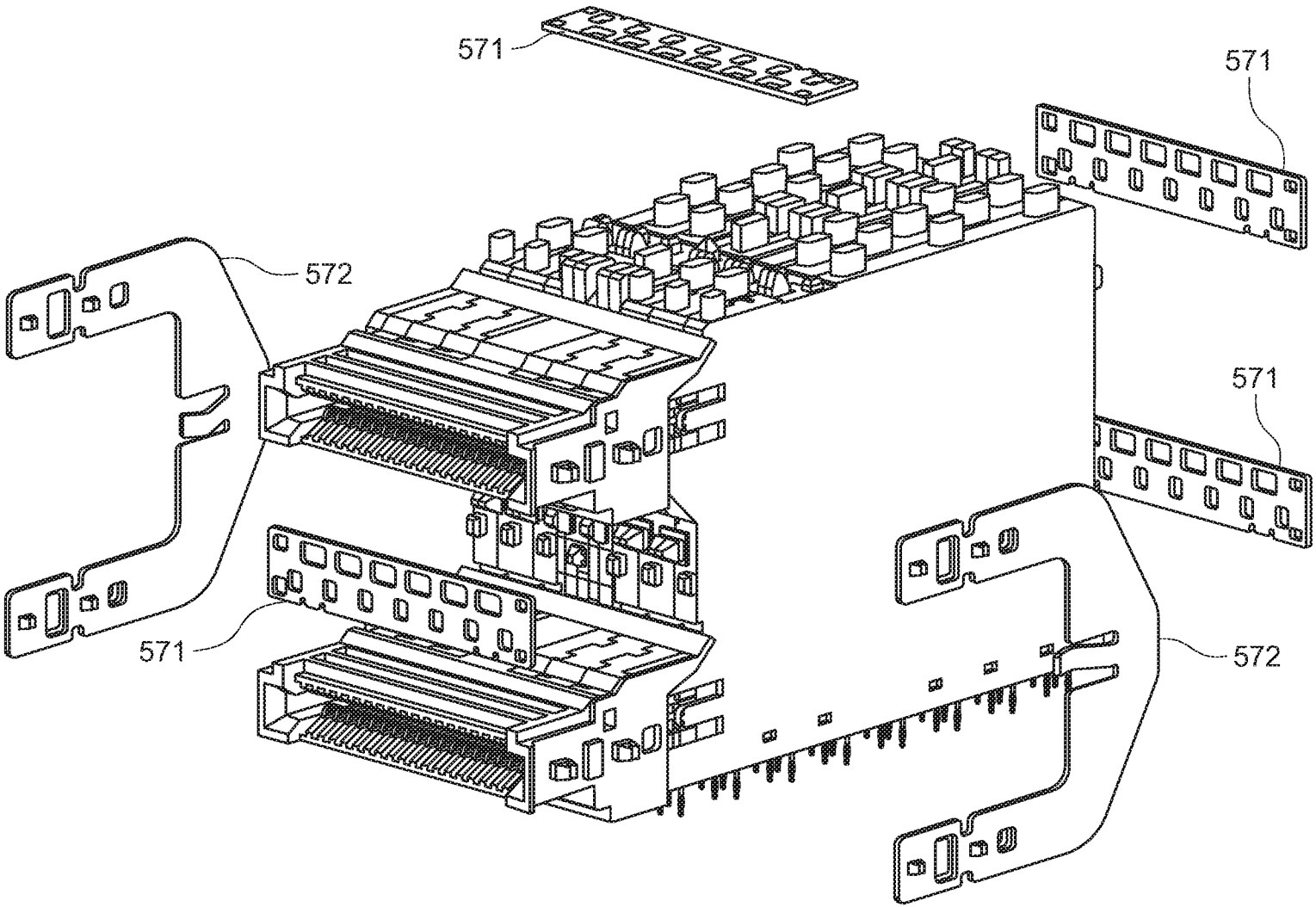
FIG. 29 illustrates a partially exploded perspective view of the embodiment depicted in FIG. 28.
Figure 30:
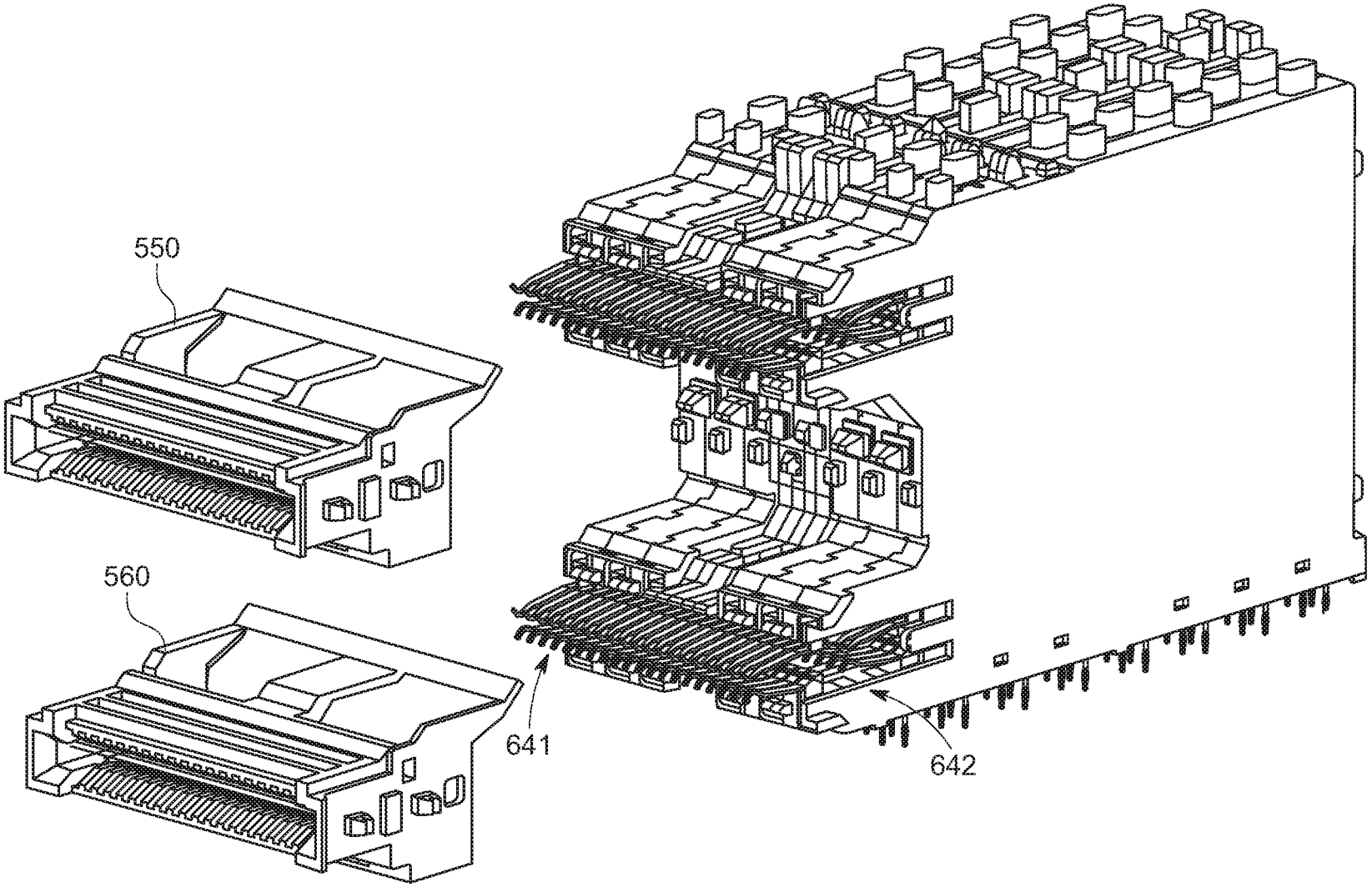
FIG. 30 illustrates a partially exploded perspective view of the embodiment depicted in FIG. 28 with some features removed.
Figure 31:
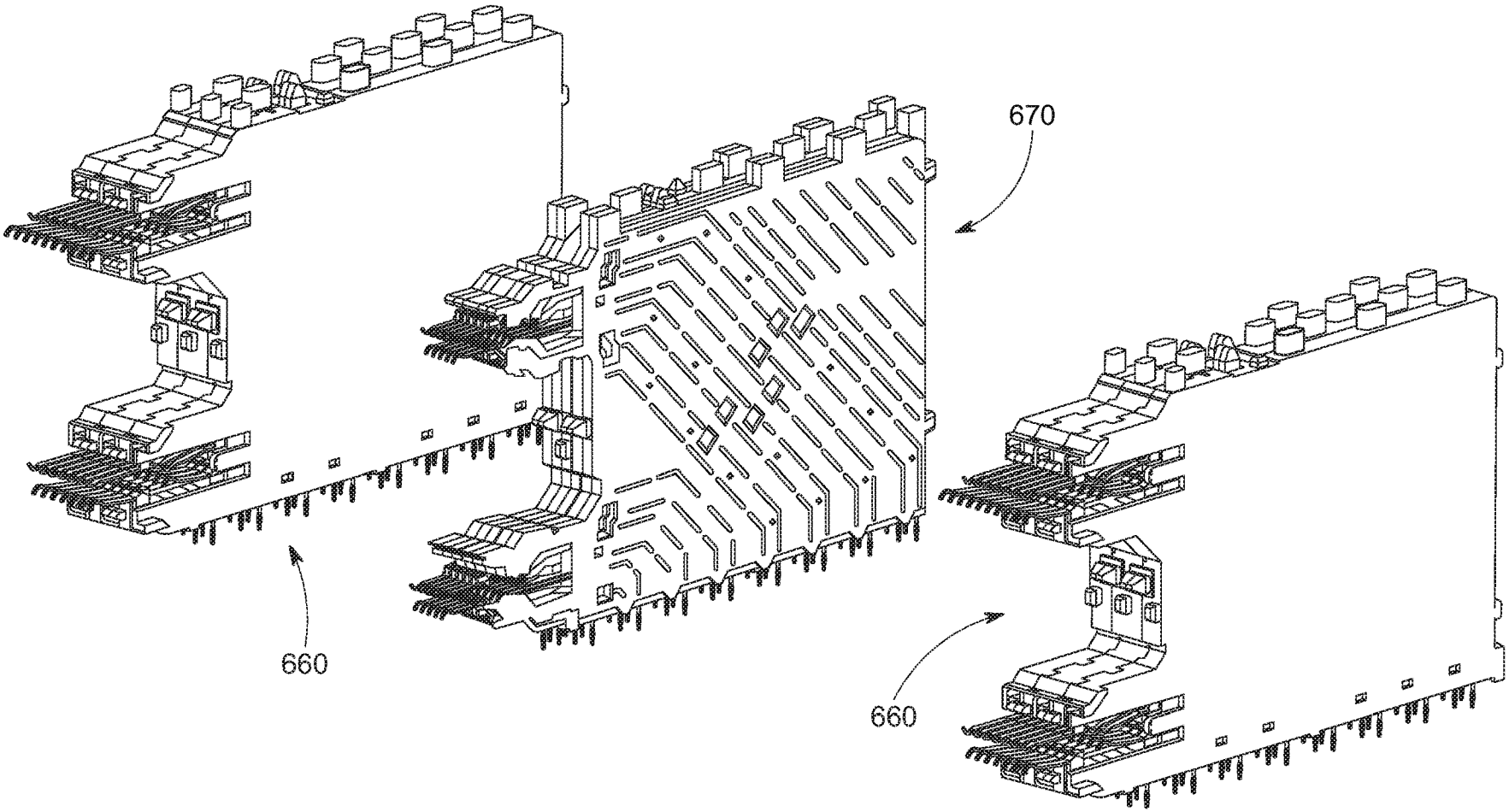
FIG. 31 illustrates a partially exploded perspective view of the wafer blocks of the embodiment depicted in FIG. 28.

As can be appreciated from FIG. 27, a receptacle 500 is mounted on a circuit board 510 and provides a right-angled construction that is configured to receive a plug module (not shown), see e.g., plug module 20. The depicted receptacle 500 design may be used with plug modules that include cooling slots (see e.g., cooling slots 115), although such cooling slots are not required on receptacle 500-compatible plug modules.

The receptacle 500 includes a cage 520 and can support light pipes if desired (see e.g., light pipes 105). The cage includes a top wall 522, a first side wall 523, a second side wall 524, a rear wall 525 and a front edge 526. The receptacle 500 defines a top port 521*a* and a bottom port 521*b*. The top and side walls may include vent apertures 535.

As can be appreciated, the depicted designs are intended to facilitate cooling of an inserted plug module. Thus, the design has been tailored to improve air flow in a number of ways that are discussed herein. In certain embodiments, the receptacle 500 can include an internal riding heat sink (see e.g., internal riding heat sink 134) that is in communication with a front grill 530 and a rear aperture set (see e.g., rear aperture set 132). The top wall 522 can include a cooling aperture 522*a* and an external riding heat sink can be positioned therein. Riding heat sinks are typically designed so that they extend into the port and engage an inserted plug module, helping to provide a conductive path to direct heat away from the plug module. It should be noted that in certain circumstances it may not be desirable to have the additional cooling (for example, in applications where there is no intention to use active modules) and in such situations many of the optional thermal features can be omitted. Thus, the depicted internal riding heat sink and the various venting features can be omitted if not desired.

One common design of existing receptacles is the use of a housing positioned inside of a cage, the housing helping to define a connector. The cage helps support the mating plug module and can help support the connector and can also provide EMI protection. The connector positioned in the cage supports terminals that include tails and contacts that allow the mating plug module to be electrically connected to a circuit board (or to cables if a Bipass design is desired). The receptacle, which is typically press-fit onto a circuit board to ease assembly, should have the terminals of the connector aligned with terminals on the cage. As can be appreciated, the cage can be formed of metal and is expected to have a fairly repeatable arrangement of tails that have the desired dimensional control with respect to each other. The tails of the connector can also be carefully manufactured so that they are aligned with each other. It is somewhat more difficult, however, to align the tails of the connector with the tails of the cage as there are multiple points of dimensional stack-up. This dimensional issue is made more difficult by the fact that in a typical press fit design the housing supports wafers that support the terminals. Thus, the terminals are dimensionally controlled with respect to each other within a wafer but have dimensional stack-up with respect to both the housing and other wafers while the housing has dimensional stack-up with the cage. Prior designs attempted to have a datum that acts as a stop to carefully control insertion of the housing into the cage to control the tolerances between the datum point and the tails of both the cage and the connector.

While such control is possible, it turns out to be more challenging and difficult, particularly as the tails are reduced in size. Applicants have determined that instead of having a stop that limits and controls the position of the housing with respect to the cage it is more desirable to have a system where the cage 520 and connector 529 are mated together in a manner that allows for infinite adjustment over a small range so that mating of the cage 520 and the connector 529 can be done in a manner that provides sufficient dimensional control. As depicted with respect to a previously described embodiment (in FIG. 7B, for example, see bottom walls 140 and 141, tongues 142, tongue slots 153 and 163), the cage 520 includes bottom walls that each have a tongue that is inserted into the respective card slot plug 550, 560. More specifically, the tongues from the cage 520 are inserted into the tongue slots in the mating portions, respectively, of card slot plug 550, 560. As can be appreciated, the card slot plugs 550, 560 engage a wafer set 620 and would provide some additional dimensional stack up therebetween. In some embodiments, the insertion can be done based on alignment between the wafer set 620 and the cage 520, thus eliminating some of the dimensional stack up that would otherwise exist. In some embodiments, the tongues have an interference fit with the tongue slots so that the cage and connector 529 are appropriately joined and stay at the appropriate location relative to each other. Such a manufacturing process allows a position of the cage 520 and the wafer set 620 to be better controlled with respect to each other and improves the yield of receptacles and their proper mounting on a circuit board.

As can be appreciated from the Figures, the depicted connector 529 omits a housing. Applicants have surprisingly discovered that the use of a housing is unnecessary to support a wafer set 620 so long as the wafers are securely fastened together, preferably on at least two sides. In a depicted embodiment retaining bars 571 are positioned on opposing sides and one of the sides has two retaining bars 571. The retaining bars 571 are connected to wafer set 620 via wafer nubs such as wafer nubs 629 that can be heat staked onto the retaining bars 571. The depicted connector 529 illustrates an embodiment with two retaining bars positioned on one side, one retaining bar positioned on a second side and one retaining bar positioned on a third side of the wafer set 620. It has been determined that removing the housing provides certain unexpected benefits. One issue is that no housing is perfectly square and straight, thus the tolerance in the housing adds to the tolerance in the wafers and thus increases the tolerance of the location of the tails. By removing the housing it is believed that one can better control the position of the tails of the wafer set with respect to the cage. The removal of the housing also allows for the size of the receptacle to be decreased, thus allowing for increased density.

The depicted connector 529 illustrates an embodiment with retaining clips 572 for securing card slot plugs 550 and 560 to wafer set 620. The retaining clips 572 are connected to card slot plugs 550 and 560 via nubs or posts that can be heat staked onto the retaining clips 572. Depending on the embodiment, some or all of the retaining bars or either or both retaining clips may be conductive structures that are used for commoning across some or all of the ground wafers. Also depending on the embodiment, there may be both a digital ground and a chassis ground, digital ground being associated generally with signal transmission and a signal reference while chassis ground being associated generally with an external shielding function and an Earth reference. In certain systems or situations, digital ground and chassis ground are ideally isolated from each other, while in other situations it may be advantageous to common digital and chassis ground. The retaining bars and retaining clips may not perform any commoning function or they may perform commoning for either digital ground or chassis ground or some combination of both. For example, the retaining bars may perform commoning for digital ground, while the retaining clips may perform commoning for chassis ground. In other embodiments, at least some of the retaining bars engage the cage so it may not be desirable for them to make contact with the plated plastic of one or more ground wafers, thereby maintaining isolation between the different grounds of the wafers and cage.

Similar to wafer designs already described, wafer set 620 has a front contact row 641 and a rear contact row 642 that are spaced apart in a plug module insertion direction and the contact rows are configured to engage two rows of pads on a mating connector. While not required, the benefit of such a design is a substantial increase in density. If such density is not desired then the wafers can be made to support a lesser number of terminals.

Depicted wafer set 620 includes three wafer blocks, two high-speed wafer blocks 660 on either side of a low-speed/power wafer block 670. It should be noted that depicted high-speed wafer blocks 660 are arranged in a manner that provides a ground-signal-signal-ground-signal-signal-ground pattern, while low-speed/power wafer block 670 is arranged in a manner that provides either a signal-signal-power-signal-signal pattern or a signal-signal-ground-signal-signal pattern. Other patterns are also possible. Thus, high-speed wafer block 660 includes sequentially left ground wafer 661, left differential pair signaling wafer pair 662, middle ground wafer 663, right differential pair signaling wafer pair 664 and right ground wafer 665.

Each wafer of the signaling wafer pairs 662, 664 includes an insulative frame (molded plastic, for example, such as LCP) disposed over or around a plurality of signal terminals. For example, referring to FIGS. 40-43, signaling wafer pair 662 includes insulative frame 662*a* and insulative frame 662*b*. As depicted with respect to a previously described embodiment (in FIG. 21, for example, see terminal sets 252 and 262), the depicted insulative frames 662*a*, 662*b* support terminal sets 710, 712, respectively. The insulative frame may be formed by insert- or over-molding about the terminal sets 710, 712 or with housing components that are manufactured separately from the terminal sets. The terminal sets 710, 712 and terminals 711, 713 may be identical or similar to the terminal sets 252, 263 and terminals 253, 263 described above.

Figure 42:
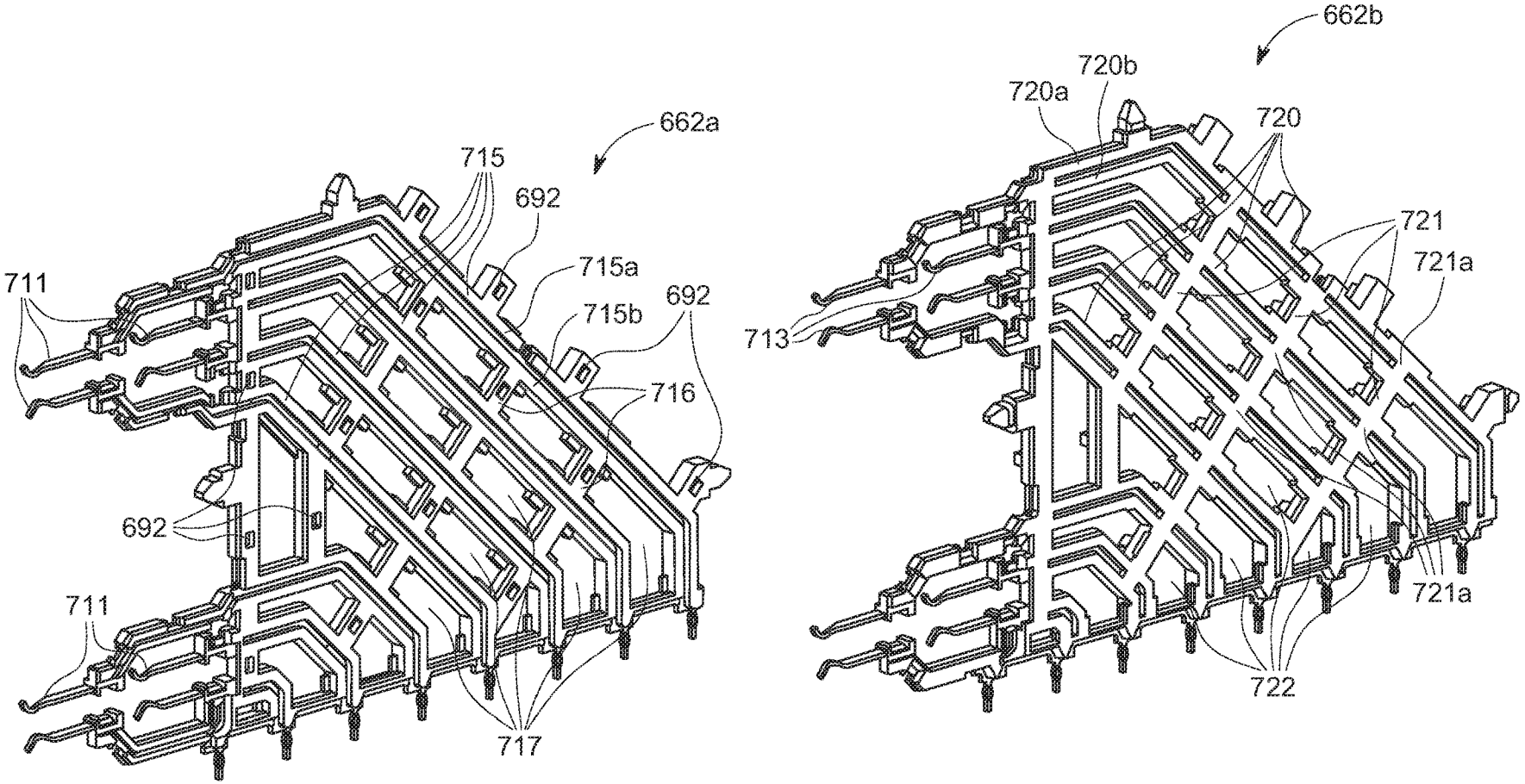
FIG. 42 illustrates a front-right partially exploded perspective view of the left signaling wafers from the high-speed wafer block depicted in FIG. 32.
Figure 43:
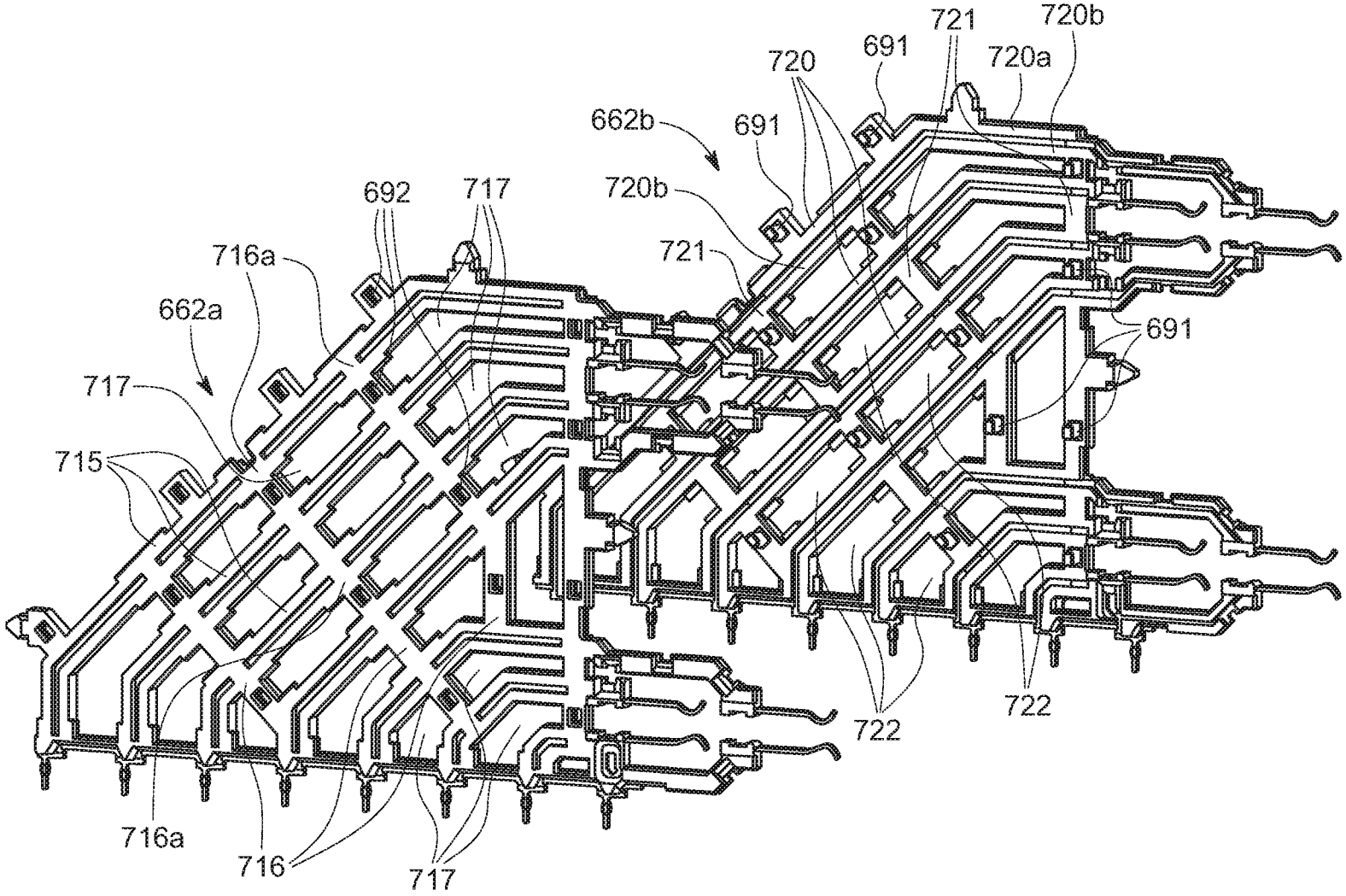
FIG. 43 illustrates a front-left partially exploded perspective view of the left signaling wafers from the high-speed wafer block depicted in FIG. 32.
Figure 44:
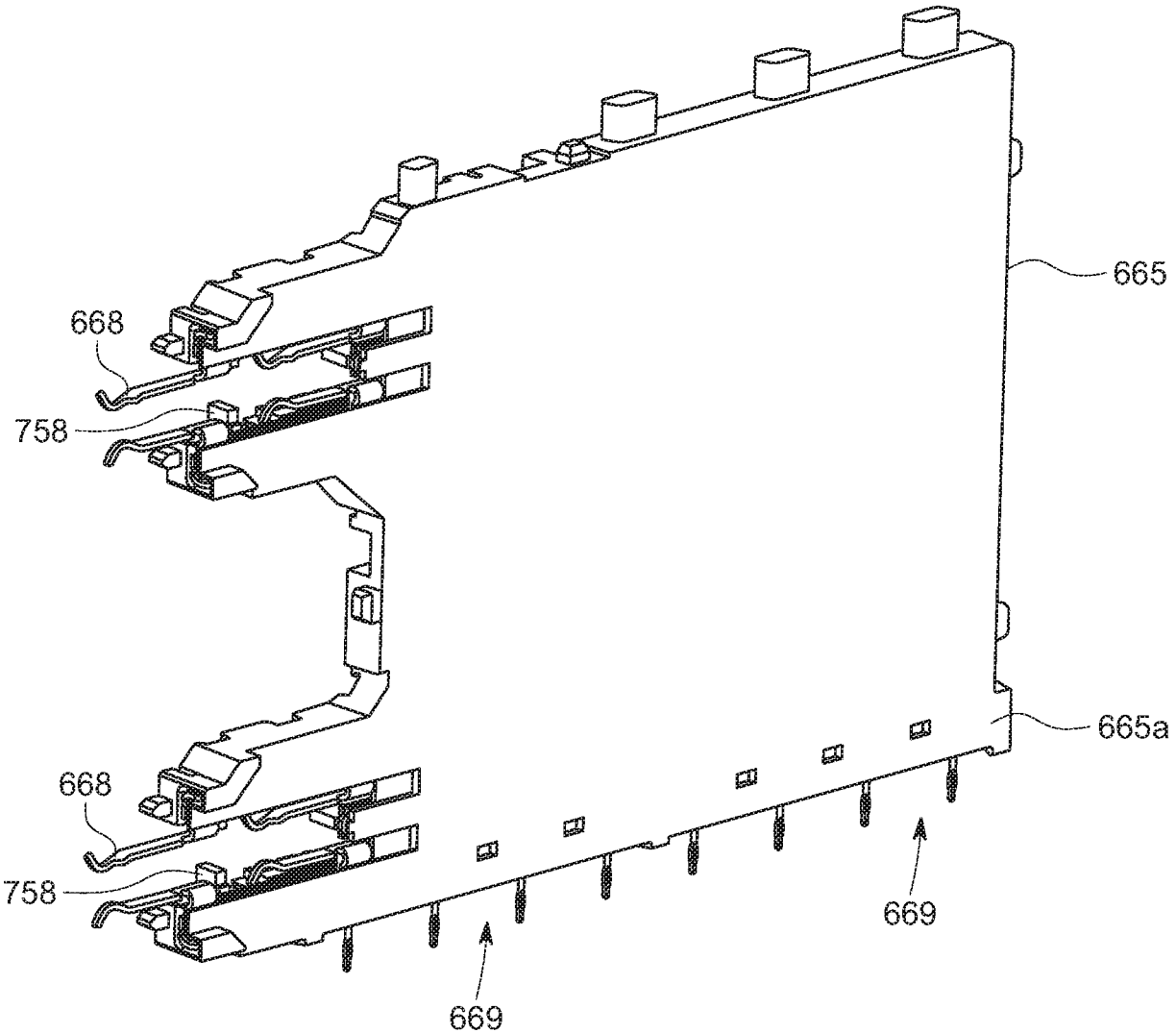
FIG. 44 illustrates a perspective view of the right ground wafer from the high-speed wafer block depicted in FIG. 32.
Figure 45:
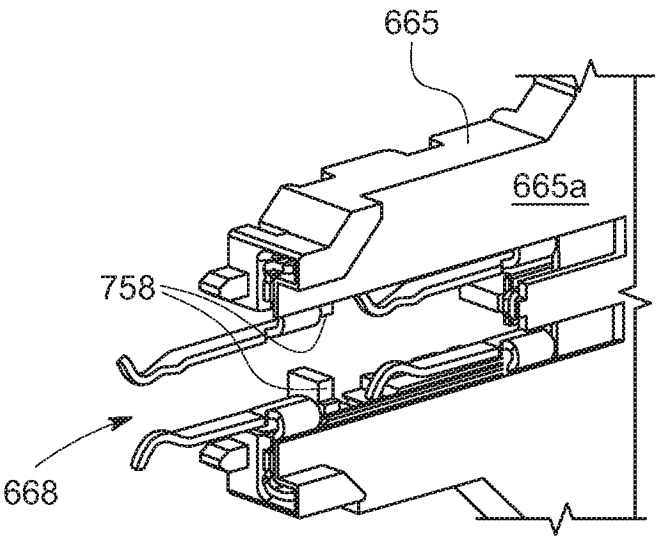
FIG. 45 illustrates an enlarged perspective view of the right ground wafer from the high-speed wafer block depicted in FIG. 32.
Figure 46:
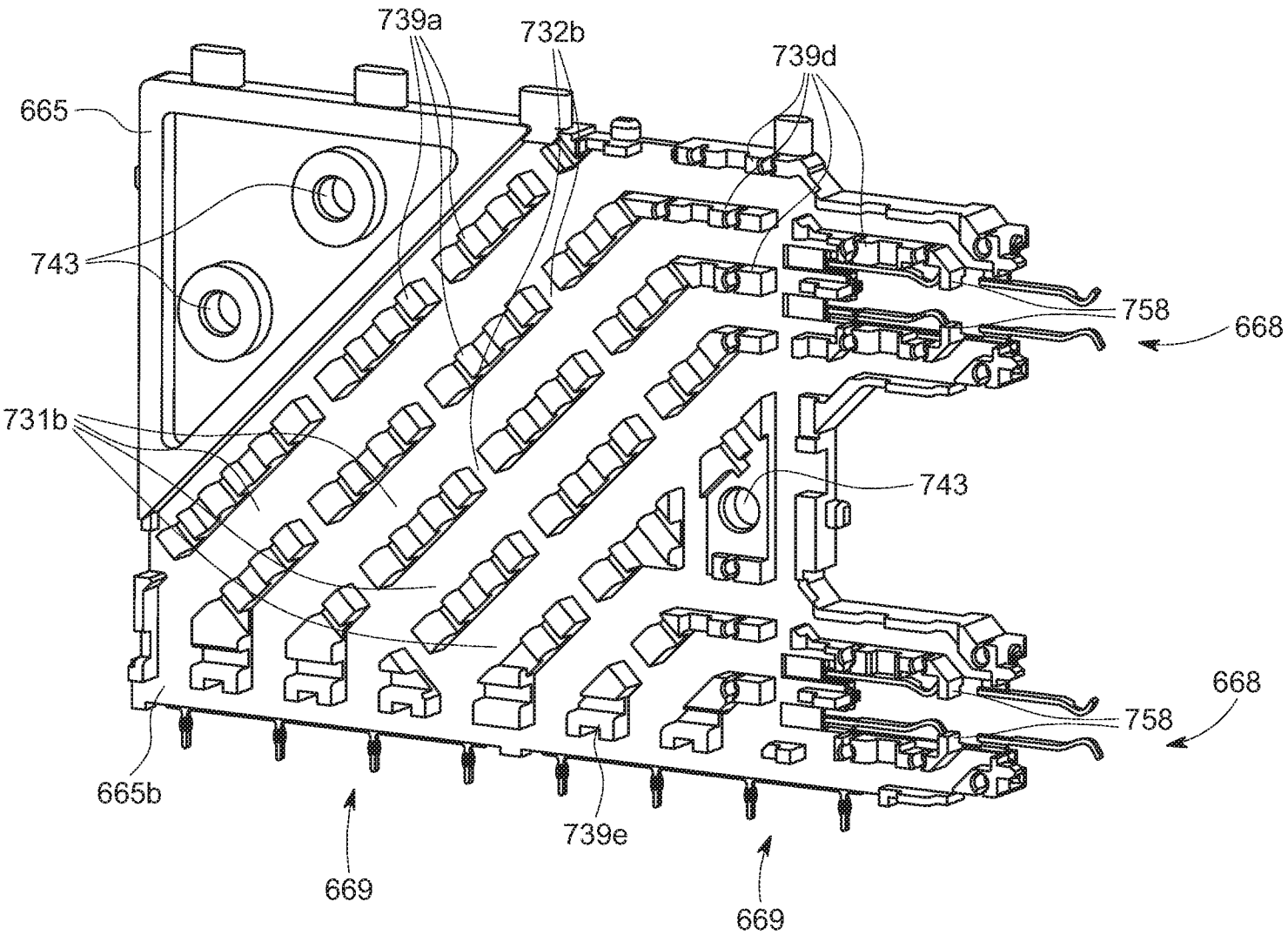
FIG. 46 illustrates another perspective view of the right ground wafer from the high-speed wafer block depicted in FIG. 32.
Figure 47:
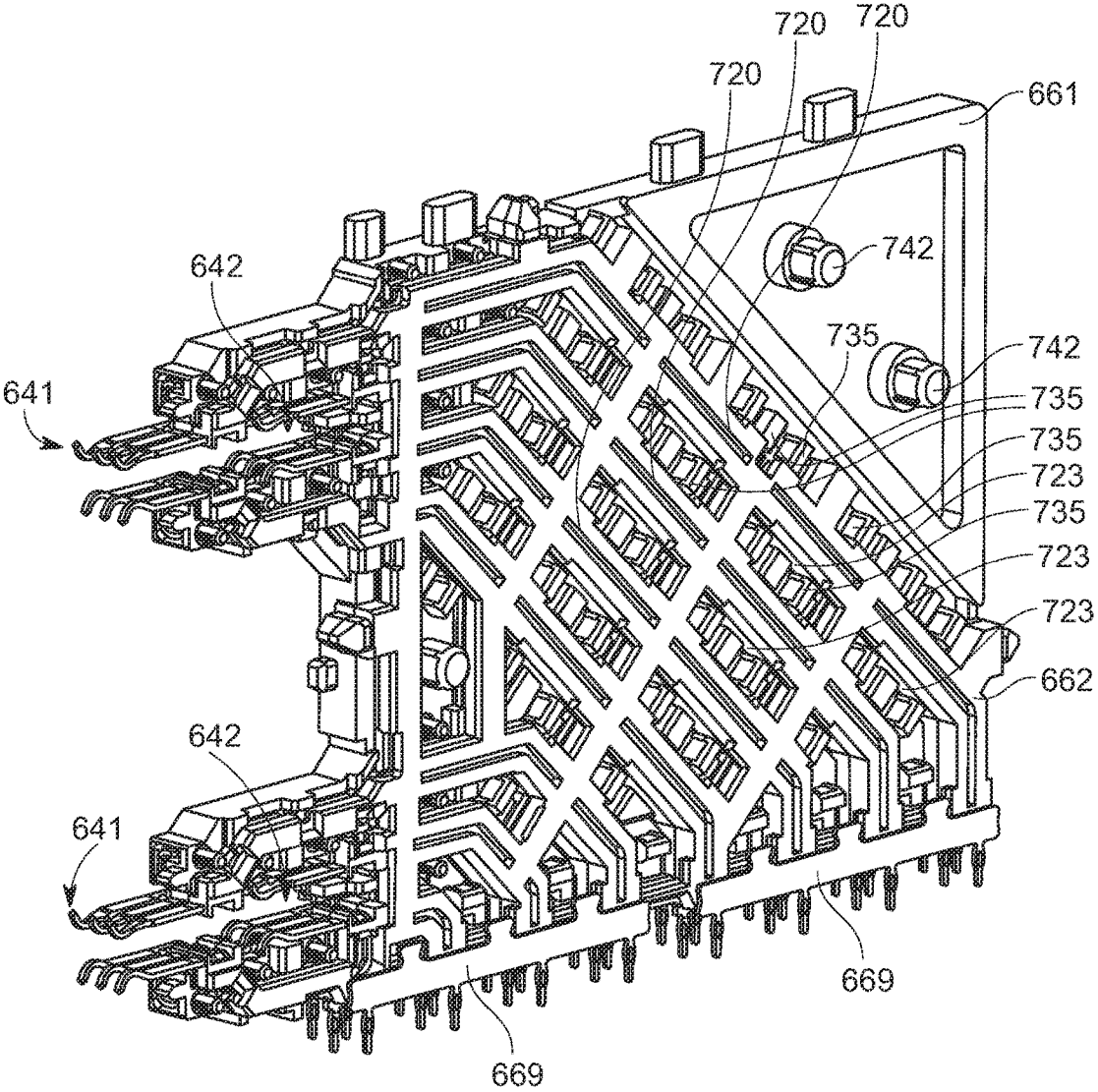
FIG. 47 illustrates a perspective view of the left ground wafer and the left signaling wafers from the high-speed wafer block depicted in FIG. 32.
Figure 48:
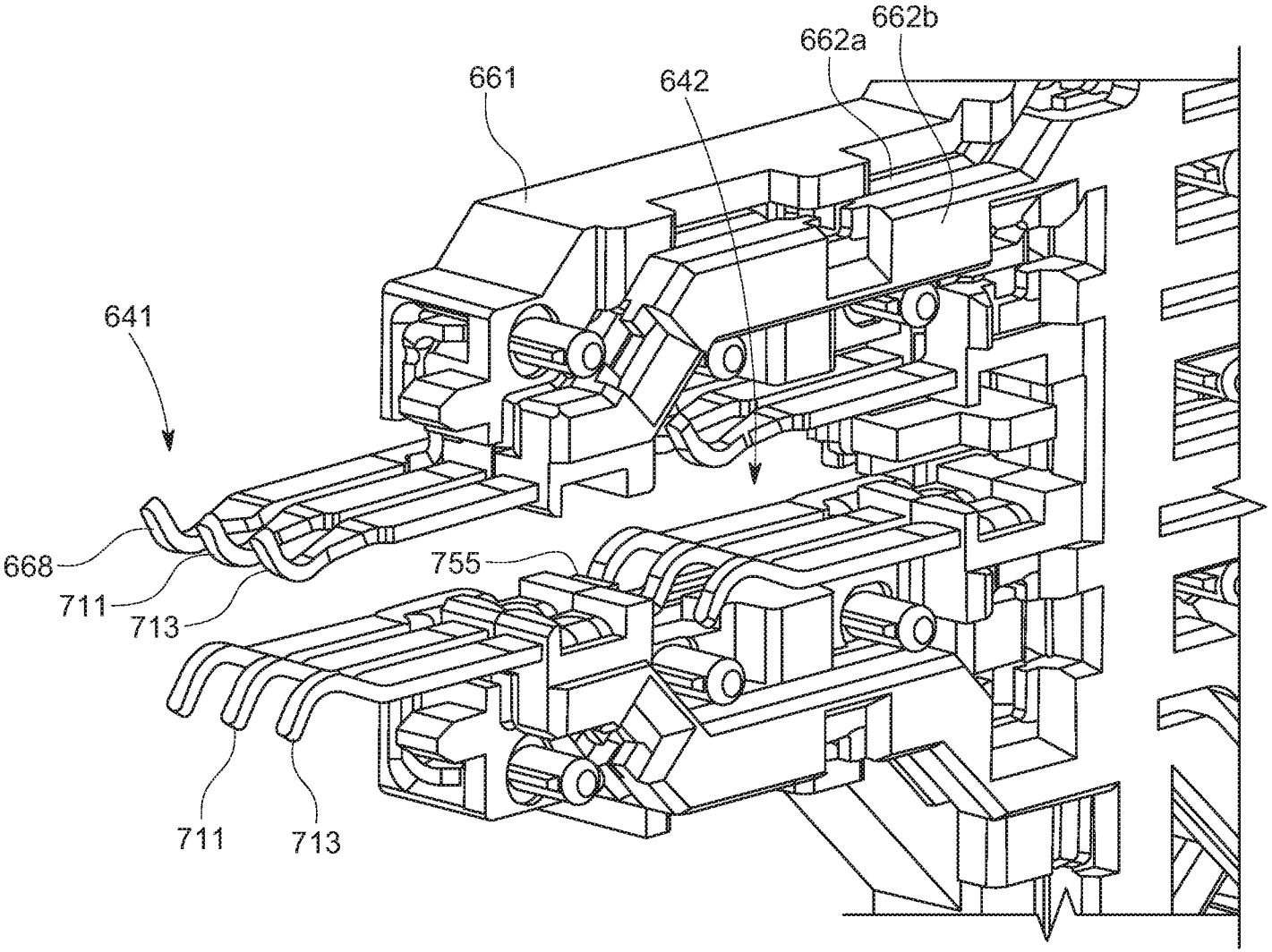
FIG. 48 illustrates an enlarged perspective view of the left ground wafer and the left signaling wafers from the high-speed wafer block depicted in FIG. 32.
Figure 49:
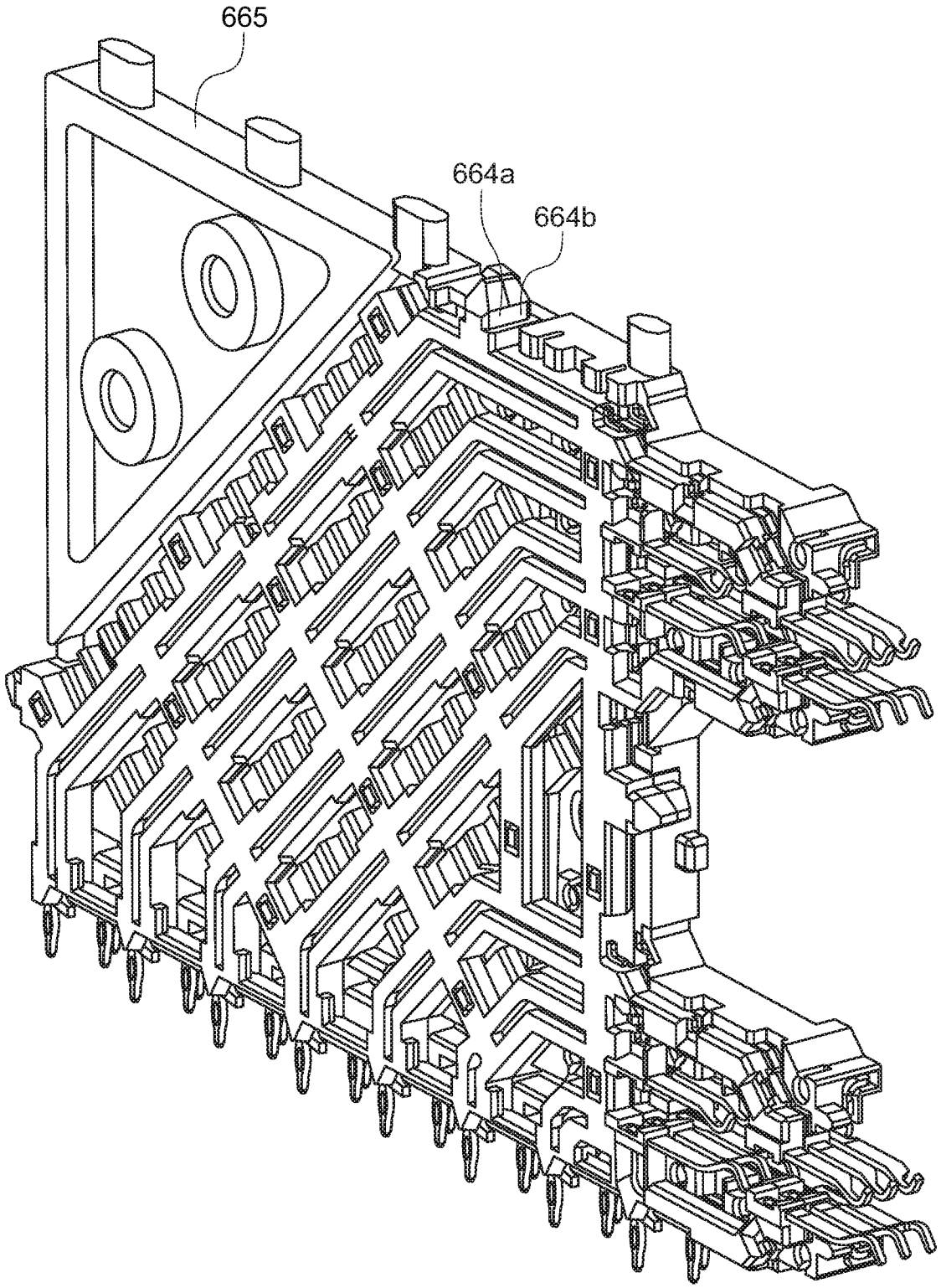
FIG. 49 illustrates a perspective view of the right ground wafer and the right signaling wafers from the high-speed wafer block depicted in FIG. 32.
Figure 50:
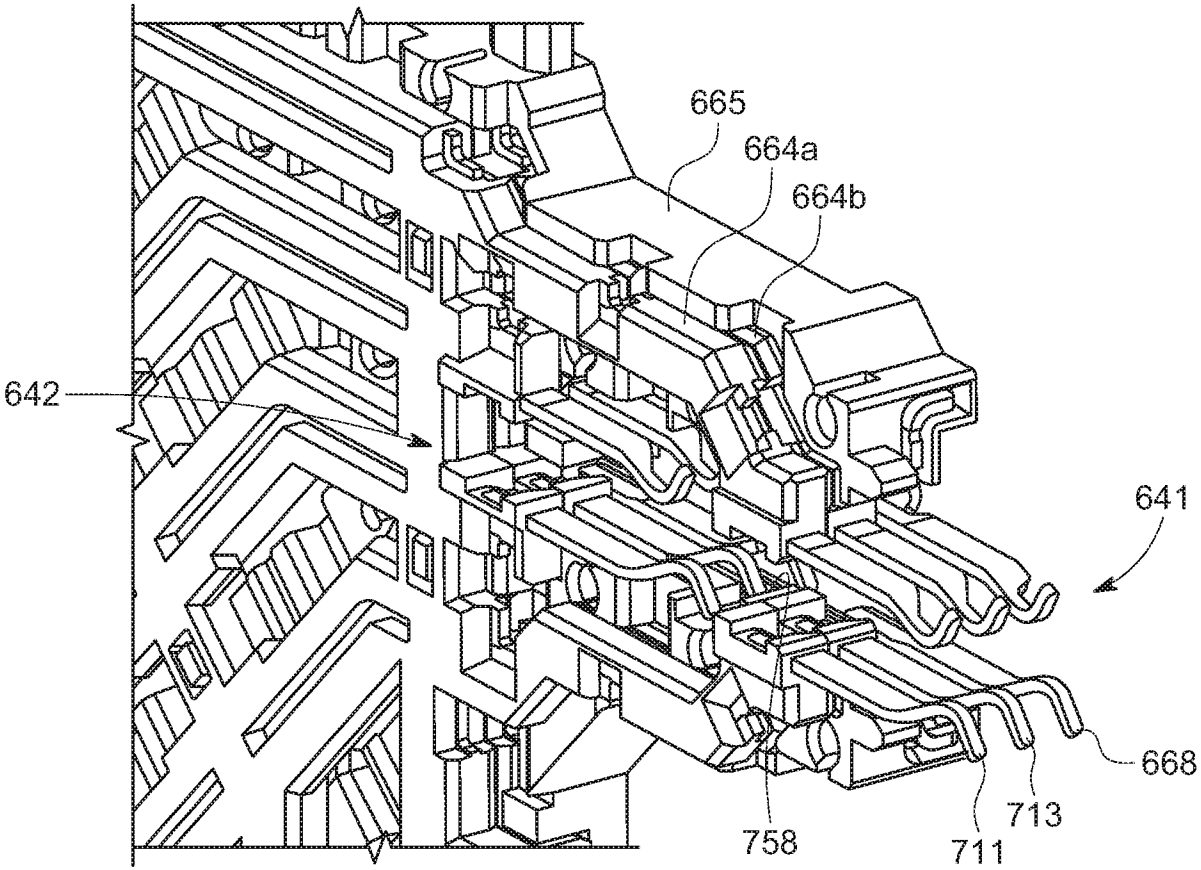
FIG. 50 illustrates an enlarged perspective view of the right ground wafer and the right signaling wafers from the high-speed wafer block depicted in FIG. 32.
Figure 51:
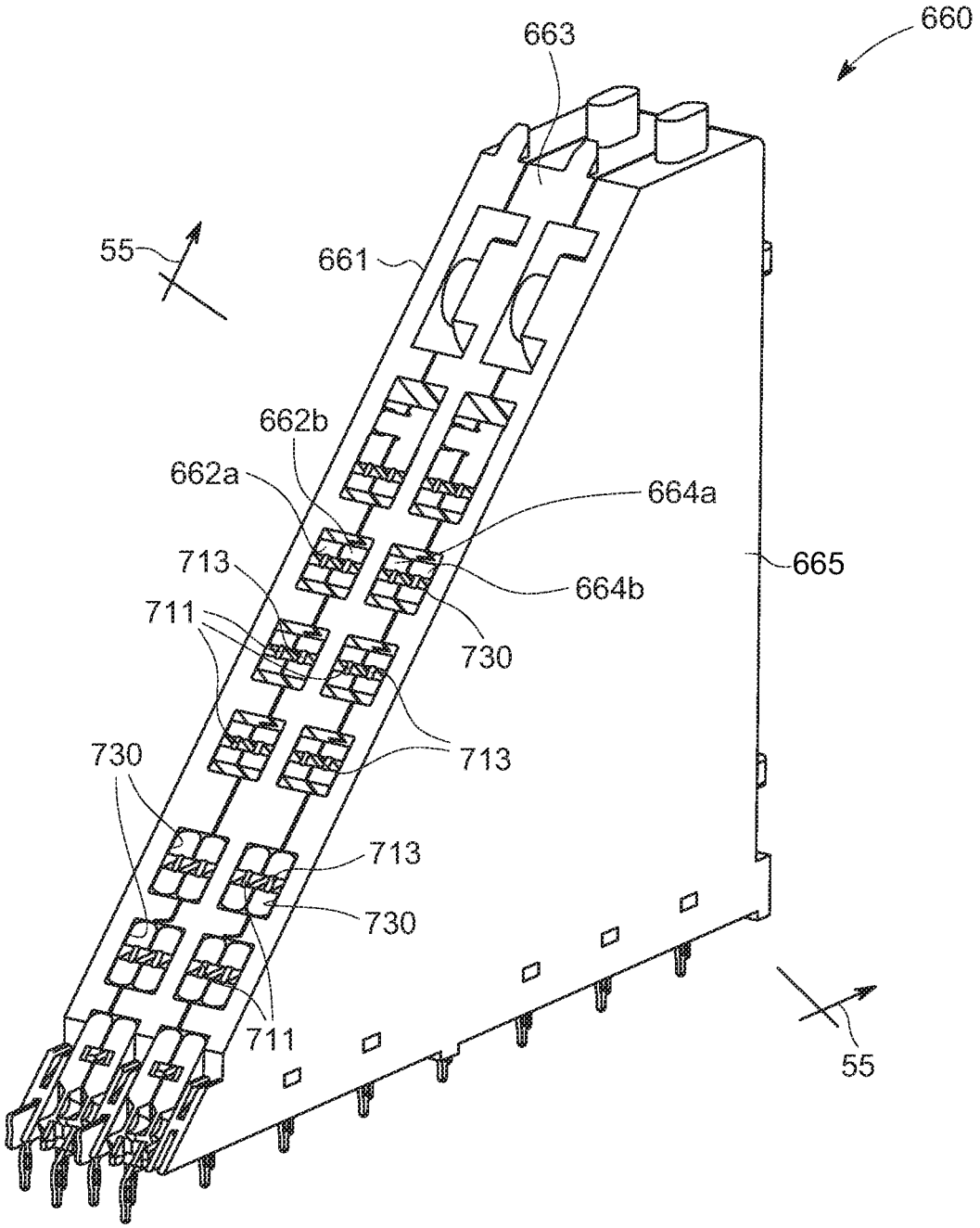
FIG. 51 illustrates a perspective cross-sectional view of the high-speed wafer block depicted in FIG. 32 taken generally along line 51-51.
Figure 52:
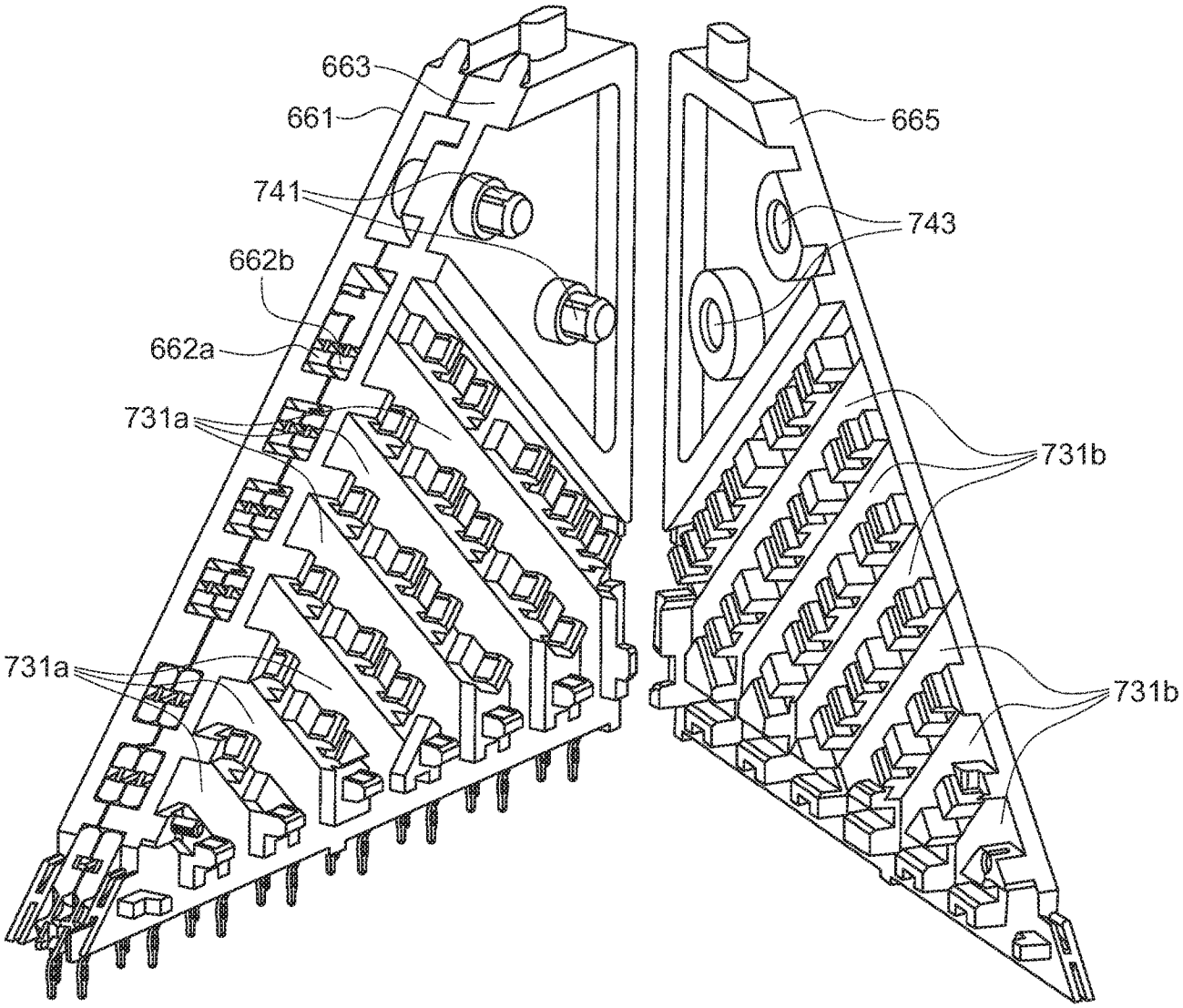
FIG. 52 illustrates a partially exploded view of the high-speed wafer block depicted in FIG. 51 with the right signaling wafers removed for clarity.
Figure 53:
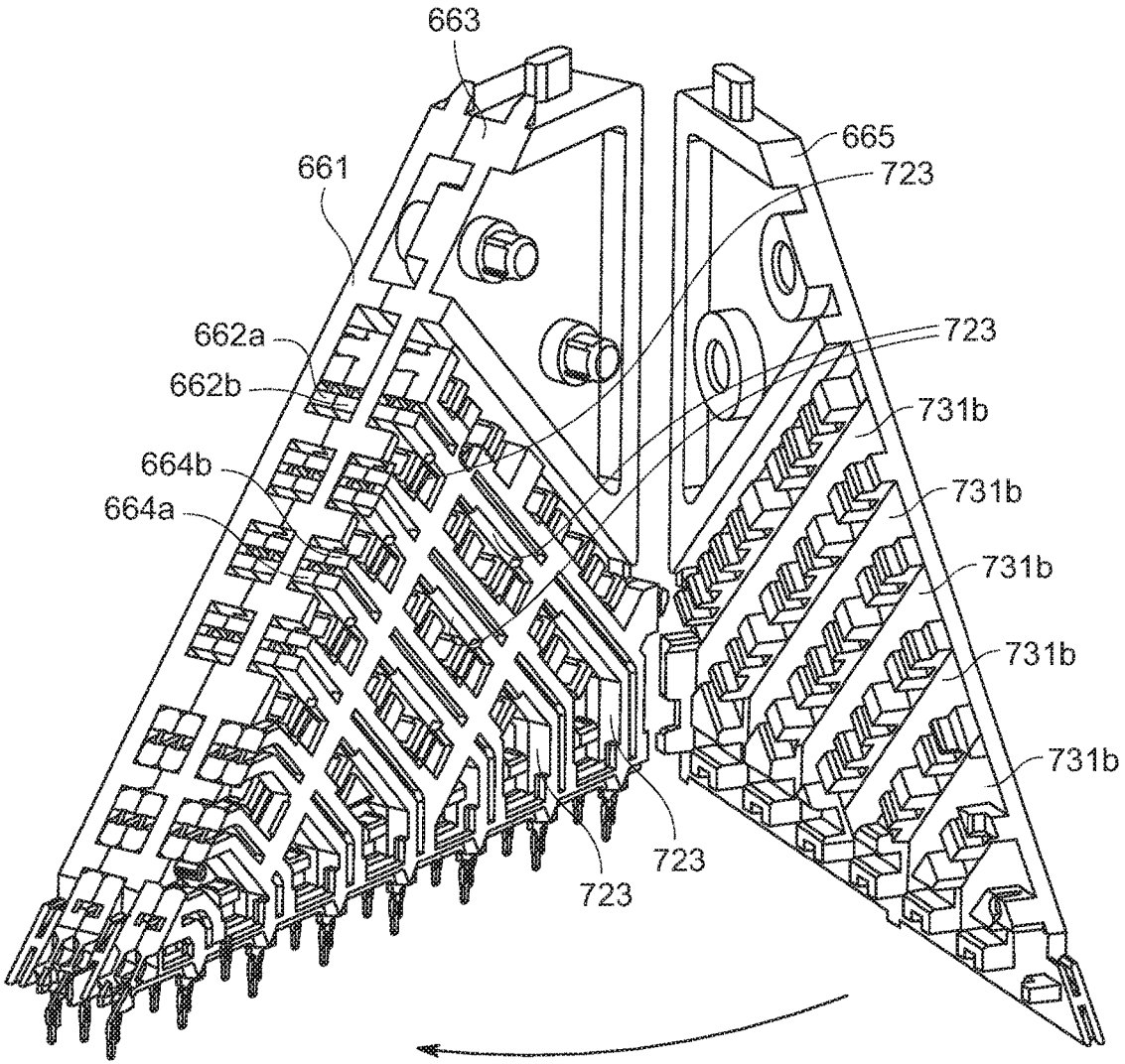
FIG. 53 illustrates a partially exploded view of the high-speed wafer block depicted in FIG. 51.
Figure 54:
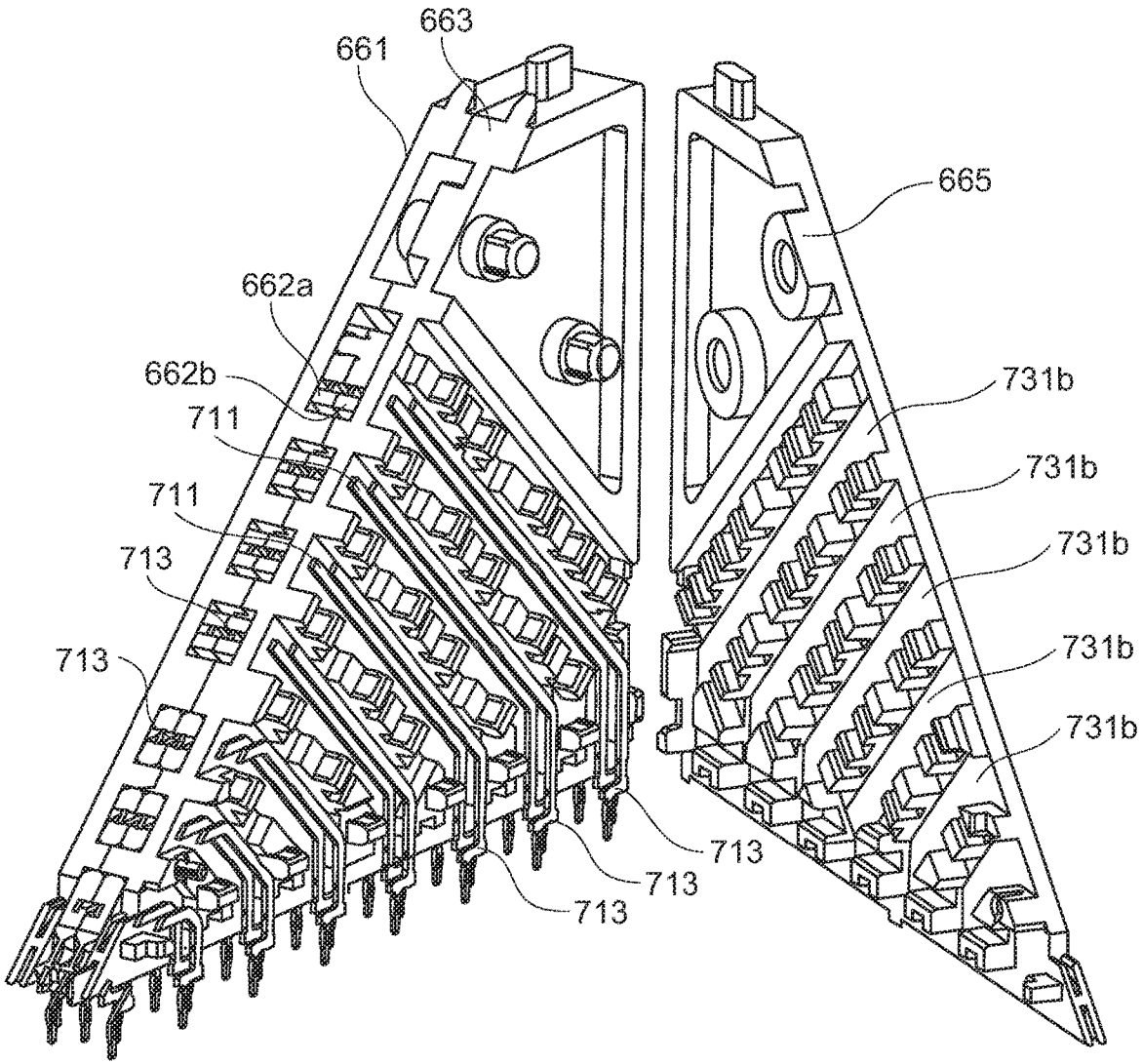
FIG. 54 illustrates a partially exploded view of the high-speed wafer block similar to FIG. 53 but with the insulators of the right signaling wafers removed for clarity.
Figure 55:
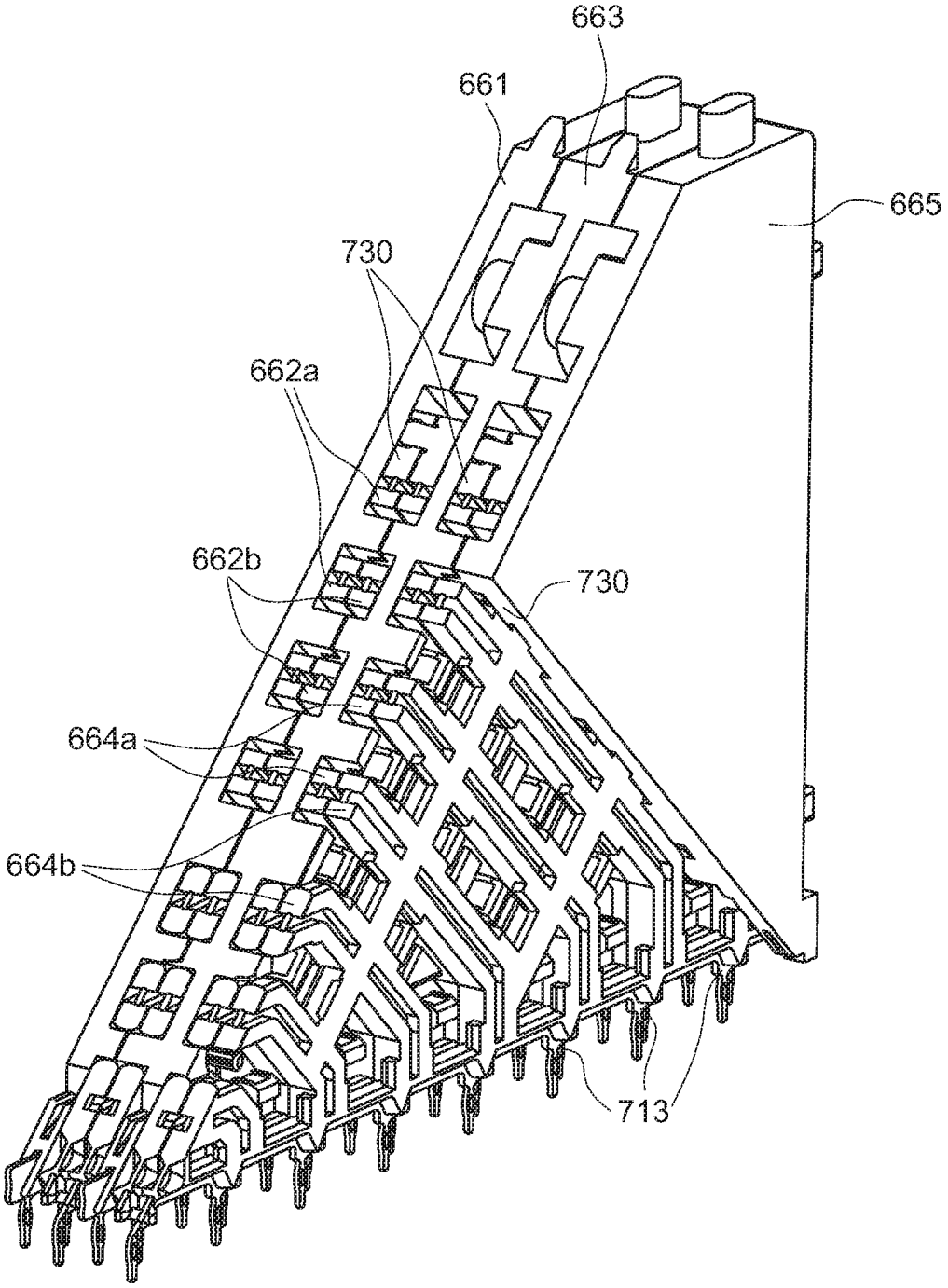
FIG. 55 illustrates a perspective cross-sectional view of the high-speed wafer block depicted in FIG. 51 with a portion of the right ground wafer sectioned generally along line 55-55.
Figure 56:
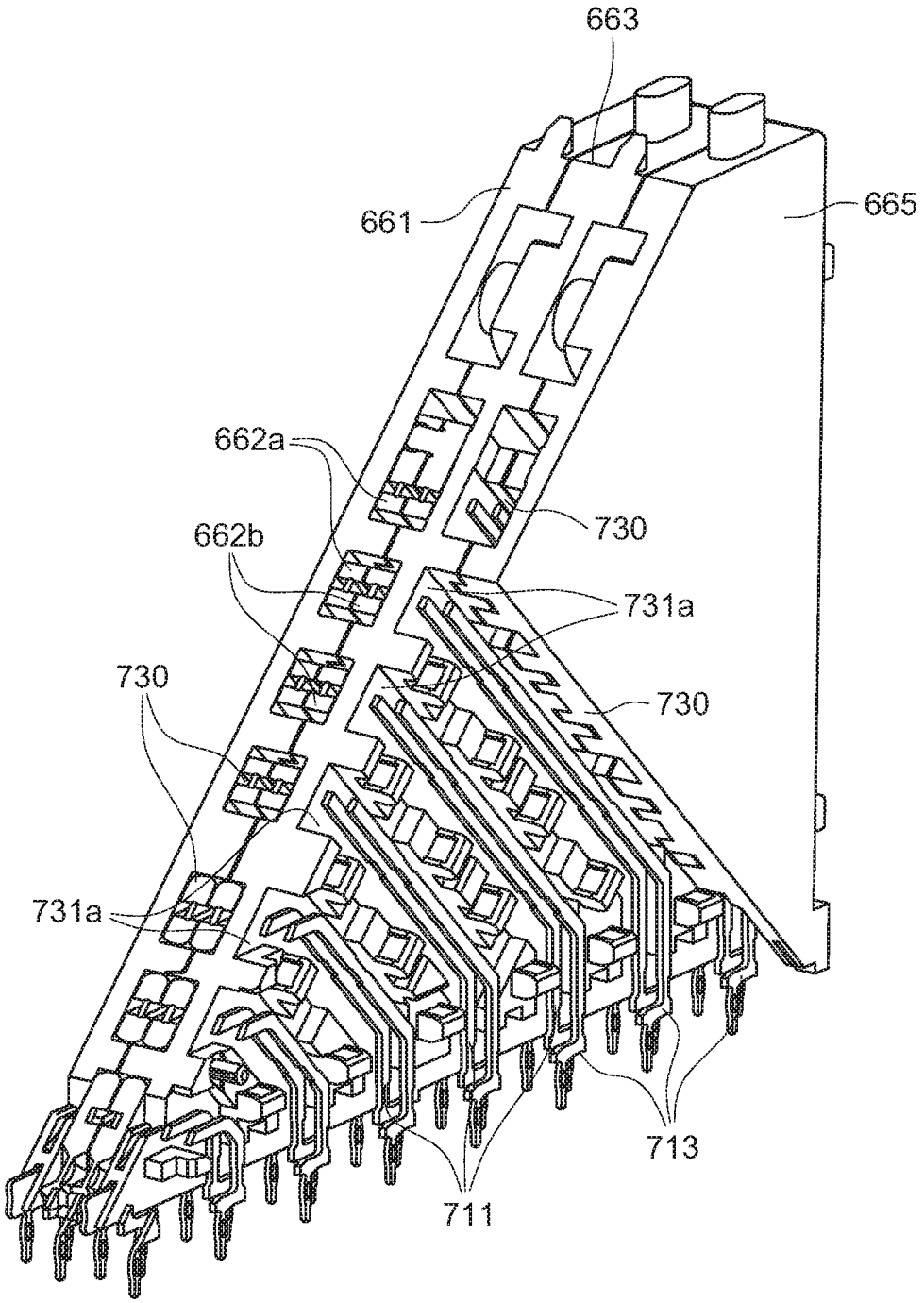
FIG. 56 illustrates a perspective cross-sectional view of the high-speed wafer block similar to FIG. 55 but with the insulators of the right signaling wafers removed for clarity.

As depicted in FIGS. 42 and 43 (and FIGS. 21-25 for reference), each terminal of each differential pair is broadside coupled to the other with only an air-gap between them except along their outer edges where they are supported by their respective wafer's insulative frame. More specifically, each terminal 711 of terminal set 710 includes a terminal web 715 of the insulative material of insulative frame 662*a* that partially surrounds the terminal along the length or substantially the entire length thereof. The terminal web 715 includes an upper portion 715*a* that extends in a continuous manner along the entire length and along the upper edge of each terminal 711 and a lower portion 715*b* that extends in a continuous manner along the entire length and along the lower edge of each terminal. The inner surface of each terminal (i.e., facing its broad-side coupled counterpart terminal) is free of insulation as best seen in FIG. 42 while the opposite side of each terminal (i.e., facing its adjacent ground wafer 661) is generally free of insulation but includes insulation along certain portions thereof. The insulative frame 662*a* further includes connecting webs 716 that extend between and connect the terminal webs 715. As depicted, the connecting webs 716 extend over portions of the terminals 711 at 716*a*. In some embodiments, the overlapping portions 716*a* may be omitted. The terminal webs 715 and connecting webs 716 define a plurality of voids or openings 717 between vertically aligned pairs of terminal webs along the length thereof.

The terminals 713 of the terminal sets 712 are configured with a terminal web 720 of the insulative material of insulative frame 662*b* that partially surrounds the terminals along the length or substantially the entire length thereof in a similar but mirror image manner as compared to webs 715. The terminal webs 720 include similar upper portions 720*a*, lower portions 720*b*, connecting webs 721, insulative portions 721*a* and openings 722 and the descriptions thereof are not repeated. Upon the aligning and securing the insulative frames 662*a* and 662*b* together, the terminal webs 715, the connecting webs 716, and the openings 717 of the frame 662*a* are aligned with the terminal webs 720, the connecting webs 721, and the openings 722 of the frame 662*b*, respectively. Upon securing the insulative frames 662*a* and 662*b* together, the aligned openings 717 and 722 define openings 723 that pass through the entire signaling wafer pair.

The insulative frames of each signaling wafer pair 662, 664 may be secured together in any desired manner For example, as depicted in FIGS. 42-43, the insulative frames 662*a*, 662*b* of signaling wafer pair 662 have pegs or projections 691 and complementary shaped holes or recesses 692 for mating with one another when joined. (Depending on the embodiment, some or all of the signaling wafer holes may not extend all of the way through the wafers, and the arrangement of pegs and holes depicted is merely one example—many embodiment dependent variations are possible.) In some embodiments, the pegs and holes of one signaling wafer have an interference fit with the other signaling wafer. Also, in some embodiments, signaling wafer pairs are welded together to fix the alignment of their respective terminal sets and therefore the alignment of the resulting differential pairs that each corresponding pair of terminals (one terminal from each terminal set) creates.

Figure 34:
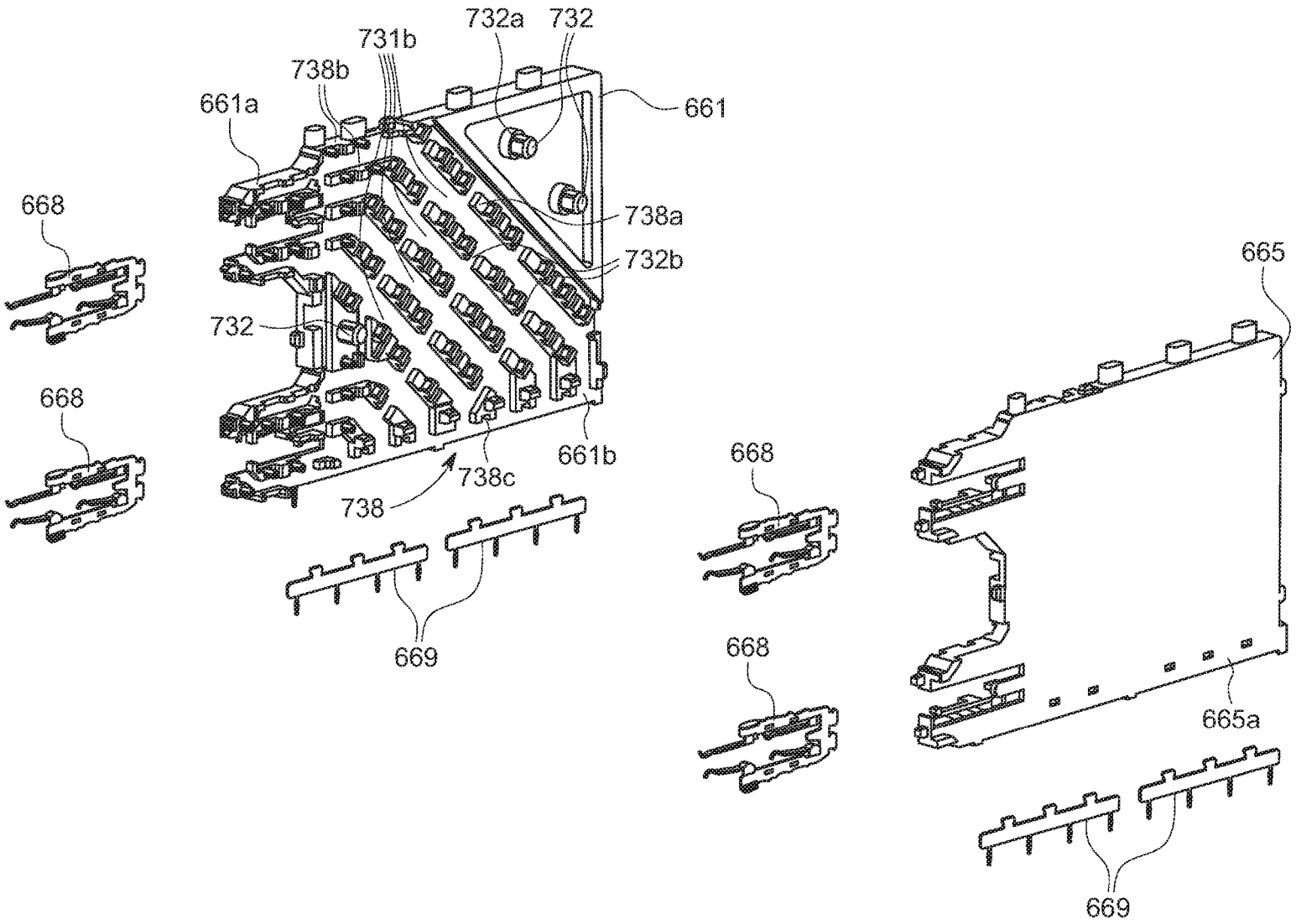
FIG. 34 illustrates a partially exploded perspective view of the outer ground wafers from the high-speed wafer block depicted in FIG. 32 showing ground wafer contact and tail inserts.
Figure 35:
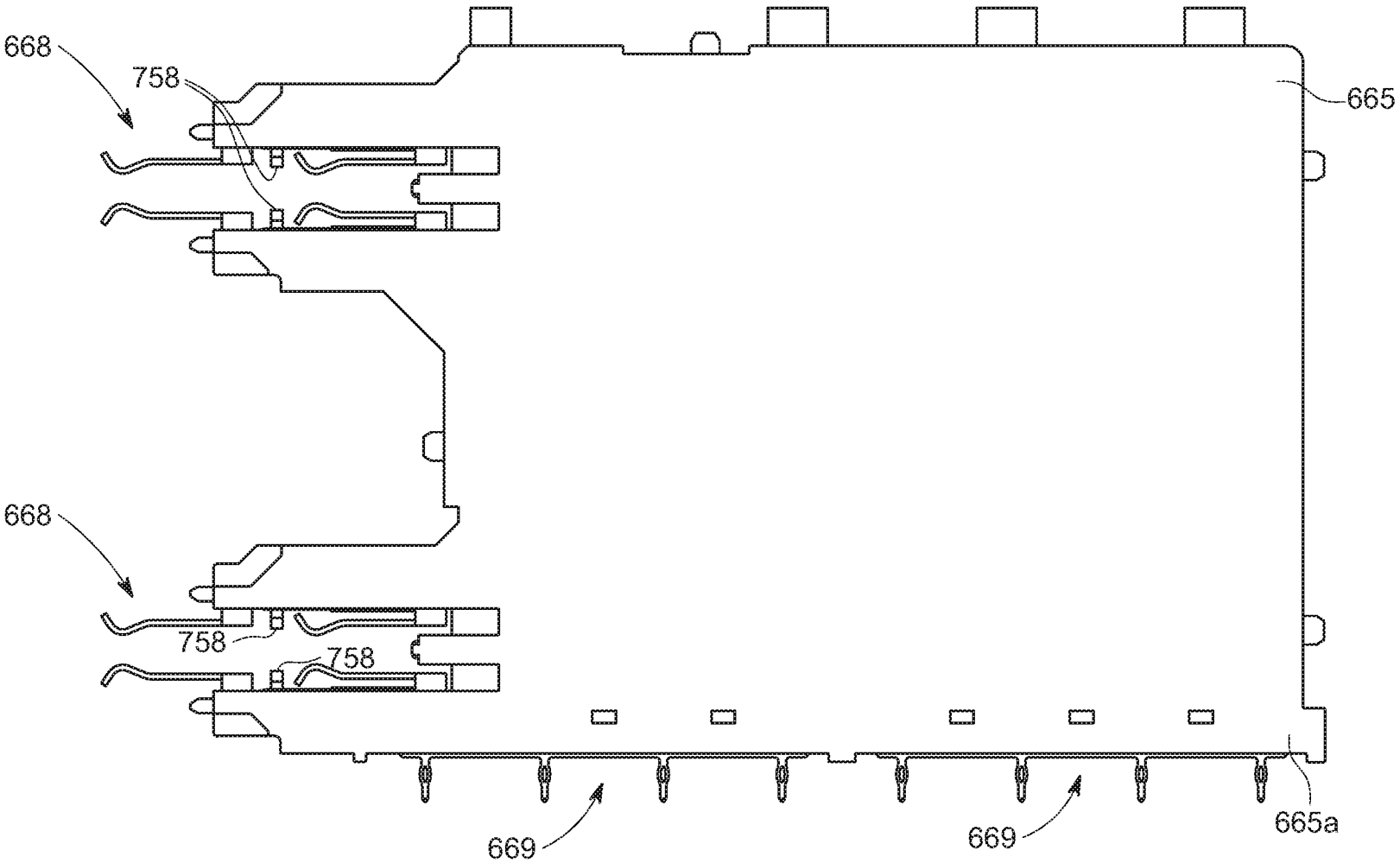
FIG. 35 illustrates a side view of the right ground wafer from the high-speed wafer block depicted in FIG. 32.

Ground wafers 661, 663, 665 are formed of metalized plastic to enable conduction and commoning. For example, metalized plastic may take various forms: it can be doped to become sufficiently conductive, it can be plated, it can be doped and plated, it can be inked, it can be etched, or it can be some combination of any of the preceding. Although, in the case of plating, the plating may cover the entire surface of the ground wafer, selective plating may be desired instead. In some embodiments, metal contact inserts 668 and metal tail inserts 669 (as depicted in FIG. 34) are stitched or inserted into pockets in the ground wafer 665 (as shown after stitching in FIG. 35) rather than being formed through a terminal over-molding process (as described with respect to other embodiments above). This stitching of inserts (whether for the contacts or tails or both) can be done for all or any of the ground wafers 661, 663, 665. Similar contact and/or tail inserts may be formed for various signaling wafers or power wafers and then stitched into those wafers as desired. In addition, the tail inserts may be press-fit tail inserts or surface-mount tail inserts. Instead of tail inserts, it is envisioned that some embodiments would include plated or metalized conductive plastic tails. Such tails could be formed as part of any molded wafer and either be conductive or be made conductive (plated, for example).

Again, and more generally stated, approaches are being described that facilitate combining a molded and galvanic serial conductive path with conductive-wafer supported communication between the traditional mateable connector portion and the traditional termination section, such as a press-fit terminal set connected to a PCB. This conductive communication section is traditionally formed by an extension of the stamped and formed press-fit tails with similarly stamped metal sections forming ground and/or signal terminals. The contemplated stitching of inserts that are capable of providing a hybrid solution that combines the versatility of stamped and formed features with the precision and versatility of molded plastic with inherent conductive elements is contemplated. While the solution set herein described primarily relates to the incorporation of a molded conductive ground system with commoned terminal sets, the application of this technology can be also applied to discrete signal terminals.

As depicted, ground wafers 661, 663, 665 have many raised areas (nubs), pegs and recesses for mating with one another when sandwiching signaling wafer pairs 662 and 664 therebetween. In some embodiments, the pegs and recesses of one ground wafer have an interference fit with the opposite sandwiching ground wafer, and in some embodiments, the raised areas of each meet to substantially fill the voids of the sandwiched signaling wafer pair. (Also, depending on the embodiment, some or all of the ground wafer recesses may instead be holes in the ground wafer for receiving pegs of the opposite ground wafer, and the arrangement of pegs and recesses depicted is merely one example—many embodiment dependent variations are possible.) It is desirable for some or all of the of the raised areas (nubs), pegs and/or recesses to be metalized to enable conduction and commoning between ground wafers 661, 663, 665.

More specifically, the ground wafers 661, 663, 665 are configured to substantially or fully electrically isolate and provide the desired impedance control along each differential signal pair of the signaling wafer pairs 662, 664. Referring to FIGS. 51-56, each adjacent pair of ground wafers (i.e., ground wafers 661 and 663 and ground wafers 663 and 665) includes a series of interlocking projections 735, 738, 739 that form part of a shielding structure that, together with the generally planar structure of the ground wafers, encircles or substantially encircles the paths 730 in which the terminal webs 715, 720 are disposed to at least substantially shield the differential pairs of terminals along their entire or a substantial portion of their length. The interlocking projections 735, 738, 739 form conductive grounding links between the ground wafers 661, 663, 665.

Figure 36:
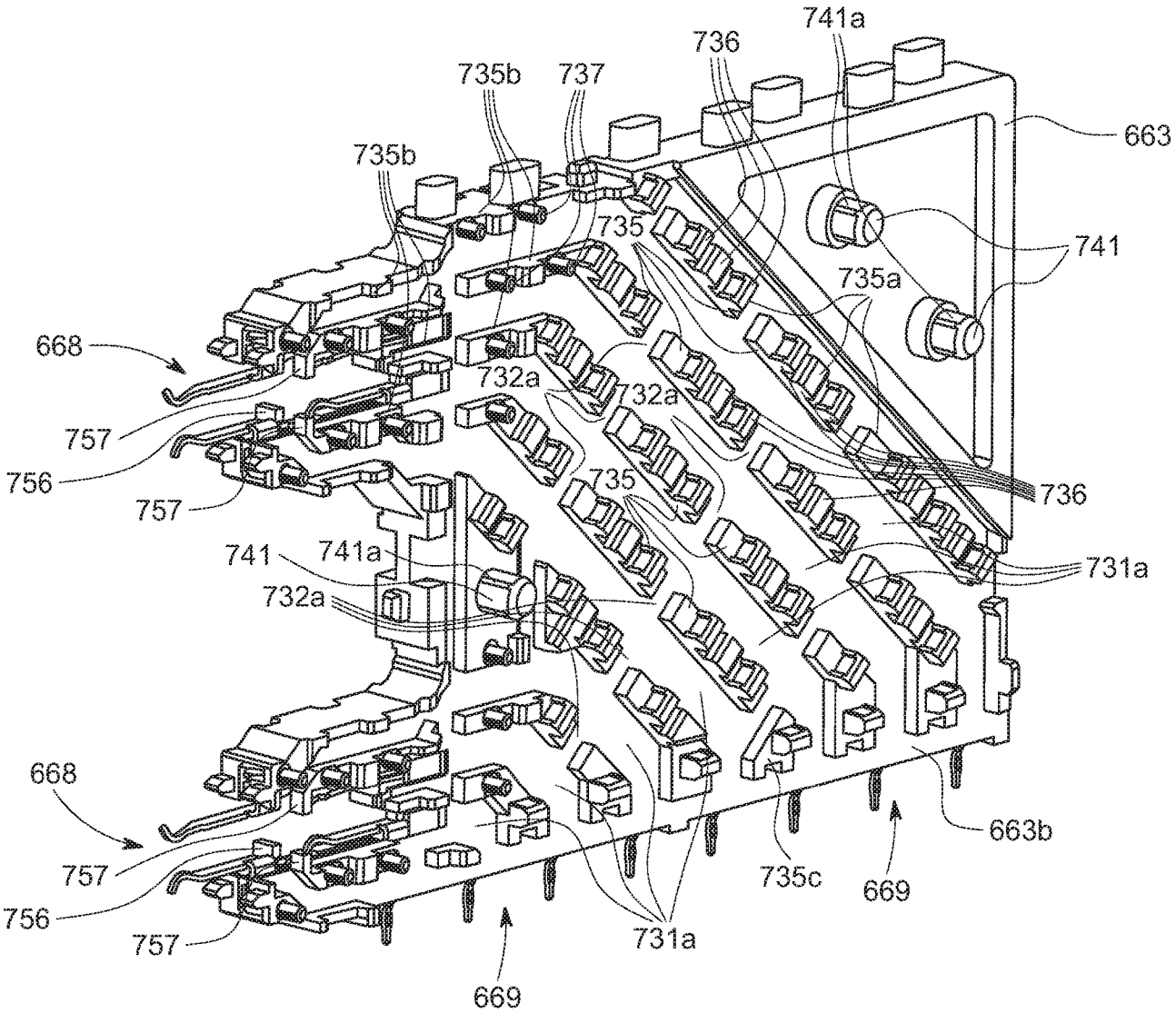
FIG. 36 illustrates a perspective view of the middle ground wafer from the high-speed wafer block depicted in FIG. 32.
Figure 37:
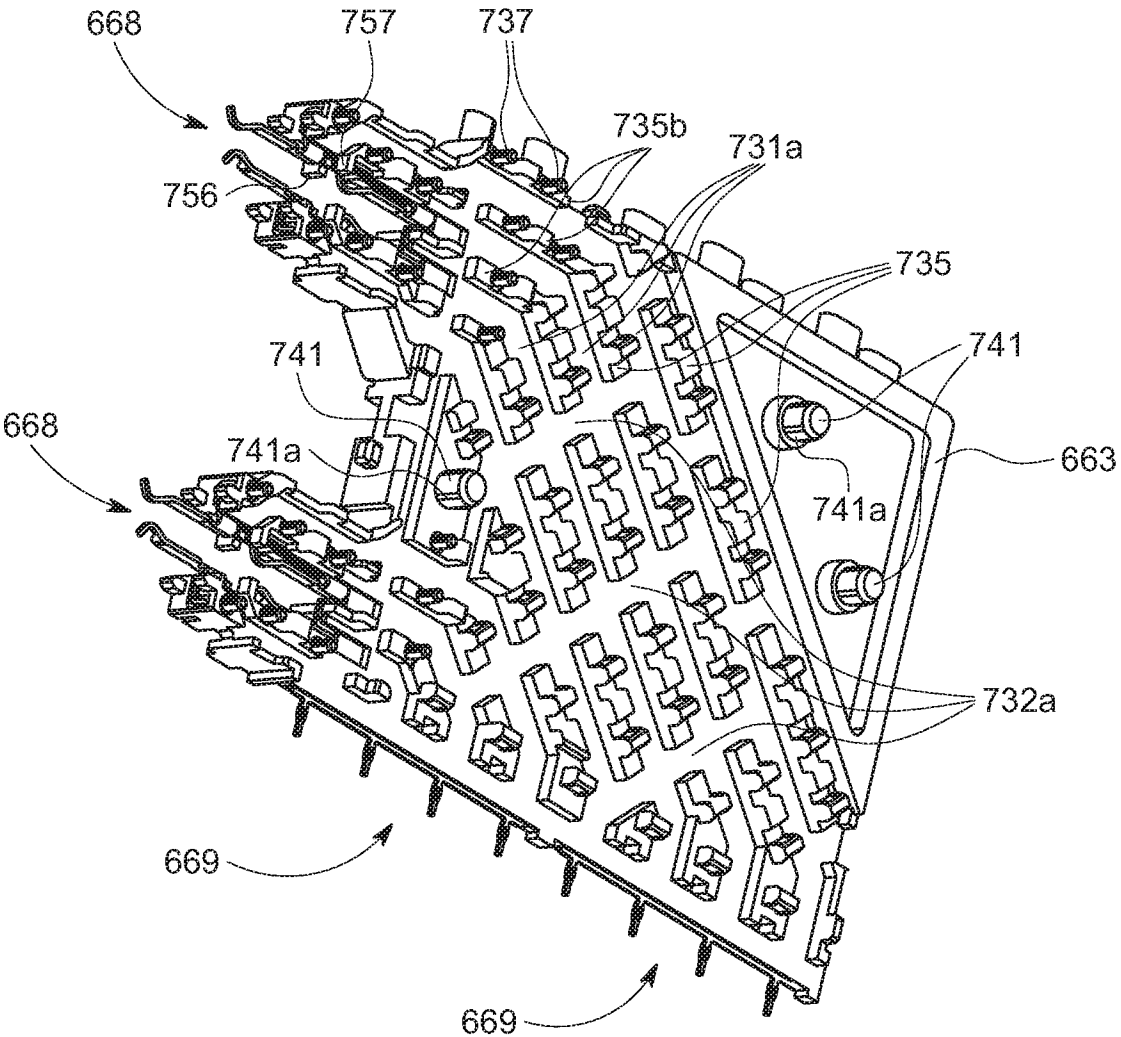
FIG. 37 illustrates another perspective view of the middle ground wafer from the high-speed wafer block depicted in FIG. 32.
Figure 38:
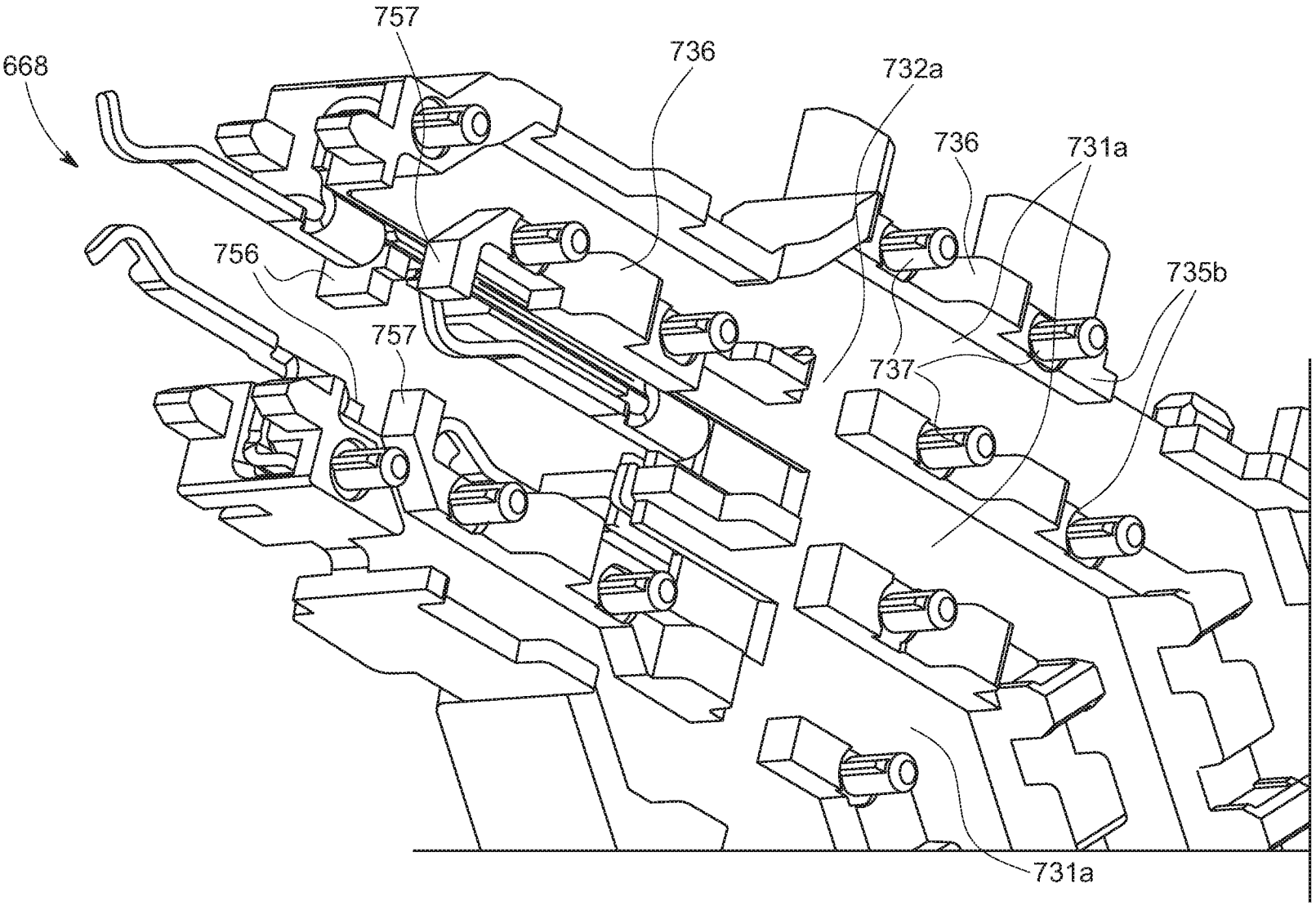
FIG. 38 illustrates an enlarged perspective view of the middle ground wafer from the high-speed wafer block depicted in FIG. 32.
Figure 39:
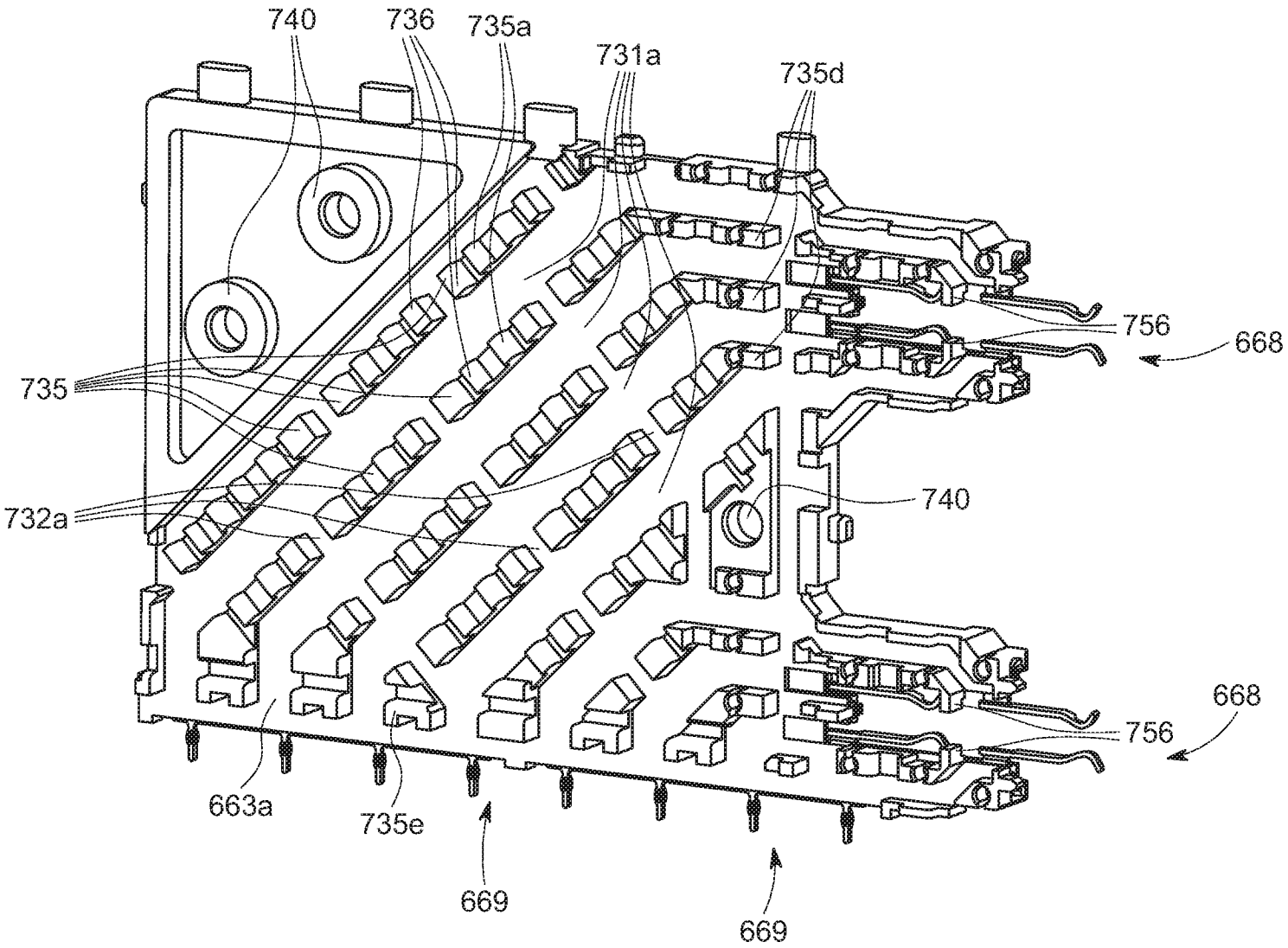
FIG. 39 illustrates a front-left perspective view of the middle ground wafer from the high-speed wafer block depicted in FIG. 32.
Figure 40:
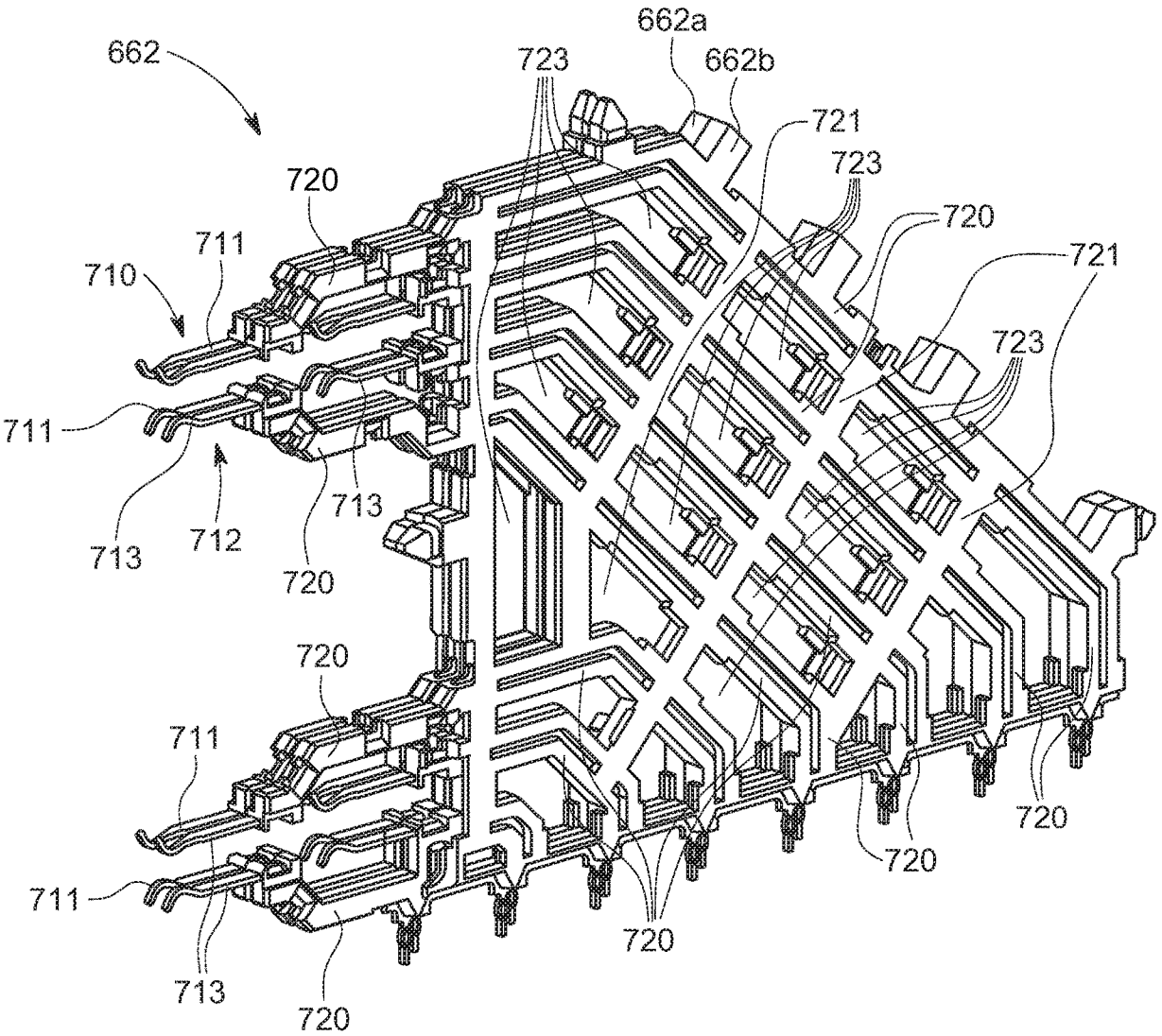
FIG. 40 illustrates a front-right perspective view of the left signaling wafers from the high-speed wafer block depicted in FIG. 32.
Figure 41:
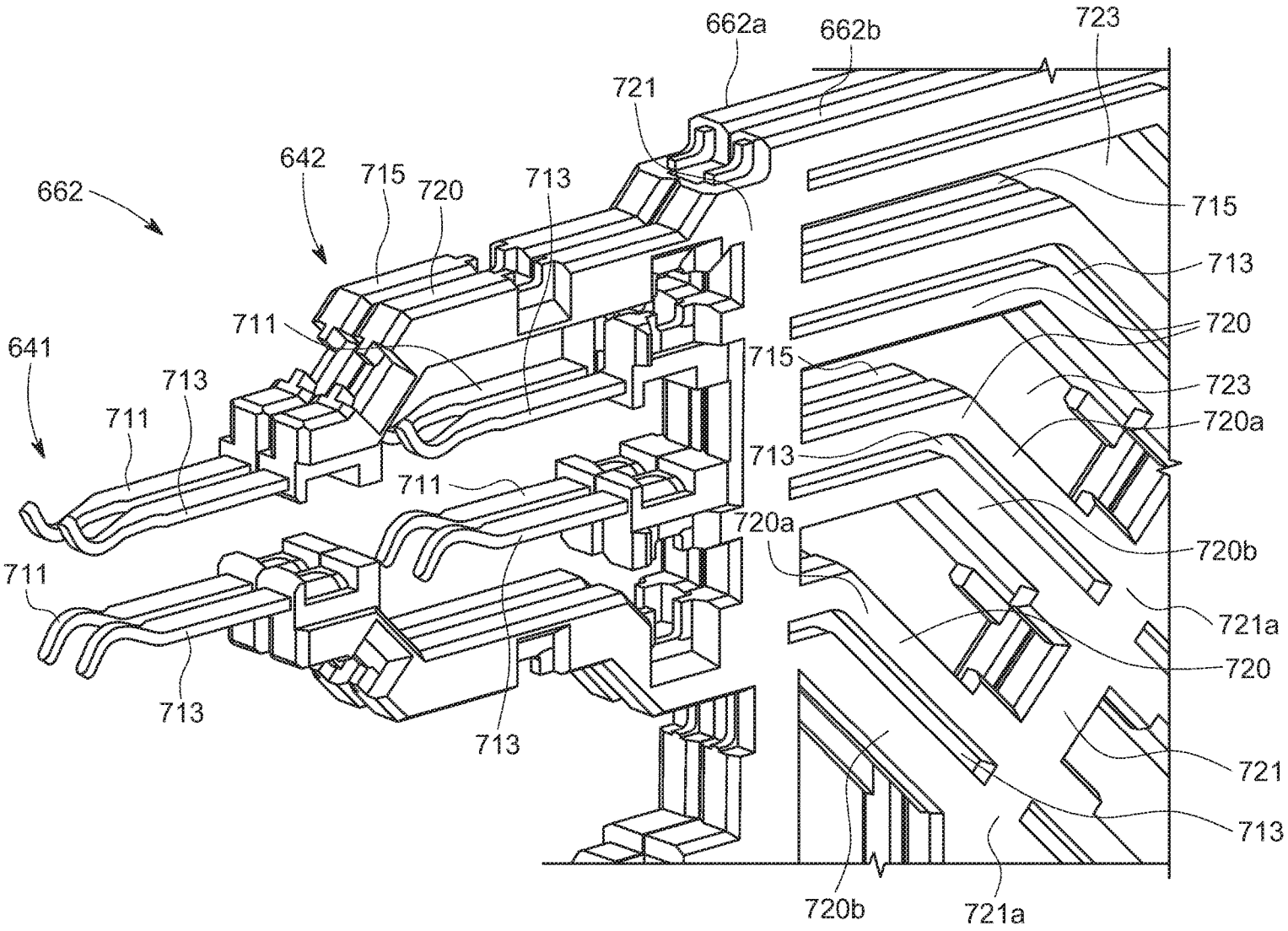
FIG. 41 illustrates a front-right enlarged perspective view of the left signaling wafers from the high-speed wafer block depicted in FIG. 32.

Referring to FIGS. 36-37, the middle ground wafer 663 includes a plurality of spaced apart raised areas or projections 735 on each of the first side 663*a* and the opposite second side 663*b*. The projections 735 are grouped together and aligned to form channels 731*a* that form a portion of the paths 730 in which the terminal webs 715, 720 of the signaling wafer pairs 662, 664 are disposed. The projections 735 are depicted as having a plurality of shapes and configurations but, in each instance, are configured to mate with or engage a similar but oppositely configured structure on the facing ground wafer 661, 665 to create a complimentary interengaging structure.

In one example, some of the projections 735*a* include a plurality of generally rectangular, spaced apart smaller projections or teeth 736. In another example, projections 735*b* include one or more round posts or projections 737, either with or without one or more rectangular projections 736. In still another example, projections 735*c* include a single rectangular projection 736. In still other examples, projections 735*d* include round receptacles and projections 735*e* include a single rectangular receptacle. The projections 735 may be linear and/or extend at an angle and are spaced apart to further define channels 732*a* in which portions of the connecting webs 716, 721 are disposed. Other configurations are contemplated. As depicted, the projections 736, 737 have different heights that may function to assist in aligning and assembling the ground wafers 661, 663, 665. In some instances, the staggered height of the projections 736, 737 may also provide improved electrical functionality.

Referring to FIG. 34, the left ground wafer 661 includes a planar first surface 661*a* and an opposite second side 661*b*. The second side 661*b* includes projections 738 that are similar to but oppositely configured as compared to the projections 735 on the first side 663*a* of the middle ground wafer 663. Using the examples described above, each of projections 738*a* mates with an oppositely configured and aligned projection 735*a*, each of projections 738*b* mates with an oppositely configured and aligned projection 735*b*, and each of projections 738*c* mates with an oppositely configured and aligned projection 735*c*. The projections 738 similarly define channels 731*b* in which portions of the terminal webs 715, 720 are disposed and channels 732*b* in which portions of the connecting webs 716, 721 are disposed. The channels 731*a* and 731*b* interact to define the shielded terminal paths 730 in which the terminal webs 715, 720 are disposed and the channels 732*a* and 732*b* interact to define the web paths 733 in which the connecting webs 716, 721 are disposed.

Similarly, the right ground wafer 665 includes a planar first surface 665*a* and an opposite second side 665*b*. The second side 665*b* includes projections 739 similar but oppositely configured as compared to the projections 735 on the second side 663*b* of the middle ground wafer 663. Using the examples described above, each of projections 739*a* mates with an oppositely configured and aligned projection 735*a*, each of projections 739*d* mates with an oppositely configured and aligned projection 735*d*, and each of projections 739*e* mates with an oppositely configured and aligned projection 735*d*. The projections 739 similarly define channels 731*b* in which portions of the terminal webs 715, 720 are disposed and channels 732*b* in which portions of the connecting webs 716, 721 are disposed. The channels 731*a* and 731*b* interact to define the terminal paths 730 in which the terminal webs 715, 720 are disposed and the channels 732*a* and 732*b* interact to define the web paths 733 in which the connecting webs 716, 721 are disposed.

Although the projections 735 on the opposite sides 663*a*, 663*b* of the middle ground wafer 663 are identically configured and therefore the projections 738 and 739 are identically configured, other configurations may be utilized provided that the projections of the ground wafers 661, 663, 665 interengage to form the terminal paths 730 formed by the terminal channels 731 and the web paths 733 formed by the web channels 732.

The ground wafers 661, 663, 665 may be secured together in any desired manner As depicted, the middle ground wafer 663 includes a plurality of recesses or receptacles 740 on the first side 663*a* and a plurality of posts 741 on the second side 663*b*. Left ground wafer 661 includes a plurality of posts 742 on the second side 661*b* that are configured to be secured within the receptacle 740 on the first side 663*a* of the middle ground wafer 663 to secure the left ground wafer and the middle ground wafer together. Right ground wafer 665 includes a plurality of receptacles 743 on the second side 665*b* that are configured to be secured to the posts 741 on the second side 663*b* of the middle ground wafer 663 to secure the right ground wafer and the middle ground wafer together. If desired, the posts 741, 742 can include crush ribs 741*a*, 742*a* to assist in securing the ground wafers 661, 663, 665 together.

To assemble a high-speed wafer block 660, the signaling wafer pair 662 is assembled by aligning and securing together the insulative frames 662*a*, 662*b* having the terminal sets 710, 712 therein. The second signaling wafer pair 664 may be assembled in the same manner The left ground wafer 661 is secured to the middle ground wafer 663 with the first signaling wafer pair 662 positioned therebetween. In doing so, the first signaling wafer pair 662 is positioned between the left ground wafer 661 and the middle ground wafer 663 with the terminal webs 715, 720 aligned with the terminal channels 731*a* in the first side 663*a* of the middle ground wafer 663 and terminal channels 731*b* in the second side 661*b* of the left ground wafer 661. The connecting webs 716, 721 are aligned with the web channels 732*a* in the first side 663*a* of the middle ground wafer 663 and web channels 732*b* in the second side 661*b* of the left ground wafer 661.

The right ground wafer 665 is secured to the middle ground wafer 663 with the second signaling wafer pair 664 positioned therebetween. In doing so, the second signaling wafer pair 664 is positioned between the middle ground wafer 663 and the right ground wafer 665 with the terminal webs 715, 720 aligned with the terminal channels 731*a* in the second side 663*a* of the middle ground wafer 663 and terminal channels 731*b* in the second side 665*b* of the right ground wafer 665. The connecting webs 716, 721 are aligned with the web channels 732*a* in the second side 663*b* of the middle ground wafer 663 and web channels 732*b* in the second side 665*b* of the right ground wafer 665.

Referring to FIGS. 51-56, the first signaling wafer pair 662 is sandwiched between the left ground wafer 661 and the middle ground wafer 663 while the second signaling wafer pair 664 is sandwiched between the middle ground wafer 663 and the right ground wafer 665. The conductive properties and structure of the ground wafers 661, 663, 665 along the terminal channels 731*a*, 731*b* provide lateral shielding and impedance control for the terminals within the signaling wafer pairs 662, 664. The projections 735 of the middle ground wafer 663 interact or interengage with the projections 738 of the left ground vertical wafer 661 and the projections 739 of the right ground wafer 665 to substantially fill the voids or openings 723 in the signaling wafer pairs 662, 664. The conductive properties and structure of the projections 735, 738, 739 within the openings 723 provide vertical shielding and impedance control for the terminals within the signaling wafer pairs 662, 664. Thus, as a result of the conductive plating on the ground wafer 661, 663, 665, the terminals 711, 713 of each differential signal pair are substantially surrounded along their entire length by conductive shielding from the ground wafers. Interruptions in the shielding occur in the gaps between the projections 735, 738, 739 that form the web channels 732. However, such interruptions are sufficiently small and infrequent so as to not significantly interrupt or affect the electrical performance of the depicted connector system.

The fully assembled structure includes terminal webs 715, 720 disposed within the terminal channels 731*a*, 731*b* and connecting webs 716, 721 disposed within the web channels 732*a*, 732*b* in a tight manner so that the assembly of the signaling wafers pairs 662, 664 and the ground wafers 661, 663, 665 form a rigid assembly. The rigidity of the assembly may assist in distributing forces on the assembly during the process of press-fitting the assembly to a circuit board.

Figure 57:
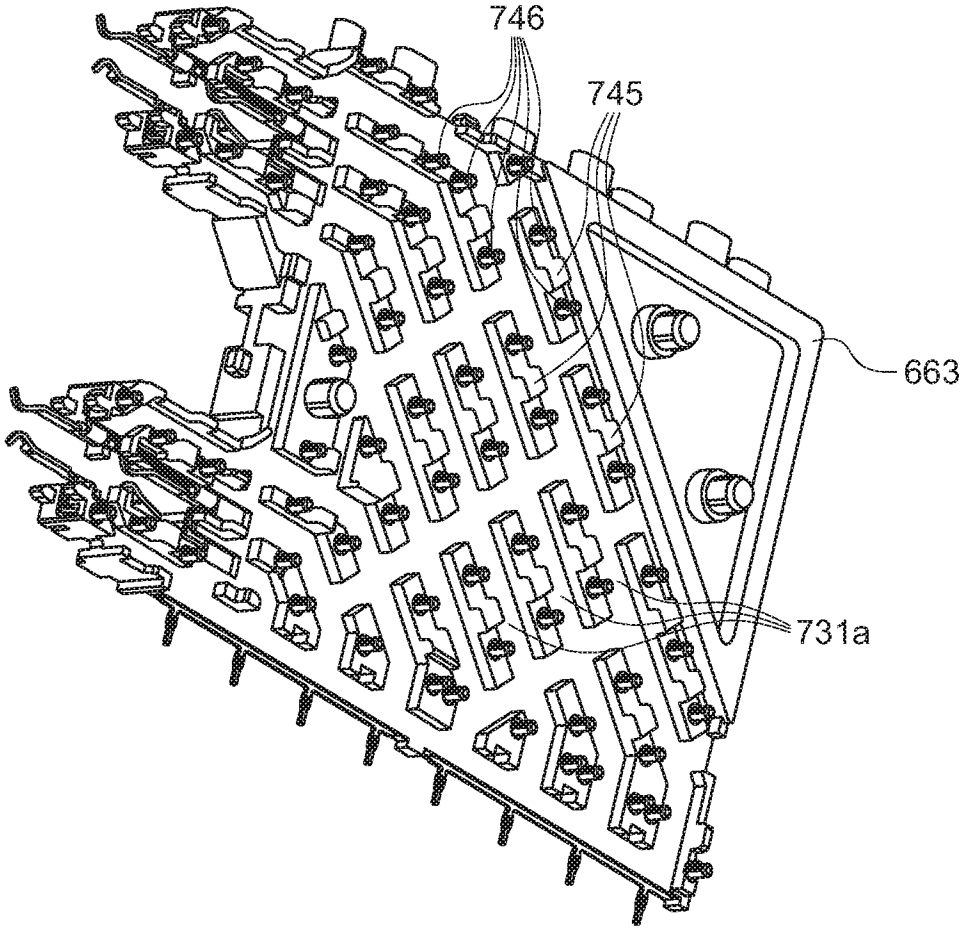
FIG. 57 illustrates a perspective view of an alternate embodiment of the middle ground wafer from the high-speed wafer block depicted in FIG. 32.

Various alternatives configurations are contemplated. For example, referring to FIG. 57, the grounding links such as projections 735, 738, 739 between the ground wafers 661, 663, 665 may have other configurations including fewer rectangular projections 745 and a greater number of cylindrical posts 746 together with complementary-shaped mating structure on the aligned ground wafers 661, 663, 665. In addition, in some embodiments, all of the grounding links may not make a galvanic or direct electrical connection with an adjacent ground wafer.

Further, rather than forming the ground wafers 661, 663, 665 of metallized plastic and inserting the metal contact inserts 668 and metal tail insert 669, ground wafers could be formed in other manners such as by stamping and forming contacts and tails as part of a leadframe assembly and then forming a metalized plastic structure around the leadframe including the contacts and tails. In other words, an alternate form of ground wafer could be formed with ground wafers similar to those depicted at 271 in FIG. 18 (i.e., a leadframe with contacts and tails) but incorporating grounding links between wafers that extend through signaling wafer pairs. The alternate ground wafers including the grounding links may be formed of metalized plastic which is then electrically connected to the leadframe within the wafers.

Still further, in another embodiment, a structure may be formed, such as of metallized plastic, that includes the projections 735, 738, 739 with such structure subsequently connected to conductive ground plates having contacts and tails. Still even further, the signal terminals may be edge coupled rather than broad-side coupled. In one example, the terminals of each differential pair can be in separate signal wafers or housings and edge coupled so that they are aligned horizontally and between a pair of ground wafers. In another example, the terminals of each differential pair can be edge coupled and aligned vertically in a housing that is between a pair of ground wafers.

Figure 58:
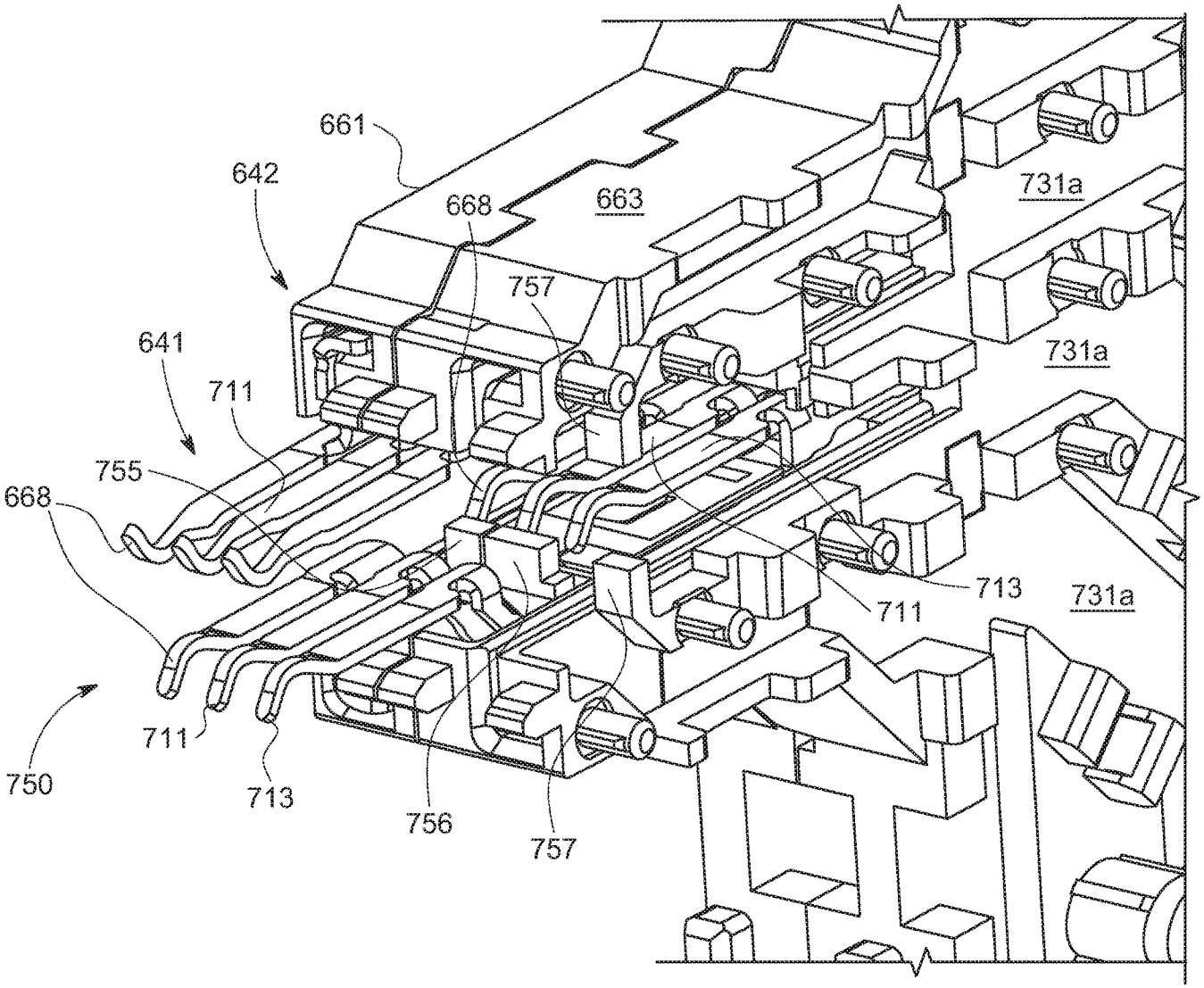
FIG. 58 illustrates an enlarged perspective view of the left ground wafer and the left signaling wafers from the high-speed wafer block depicted in FIG. 32 but with the insulators of the left signaling wafers removed for clarity.
Figure 59:
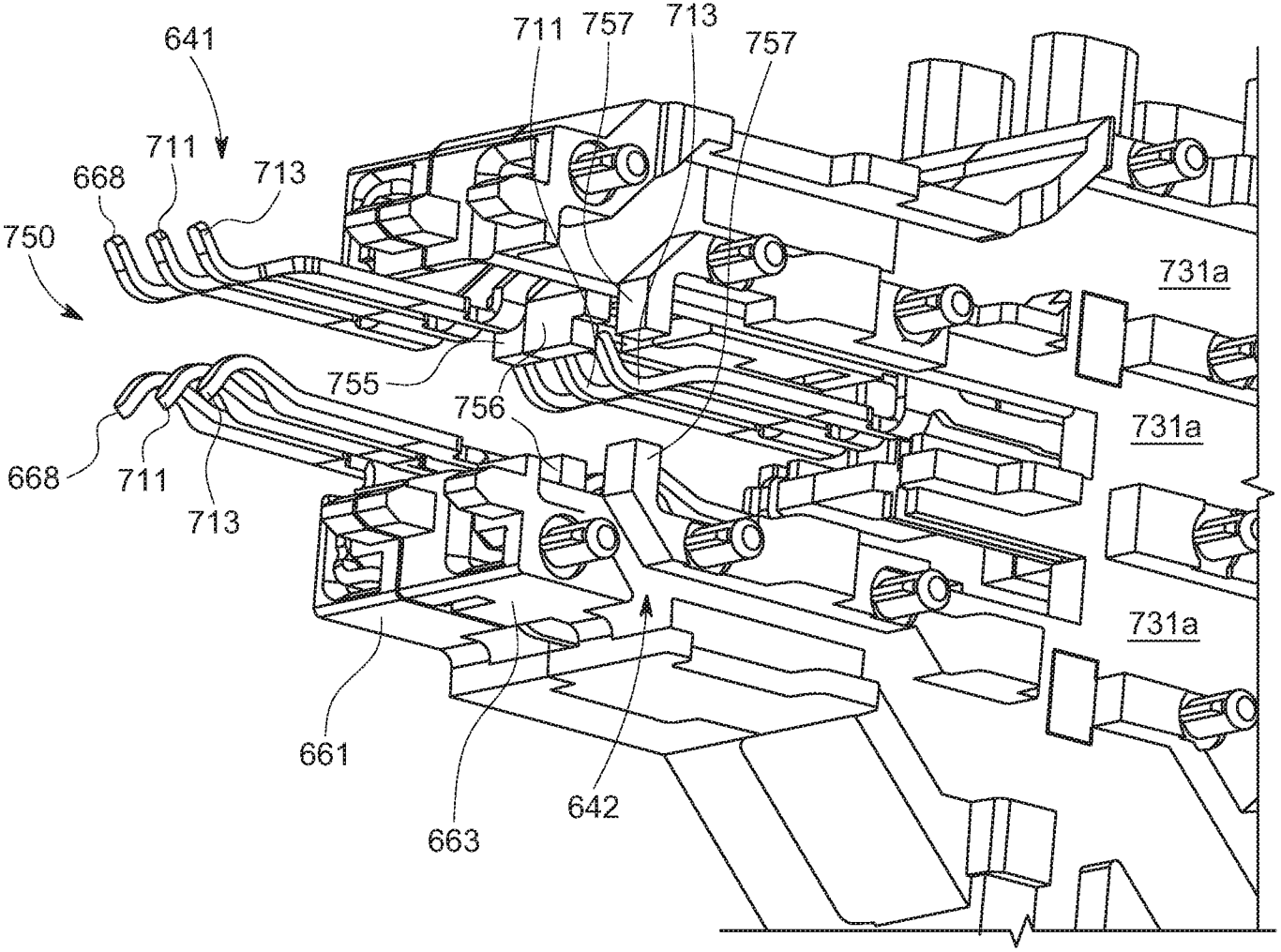
FIG. 59 illustrates another enlarged perspective view of the left ground wafer and the left signaling wafers from the high-speed wafer block depicted in FIG. 32 but with the insulators of the left signaling wafers removed for clarity.

In a further aspect, the ground wafers 661, 663, 665 may be configured to enhance the shielding between and further electrically isolate the front contact rows 641 from the rear contact rows 642 within the card slots 750, 751. More specifically, referring to FIGS. 58-59, the ground wafers 661, 663, 665 include further projections that extend laterally within the upper and lower card slots 750, 751. The left ground wafer 661 includes projections 755 within the slots 750, 751 that extend laterally from the second side 661*b* towards the middle wafer 663 and towards a horizontal centerline of the slots.

The middle ground wafer 663 includes projections 756 within the slots 750, 751 that extend laterally from the first side 663*a* towards the left ground wafer 661 and towards a horizontal centerline of the slots. The middle ground wafer 663 also includes projections 757 within the slots 750, 751 that extend laterally from the second sides 663*b* towards the right ground wafer 665 and towards a horizontal centerline of the slots. The right ground wafer 665 includes projections 758 (FIG. 44) within the slots 750, 751 that extend laterally from the second side 665*b* towards the middle wafer 663 and towards a horizontal centerline of the slots. The projections 755-58 enhance the shielding between and further electrically isolate the front contact rows 641 from the rear contact rows 642 within the card slots 750, 751. In an embodiment, the pairs of projections (e.g., 755 and 756 together with 757 and 758) may be mechanically and electrically interconnected to further enhance the shielding and isolation function.

The disclosure provided herein describes features in terms of preferred and exemplary embodiments thereof. Numerous other embodiments, modifications and variations within the scope and spirit of the appended claims will occur to persons of ordinary skill in the art from a review of this disclosure.

We claim:

1. A connector assembly comprising:

an insulative housing having a plurality of conductive signal terminals disposed therein, the insulative housing having opposite side surfaces and a plurality of openings therein extending between the side surfaces;

a first conductive ground wafer;

a second conductive ground wafer, the second ground wafer being spaced from and parallel to the first ground wafer; and a plurality of grounding links, the grounding links being electrically connected to and extending between the first and second ground wafers, the grounding links extending through the openings in the housing having a plurality of conductive signal terminals disposed therein.

2. The connector assembly of claim 1, wherein the ground wafers comprise plated plastic.

3. The connector assembly of claim 1, further comprising:

a second insulative housing having a plurality of second conductive signal terminals disposed therein, the second insulative housing having opposite side surfaces and a plurality of second openings therein extending between the side surfaces; and a third conductive ground wafer, the third ground wafer being spaced from and parallel to the second ground wafer; and a plurality of second grounding links, the second grounding links being electrically connected to and extending between the second and third ground wafers, the second grounding links extending through the second openings in the second housing.

4. The connector assembly of claim 1, wherein the grounding links comprise a plurality of projections disposed on one of the first and second wafers.

5. The connector assembly of claim 1, wherein the ground wafers comprise conductive metalized plastic.

6. The connector assembly of claim 1, wherein the grounding links comprise first projections disposed on first ground wafer and second projections disposed on the second ground wafer.

7. The connector assembly of claim 6, wherein the first projections interengage with the second projections.

8. The connector assembly of claim 1, wherein the insulative housing includes an insulative terminal web extending along each terminal and the grounding links define a plurality of terminal paths in which the terminal webs are disposed.

9. The connector assembly of claim 8, wherein each signal terminal includes a contact, a tail, and a body extending between the contact and the tail, and a terminal web extends along the entire body of each signal terminal.

10. The connector assembly of claim 9, wherein the grounding links are disposed along substantially the entire length of the body of each terminal.

11. The connector assembly of claim 10, wherein the insulative housing further includes connecting webs interconnecting the terminal webs and the grounding links are disposed to further define a plurality of web paths in which the connecting webs are disposed.

12. The connector assembly of claim 1, wherein the signal terminals are configured as pairs of differential signal terminals.

13. The connector assembly of claim 12, wherein the pairs of differential signal terminals are broad-side coupled.

14. The connector assembly of claim 13, wherein the pairs of differential signal terminals are edge coupled.

15. The connector assembly of claim 12, wherein the insulative housing includes a first signaling wafer having a plurality of first signal terminals therein and a second signaling wafer having a plurality of second signal terminals therein.

16. The connector assembly of claim 15, wherein each pair of differential signal terminals includes one of the first signal terminals and one of the second signal terminals.

17. A connector assembly comprising:

an insulative housing having a plurality of conductive signal terminals disposed therein, the insulative housing having opposite side surfaces and a plurality of openings therein extending between the side surfaces;

a first conductive ground wafer;

a second conductive ground wafer, the second ground wafer being spaced from and parallel to the first ground wafer; and a plurality of grounding links, the grounding links being electrically connected to one of the ground wafers and extending towards another of the ground wafers, the grounding links extending through the openings in the housing having a plurality of conductive signal terminals disposed therein.

18. The connector assembly of claim 17, wherein the first and second ground wafers comprise conductive metalized plastic.

19. The connector assembly of claim 17, wherein the first and second ground wafers comprise plated plastic.

* * * * *